US006222515B1

(12) United States Patent
Yamaguchi et al.

(10) Patent No.: US 6,222,515 B1
(45) Date of Patent: Apr. 24, 2001

(54) APPARATUS FOR CONTROLLING DATA VOLTAGE OF LIQUID CRYSTAL DISPLAY UNIT TO ACHIEVE MULTIPLE GRAY-SCALE

(75) Inventors: Tadahisa Yamaguchi; Kazuhiro Takahara; Masami Oda; Hisashi Yamaguchi, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 07/786,251

(22) Filed: Oct. 31, 1991

(30) Foreign Application Priority Data

Oct. 31, 1990 (JP) ..... 2-294831
Feb. 4, 1991 (JP) ..... 3-013103
Aug. 29, 1991 (JP) ..... 3-218979

(51) Int. Cl.[7] ..... G09G 3/36
(52) U.S. Cl. ..... 345/89; 345/147
(58) Field of Search ..... 245/89, 94, 96, 245/100

(56) References Cited

U.S. PATENT DOCUMENTS 4,481,511 * 11/1984 Hanmura et al. ..... 340/799
4,776,676 * 10/1988 Inone et al. ..... 345/89
4,882,710 * 11/1989 Hashimoto et al. ..... 345/189
4,921,334 5/1990 Akodes ..... 350/333
4,929,058 * 5/1990 Numao ..... 340/784
5,040,874 * 8/1991 Fukuda ..... 345/96
5,041,821 * 8/1991 Onitsuka et al. ..... 345/94
5,057,928 * 10/1991 Nagashima et al. ..... 340/784
5,058,994 * 10/1991 Mihara et al. ..... 345/89
5,091,722 * 2/1992 Kitajima et al. ..... 345/89
5,270,697 * 12/1993 Takeda ..... 345/96

FOREIGN PATENT DOCUMENTS

0071911 * 2/1983 (EP) .
2 164 190 3/1986 (GB) ..... G09G/3/36

* cited by examiner

*Primary Examiner*—Amare Mengistu
(74) *Attorney, Agent, or Firm*—Staas & Halsey LLP

(57) ABSTRACT

In a driving device of an active matrix type liquid crystal display unit including a liquid crystal display panel, a scan driver, and a data driver, a data voltage controlling apparatus is provided to achieve digital multiple gray-scale levels with little flickering. The data voltage controlling apparatus supplies the data driver with a combination of two different data voltages picked up from a plurality of digital data voltages previously set. The combination of two different data voltages are, for example, a combination of different waveforms, a combination of negative level and positive level, and a combination of two different voltages having at least a voltage difference. Further, a division of T-V characteristics and an exchange of data voltages are carried out to reduce the flickering.

24 Claims, 76 Drawing Sheets

| Fig. 1A | Fig. 1B |
|---|---|

| Fig. 16A | Fig. 16B |
|---|---|

FIGURE IN ( ) IS MEAN EFFECTIVE VOLTAGE

| Fig. 20A | Fig. 20B |
|---|---|

| VF1 | VF2 |
|---|---|
| 2.0 | 2.0 |
| 2.1 | 2.8 |
| 2.2 | 3.6 |
| 2.3 | 4.4 |
| 2.4 | 5.2 |
| 2.5 | 6.0 |
| 2.6 | 6.8 |
| 2.7 | 7.6 |

Fig. 25

| GRAY-SCALE LEVEL | INPUT DATA | | | | VOLTAGE | | BRIGHTNESS (cd/m2) |
|---|---|---|---|---|---|---|---|
| | $D_3$ | $D_2$ | $D_1$ | $D_0$ | $VF_2$ | $VF_1$ | |
| 1 | 0 | 0 | 0 | 0 | 2.0 | 2.0 | 100 |
| 2 | 0 | 0 | 0 | 1 | 2.0 | 2.4 | 85 |
| 3 | 0 | 0 | 1 | 0 | 2.0 | 2.8 | 73 |
| 4 | 0 | 0 | 1 | 1 | 2.0 | 3.2 | 64 |
| 5 | 0 | 1 | 0 | 0 | 3.6 | 2.0 | 55 |
| 6 | 0 | 1 | 0 | 1 | 3.6 | 2.4 | 48 |
| 7 | 0 | 1 | 1 | 0 | 3.6 | 2.8 | 42 |
| 8 | 0 | 1 | 1 | 1 | 3.6 | 3.2 | 36 |
| 9 | 1 | 0 | 0 | 0 | 5.2 | 2.0 | 31 |
| 10 | 1 | 0 | 0 | 1 | 5.2 | 2.4 | 26 |
| 11 | 1 | 0 | 1 | 0 | 5.2 | 2.8 | 22 |
| 12 | 1 | 0 | 1 | 1 | 5.2 | 3.2 | 20 |
| 13 | 1 | 1 | 0 | 0 | 6.8 | 2.0 | 15 |
| 14 | 1 | 1 | 0 | 1 | 6.8 | 2.4 | 11 |
| 15 | 1 | 1 | 1 | 0 | 6.8 | 2.8 | 8 |
| 16 | 1 | 1 | 1 | 1 | 6.8 | 3.2 | 5 |

Fig. 26

| GRAY-SCALE LEVEL | INPUT DATA | | | | OUTPUT DATA | | | |
|---|---|---|---|---|---|---|---|---|
| | $D_3$ | $D_2$ | $D_1$ | $D_0$ | $D_3$ | $D_2$ | $D_1$ | $D_0$ |
| 1 | 0 | 0 | 0 | 0 | 0 | 0 | 0 | 0 |
| 2 | 0 | 0 | 0 | 1 | 0 | 0 | 0 | 1 |
| 3 | 0 | 0 | 1 | 0 | 0 | 0 | 1 | 0 |
| 4 | 0 | 0 | 1 | 1 | 0 | 0 | 1 | 1 |
| 5 | 0 | 1 | 0 | 0 | 0 | 1 | 0 | 0 |
| 6 | 0 | 1 | 0 | 1 | 0 | 1 | 0 | 1 |
| 7 | 0 | 1 | 1 | 0 | 0 | 1 | 1 | 0 |
| 8 | 0 | 1 | 1 | 1 | 0 | 1 | 1 | 1 |
| 9 | 1 | 0 | 0 | 0 | 1 | 0 | 0 | 0 |
| 10 | 1 | 0 | 0 | 1 | 1 | 0 | 0 | 1 |
| 11 | 1 | 0 | 1 | 0 | 1 | 0 | 1 | 0 |
| 12 | 1 | 0 | 1 | 1 | 1 | 1 | 0 | 0 |
| 13 | 1 | 1 | 0 | 0 | 1 | 0 | 1 | 1 |
| 14 | 1 | 1 | 0 | 1 | 1 | 1 | 0 | 1 |
| 15 | 1 | 1 | 1 | 0 | 1 | 1 | 1 | 0 |
| 16 | 1 | 1 | 1 | 1 | 1 | 1 | 1 | 1 |

SWAPPING

| Fig. 28A | Fig. 28B |
|---|---|

| Fig. 30A | Fig. 30B |
|---|---|

| VF1 | VF2 |
|---|---|
| 2.0 | 2.0 |
| 2.1 | 2.4 |
| 2.2 | 2.8 |
| 2.3 | 3.2 |
| 2.8 | 2.8 |
| 2.9 | 3.2 |
| 3.0 | 3.6 |
| 3.1 | 4.0 |
| 3.6 | 3.6 |
| 3.7 | 4.0 |
| 3.8 | 4.4 |
| 3.9 | 4.6 |
| 4.4 | 4.4 |
| 4.5 | 4.8 |
| 4.6 | 5.2 |
| 4.7 | 5.6 |

Fig. 34

| GRAY-SCALE | D5 | D4 | D3 | D2 | D1 | D0 | VF2 | VF1 |
|---|---|---|---|---|---|---|---|---|
| 0 | 0 | 0 | 0 | 0 | 0 | 0 | 2.0 | 2.0 |
| 1 | 0 | 0 | 0 | 0 | 0 | 1 | 2.0 | 2.1 |
| 2 | 0 | 0 | 0 | 0 | 1 | 0 | 2.0 | 2.2 |
| 3 | 0 | 0 | 0 | 0 | 1 | 1 | 2.0 | 2.3 |
| 4 | 0 | 0 | 0 | 1 | 0 | 0 | 2.4 | 2.0 |
| 5 | 0 | 0 | 0 | 1 | 0 | 1 | 2.4 | 2.1 |
| 6 | 0 | 0 | 0 | 1 | 1 | 0 | 2.4 | 2.2 |
| 7 | 0 | 0 | 0 | 1 | 1 | 1 | 2.4 | 2.3 |
| 8 | 0 | 0 | 1 | 0 | 0 | 0 | 2.8 | 2.0 |
| 9 | 0 | 0 | 1 | 0 | 0 | 1 | 2.8 | 2.1 |
| 10 | 0 | 0 | 1 | 0 | 1 | 0 | 2.8 | 2.2 |
| 11 | 0 | 0 | 1 | 0 | 1 | 1 | 2.8 | 2.3 |
| 12 | 0 | 0 | 1 | 1 | 0 | 0 | 3.2 | 2.0 |
| 13 | 0 | 0 | 1 | 1 | 0 | 1 | 3.2 | 2.1 |
| 14 | 0 | 0 | 1 | 1 | 1 | 0 | 3.2 | 2.2 |
| 15 | 0 | 0 | 1 | 1 | 1 | 1 | 3.2 | 2.3 |
| 16 | 0 | 1 | 0 | 0 | 0 | 0 | 2.8 | 2.8 |
| 17 | 0 | 1 | 0 | 0 | 0 | 1 | 2.8 | 2.9 |
| 18 | 0 | 1 | 0 | 0 | 1 | 0 | 2.8 | 3.0 |
| 19 | 0 | 1 | 0 | 0 | 1 | 1 | 2.8 | 3.1 |
| 20 | 0 | 1 | 0 | 1 | 0 | 0 | 3.2 | 2.8 |
| 21 | 0 | 1 | 0 | 1 | 0 | 1 | 3.2 | 2.9 |
| 22 | 0 | 1 | 0 | 1 | 1 | 0 | 3.2 | 3.0 |
| 23 | 0 | 1 | 0 | 1 | 1 | 1 | 3.2 | 3.1 |
| 24 | 0 | 1 | 1 | 0 | 0 | 0 | 3.6 | 2.8 |
| 25 | 0 | 1 | 1 | 0 | 0 | 1 | 3.6 | 2.9 |
| 26 | 0 | 1 | 1 | 0 | 1 | 0 | 3.6 | 3.0 |
| 27 | 0 | 1 | 1 | 0 | 1 | 1 | 3.6 | 3.1 |
| 28 | 0 | 1 | 1 | 1 | 0 | 0 | 4.0 | 2.8 |
| 29 | 0 | 1 | 1 | 1 | 0 | 1 | 4.0 | 2.9 |
| 30 | 0 | 1 | 1 | 1 | 1 | 0 | 4.0 | 3.0 |
| 31 | 0 | 1 | 1 | 1 | 1 | 1 | 4.0 | 3.1 |

| GRAY-SCALE | D5 | D4 | D3 | D2 | D1 | D0 | VF2 | VF1 |
|---|---|---|---|---|---|---|---|---|
| 32 | 1 | 0 | 0 | 0 | 0 | 0 | 3.6 | 3.6 |
| 33 | 1 | 0 | 0 | 0 | 0 | 1 | 3.6 | 3.7 |
| 34 | 1 | 0 | 0 | 0 | 1 | 0 | 3.6 | 3.8 |
| 35 | 1 | 0 | 0 | 0 | 1 | 1 | 3.6 | 3.9 |
| 36 | 1 | 0 | 0 | 1 | 0 | 0 | 4.0 | 3.6 |
| 37 | 1 | 0 | 0 | 1 | 0 | 1 | 4.0 | 3.7 |
| 38 | 1 | 0 | 0 | 1 | 1 | 0 | 4.0 | 3.8 |
| 39 | 1 | 0 | 0 | 1 | 1 | 1 | 4.0 | 3.9 |
| 40 | 1 | 0 | 1 | 0 | 0 | 0 | 4.4 | 3.6 |
| 41 | 1 | 0 | 1 | 0 | 0 | 1 | 4.4 | 3.7 |
| 42 | 1 | 0 | 1 | 0 | 1 | 0 | 4.4 | 3.8 |
| 43 | 1 | 0 | 1 | 0 | 1 | 1 | 4.4 | 3.9 |
| 44 | 1 | 0 | 1 | 1 | 0 | 0 | 4.8 | 3.6 |
| 45 | 1 | 0 | 1 | 1 | 0 | 1 | 4.8 | 3.7 |
| 46 | 1 | 0 | 1 | 1 | 1 | 0 | 4.8 | 3.8 |
| 47 | 1 | 0 | 1 | 1 | 1 | 1 | 4.8 | 3.9 |
| 48 | 1 | 1 | 0 | 0 | 0 | 0 | 4.4 | 4.4 |
| 49 | 1 | 1 | 0 | 0 | 0 | 1 | 4.4 | 4.5 |
| 50 | 1 | 1 | 0 | 0 | 1 | 0 | 4.4 | 4.6 |
| 51 | 1 | 1 | 0 | 0 | 1 | 1 | 4.4 | 4.7 |
| 52 | 1 | 1 | 0 | 1 | 0 | 0 | 4.8 | 4.4 |
| 53 | 1 | 1 | 0 | 1 | 0 | 1 | 4.8 | 4.5 |
| 54 | 1 | 1 | 0 | 1 | 1 | 0 | 4.8 | 4.6 |
| 55 | 1 | 1 | 0 | 1 | 1 | 1 | 4.8 | 4.7 |
| 56 | 1 | 1 | 1 | 0 | 0 | 0 | 5.2 | 4.4 |
| 57 | 1 | 1 | 1 | 0 | 0 | 1 | 5.2 | 4.5 |
| 58 | 1 | 1 | 1 | 0 | 1 | 0 | 5.2 | 4.6 |
| 59 | 1 | 1 | 1 | 0 | 1 | 1 | 5.2 | 4.7 |
| 60 | 1 | 1 | 1 | 1 | 0 | 0 | 5.6 | 4.4 |
| 61 | 1 | 1 | 1 | 1 | 0 | 1 | 5.6 | 4.5 |
| 62 | 1 | 1 | 1 | 1 | 1 | 0 | 5.6 | 4.6 |
| 63 | 1 | 1 | 1 | 1 | 1 | 1 | 5.6 | 4.7 |

| Fig. 40A | Fig. 40B |
|---|---|

| Fig.42A | Fig.42B |
|---|---|

Fig. 43

| GRAY-SCALE | INPUT DATA | | | | DATA FOR FIRST FIELD | | | DATA FOR SECOND FIELD | | |
|---|---|---|---|---|---|---|---|---|---|---|
| | $D_3$ | $D_2$ | $D_1$ | $D_0$ | $*D_2$ | $*D_1$ | $*D_0$ | $*D_2$ | $*D_1$ | $*D_0$ |
| 1 | 0 | 0 | 0 | 0 | 1 | 0 | 0 | 0 | 0 | 0 |
| 2 | 0 | 0 | 0 | 1 | 0 | 0 | 0 | 0 | 0 | 1 |
| 3 | 0 | 0 | 1 | 0 | 0 | 0 | 1 | 0 | 0 | 1 |
| 4 | 0 | 0 | 1 | 1 | 0 | 0 | 1 | 0 | 1 | 0 |
| 5 | 0 | 1 | 0 | 0 | 0 | 1 | 0 | 0 | 1 | 0 |
| 6 | 0 | 1 | 0 | 1 | 0 | 1 | 0 | 0 | 1 | 1 |
| 7 | 0 | 1 | 1 | 0 | 0 | 1 | 1 | 0 | 1 | 1 |
| 8 | 0 | 1 | 1 | 1 | 0 | 1 | 1 | 1 | 0 | 0 |
| 9 | 1 | 0 | 0 | 0 | 1 | 0 | 0 | 1 | 0 | 0 |
| 10 | 1 | 0 | 0 | 1 | 1 | 0 | 0 | 1 | 0 | 0 |
| 11 | 1 | 0 | 1 | 0 | 1 | 0 | 1 | 1 | 0 | 1 |
| 12 | 1 | 0 | 1 | 1 | 1 | 0 | 1 | 1 | 1 | 0 |
| 13 | 1 | 1 | 0 | 0 | 1 | 1 | 0 | 1 | 1 | 0 |
| 14 | 1 | 1 | 0 | 1 | 1 | 1 | 1 | 1 | 1 | 0 |
| 15 | 1 | 1 | 1 | 0 | 1 | 1 | 0 | 1 | 1 | 1 |
| 16 | 1 | 1 | 1 | 1 | 1 | 1 | 1 | 1 | 1 | 1 |

Fig. 44

| GRAY-SCALE | INPUT DATA | | | | FIRST FIELD POWER SOURCE VOLTAGE $F_1$ | | | | | | | | SECOND FIELD POWER SOURCE VOLTAGE $F_2$ | | | | | | | | MEAN OUTPUT VOLTAGE |
|---|---|---|---|---|---|---|---|---|---|---|---|---|---|---|---|---|---|---|---|---|---|
| | $D_3$ | $D_2$ | $D_1$ | $D_0$ | $V_8$ | $V_7$ | $V_6$ | $V_5$ | $V_4$ | $V_3$ | $V_2$ | $V_1$ | $V_9$ | $V_7$ | $V_6$ | $V_5$ | $V_4$ | $V_3$ | $V_2$ | $V_1$ | |
| 1 | 0 | 0 | 0 | 0 | 0 | 0 | 0 | 0 | 0 | 0 | 0 | 1 | 0 | 0 | 0 | 0 | 0 | 0 | 0 | 1 | $V_1$ |
| 2 | 0 | 0 | 0 | 1 | | | | | | 0 | 0 | 1 | | | | | | 0 | 1 | 0 | $(V_1+V_2)/2$ |
| 3 | 0 | 0 | 1 | 0 | | | | | | 0 | 1 | 0 | | | | | | 0 | 1 | | $V_2$ |
| 4 | 0 | 0 | 1 | 1 | | | | | | 0 | 1 | | | | | | | 1 | 0 | | $(V_2+V_3)/2$ |
| 5 | 0 | 1 | 0 | 0 | | | | | 0 | 1 | 0 | | | | | | 0 | 1 | | | $V_3$ |
| 6 | 0 | 1 | 0 | 1 | | | | | 0 | 1 | | | | | | | 1 | 0 | | | $(V_3+V_4)/2$ |
| 7 | 0 | 1 | 1 | 0 | | | | 0 | 1 | 0 | | | | | | 0 | 1 | | | | $V_4$ |
| 8 | 0 | 1 | 1 | 1 | | | | 0 | 1 | | | | | | | 1 | 0 | | | | $(V_4+V_5)/2$ |
| 9 | 1 | 0 | 0 | 0 | | | 0 | 1 | 0 | | | | | | 0 | 1 | | | | | $V_5$ |
| 10 | 1 | 0 | 0 | 1 | | | 0 | 1 | | | | | | | 1 | 0 | | | | | $(V_5+V_6)/2$ |
| 11 | 1 | 0 | 1 | 0 | | 0 | 1 | 0 | | | | | | 0 | 1 | | | | | | $V_6$ |
| 12 | 1 | 0 | 1 | 1 | | 0 | 1 | | | | | | | 1 | 0 | | | | | | $(V_6+V_7)/2$ |
| 13 | 1 | 1 | 0 | 0 | 0 | 1 | 0 | | | | | | | 1 | | | | | | | $V_7$ |
| 14 | 1 | 1 | 0 | 1 | 1 | 0 | | | | | | | 0 | 1 | | | | | | | $(V_8+V_7)/2$ |
| 15 | 1 | 1 | 1 | 0 | 0 | 1 | | | | | | | 1 | 0 | | | | | | | $(V_7+V_9)/2$ |
| 16 | 1 | 1 | 1 | 1 | 1 | 0 | 0 | 0 | 0 | 0 | 0 | 0 | 1 | 0 | 0 | 0 | 0 | 0 | 0 | 0 | $(V_8+V_9)/2$ |

Fig. 45

WHITE LEVEL

BLACK LEVEL

| GRAY-SCALE | VF1 (V) | VF2 (V) | MEAN VOLTAGE (V) | VOLTAGE DIFFERENCE \| VF1 − VF2 \| (V) |
|---|---|---|---|---|
| 1 | 2. 0 | 2. 0 | 2. 0 | 0 |
| 2 | 2. 0 | 2. 4 | 2. 2 | 0. 4 |
| 3 | 2. 4 | 2. 4 | 2. 4 | 0 |
| 4 | 2. 4 | 2. 8 | 2. 6 | 0. 4 |
| 5 | 2. 8 | 2. 8 | 2. 8 | 0 |
| 6 | 2. 8 | 3. 2 | 3. 0 | 0. 4 |
| 7 | 3. 2 | 3. 2 | 3. 2 | 0 |
| 8 | 3. 2 | 3. 6 | 3. 4 | 0. 4 |
| 9 | 3. 6 | 3. 6 | 3. 6 | 0 |
| 10 | 3. 6 | 4. 0 | 3. 8 | 0. 4 |
| 11 | 4. 0 | 4. 0 | 4. 0 | 0 |
| 12 | 4. 0 | 4. 4 | 4. 2 | 0. 4 |
| 13 | 4. 4 | 4. 4 | 4. 4 | 0 |
| 14 | 4. 8 | 4. 4 | 4. 6 | 0. 4 |
| 15 | 4. 4 | 5. 2 | 4. 8 | * 0. 8 |
| 16 | 4. 8 | 5. 2 | 5. 0 | 0. 4 |

(m, n) : CELL COODINATES

| Fig. 33A | Fig. 33B |
|---|---|

Fig. 54

| GROUP | FIRST FIELD VF1 | SECOND FIELD VF2 |
|---|---|---|
| 1 | 2.0<br>2.1<br>2.2<br>2.3 | 2.0<br>2.4<br>2.8<br>3.2 |
| 2 | 2.8<br>2.9<br>3.0<br>3.1 | 2.8<br>3.2<br>3.6<br>4.0 |
| 3 | 3.6<br>3.7<br>3.8<br>3.9 | 3.6<br>4.0<br>4.4<br>4.8 |
| 4 | 4.4<br>4.5<br>4.6<br>4.7 | 4.4<br>4.8<br>5.2<br>5.6 |

Fig. 58

| GROUP | FIRST FIELD VF1 | SECOND FIELD VF2 |
|---|---|---|
| 1 | 2.2<br>2.3<br>2.4<br>2.5 | 1.8<br>2.2<br>2.6<br>3.0 |
| 2 | 3.0<br>3.1<br>3.2<br>3.3 | 2.6<br>3.0<br>3.4<br>3.8 |
| 3 | 3.8<br>3.9<br>4.0<br>4.1 | 3.4<br>3.8<br>4.2<br>4.6 |
| 4 | 4.6<br>4.7<br>4.8<br>4.9 | 4.2<br>4.6<br>5.0<br>5.4 |

APPARATUS FOR CONTROLLING DATA VOLTAGE OF LIQUID CRYSTAL DISPLAY UNIT TO ACHIEVE MULTIPLE GRAY-SCALE

BACKGROUND OF THE INVENTION

1) Field of the invention

The present invention relates to an apparatus for controlling the data voltage of liquid crystal display unit to achieve multiple gray-scale, levels and particularly to the apparatus for controlling the data voltage of an active matrix liquid crystal display unit that is useful for a field of flat display panels to achieve digital multiple gray-scale levels.

2) Description of the Related Art

In recent years, information terminals such as personal computers and word processors have become small-sized, high performance, and high function. Many compact information processors of the desktop type, laptop type, and even smaller notebook type and palmtop type are being marketed.

To reduce the size and weight of these information terminals, light-weight and thin display units are required. For this purpose, liquid crystal display units are frequently employed in place of cathode ray tubes (CRTs), which are usually employed for desktop information terminals. The liquid crystal display units include simple matrix liquid crystal display units such as TN (Twisted Nematic) display units and STN (Super Twisted Nematic) display units. Compared with these simple matrix display units, active matrix liquid crystal display units such as TFT (Thin Film Transistor) and MIM (Metal Insulator Metal) display units are frequently used in a field for displaying high quality color images with multiple gray-scale levels, because the active matrix display units are capable of precisely controlling intermediate gray-scale levels, ensuring high contrast ratios, and providing a high response speed, compared with the simple matrix display units.

For the active matrix liquid crystal display units, presently available digital driver ICs for selecting voltage levels for assigning gray-scale levels can handle only eight gray-scale levels. Even driver ICs presently being developed can operate only up to 16 gray-scale levels. To assign multiple gray-scale levels of more than 16 levels, expensive analog drivers must be employed to drive data. This prevents reducing the cost of liquid crystal display units.

Various studies have been made to increase the number of gray-scale levels with proper use of digital driver ICs. For example, a driver having a capacity of eight gray-scale levels may be employed. First, groups each involving eight power source voltages are prepared and temporarily switched from one to another and combined together, to realize a number of gray-scale levels greater than the number of the power sources.

In this case, if a difference between voltages that are combined together is extremely large, transmissivity based on an average of the combined voltages may deviate from a required value, or a gray-scale level may be swapped with another one, to deteriorate the quality of the gray-scale level assignment.

It is required, therefore, to provide an inexpensive digital data driver that can correctly assign multiple gray-scale levels.

Conventional active matrix liquid crystal display units that achieve good display quality include those employing TFTs.

The TFT display units involve many thin film transistors and pixel capacitance between two electrode layers to form a liquid crystal panel, and a display voltage is written in an optional capacitance through corresponding thin film transistors.

Brightness of the pixel depends on the written voltage. For example, "n" pieces of write voltages may be prepared to provide "n" gray-scale levels.

The n write voltages may be generated as follows:

(1) A predetermined constant voltage is amplified through an operational amplifier whose amplification factor is variable in multiple steps (in this case, n steps). (This will be referred to as the first generation method.)

(2) Two constant voltages are divided by resistances into n kinds of voltages, and one of which is selected by a switching element. (This will be referred to as the second generation method.)

Since the first generation method amplifies the predetermined constant voltage through the operational amplifier, it has the problem that a minimum variable width of the amplification factor is determined by the accuracy of the operational amplifier.

Since the second generation method selects one of the two constant voltages through the switching element, it has the problem that the number of the voltage dividing resistances and switching elements must be increased to expand a circuit scale.

Namely, any one of the above methods cannot easily increase the number (n) of generated voltages, and therefore, cannot further increase the number of gray-scale levels.

According to the development of GUI (Graphic User Interface) in recent years, requirements for multiple colors in computer displays have escalated from the conventional eight or 16 colors to 4096 colors with 16 gray-scale levels, or over 260,000 colors with 64 gray-scale levels. At present, however, about 512 colors with 8 gray-scale levels is the maximum, due to the reasons mentioned above. This is completely insufficient to meet the above requirements for multiple colors.

SUMMARY OF THE INVENTION

An object of the present invention is to provide an apparatus for controlling the data voltage of a liquid crystal display unit that can realize a multiple gray-scale level display of high quality without increasing a circuit scale.

Accordingly to the present invention is an apparatus for controlling data voltage of a liquid crystal display unit having a liquid crystal display panel, scan driver, and data driver to display an image of one frame composed of a plurality of fields. The apparatus of the present invention is composed of a timing signal generating means for generating at least timing signals for the scan driver and the data driver, and a timing signal for switching each field; a data voltage selecting signal generating means for generating a data voltage selecting signal by which data voltages applied on liquid crystal elements become different for each field in accordance with an input data signal and outputting the same to the data driver; and a voltage applying means for generating more data voltage levels than the number of fields of one frame, to apply different data voltage levels for each of the field in accordance with the data voltage selecting signal and outputting the same to the data driver and a common electrode provided in the liquid crystal display panel. In addition, the data driver selectively applies a data voltage among the applied voltage levels to the liquid crystal element, in accordance with the data voltage selecting signal, thereby assigning a gray-scale level according to a mean effective voltage of the voltage levels applied to each of the fields of the one frame.

In this way, the present invention assigns a gray-scale level according to a mean effective voltage of voltage levels applied to fields of one frame. This technique easily assigns multiple gray-scale levels without increasing circuit scale.

The invention changes the combination and/or phase of voltage levels applied to adjacent pixels, to suppress flickering. The invention may increase a scan frequency according to the number of fields in a frame, to further suppress the flickering.

In addition, the invention restricts a voltage difference applied to each frame below a predetermined value, to surely reduce flickering between a plurality of cells.

The invention substantially equalizes the averages of combinations of voltage levels set for a plurality of fields, thereby suppressing differences in the combined voltages, and securing the quality of a gray-scale level assignment.

BRIEF DESCRIPTION OF THE DRAWINGS

The present invention will be more clearly understood from the description as set forth below, with reference to the accompanying drawings wherein:

FIG. 25 is an explanatory table showing a principle of swapping deviated gray-scale levels with each other;

FIG. 26 is a view showing a conversion table of display data;

FIG. 34 is a table showing gray-scale levels and the combinations of digital inputs;

FIG. 43 is a table showing a conversion table of a data conversion circuit;

FIG. 44 is a table showing a relationship between input data (an gray-scale level), selected power source voltages (for first and second fields), and a mean output voltage;

FIG. 45 is a table showing combinations of voltages for 16 gray-scale levels, mean voltages, and voltage differences;

FIG. 54 is a table showing set voltages calculated by conventional equations;

FIG. 58 is a table showing set voltages calculated by equations of the present invention;

DESCRIPTION OF THE PREFERRED EMBODIMENTS

Figures 1, 1A:
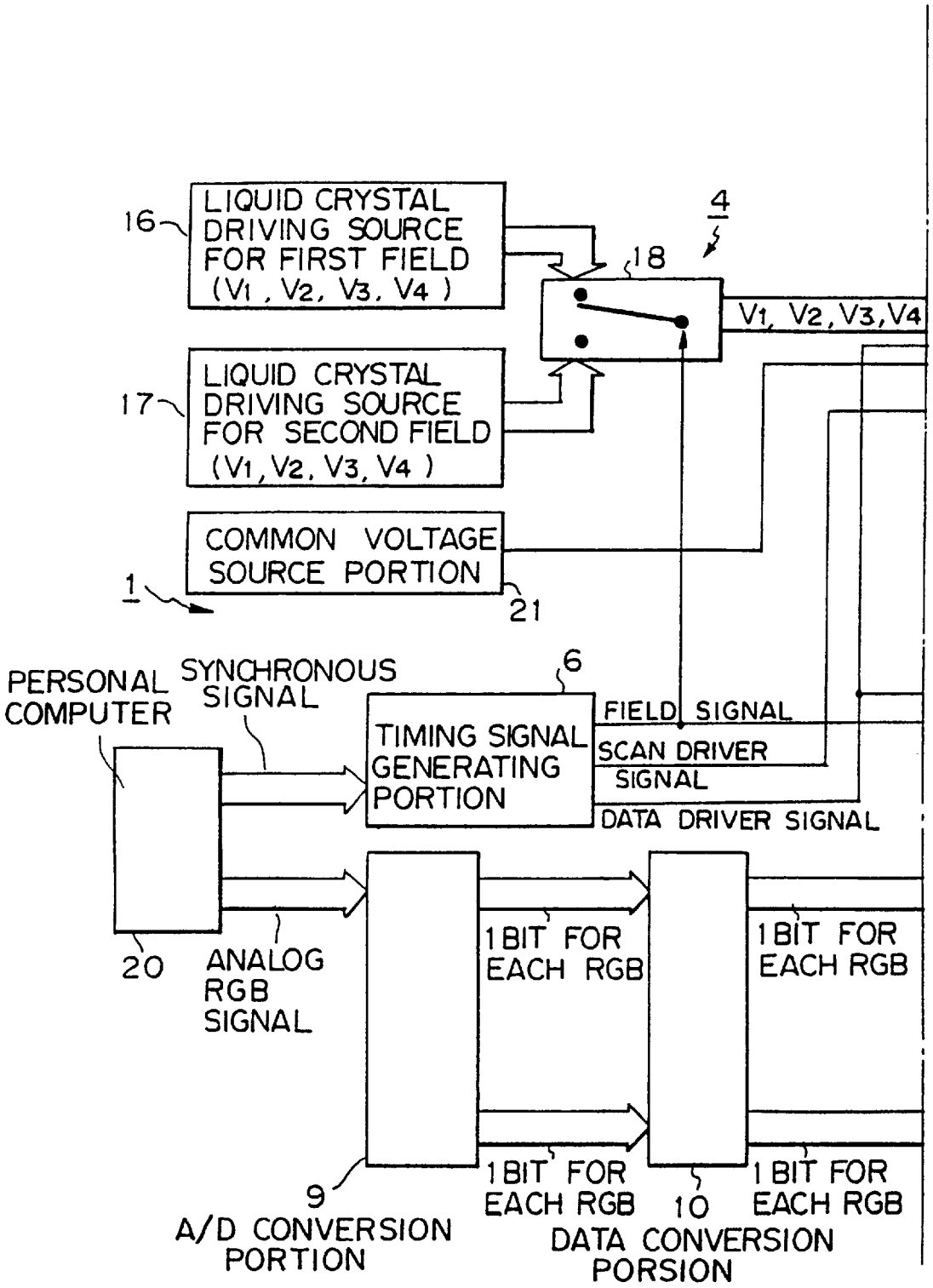
FIGS. 1A and 1B is a block diagram showing a general arrangement of a first embodiment.
Figure 1B:
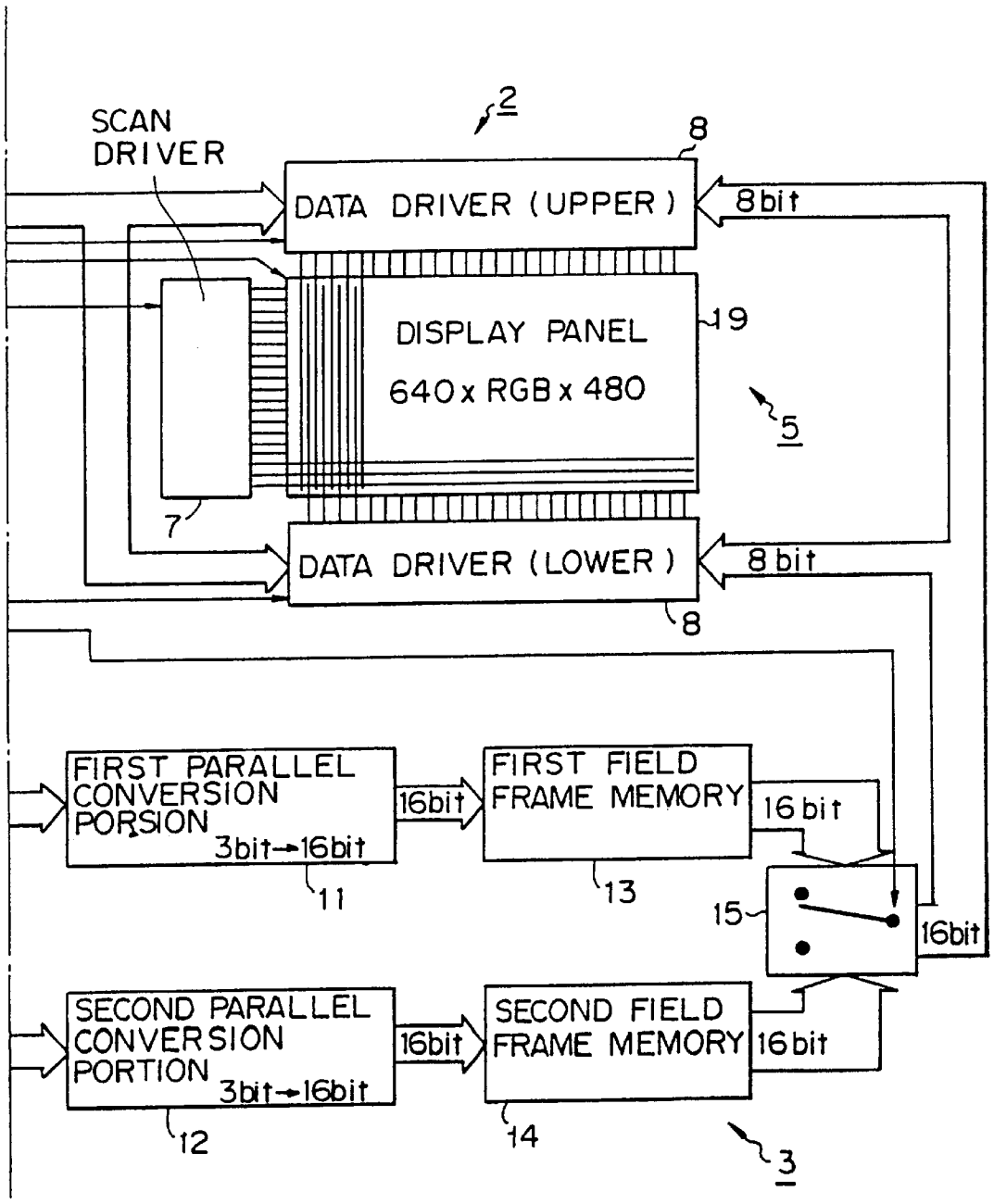

FIGS. 1 through 15F are views showing a liquid crystal display unit according to a first embodiment of the present invention, in which FIGS. 1A and 1B are a block diagram showing a general arrangement of the first embodiment. The arrangement of the first embodiment will be explained below.

In FIGS. 1A and 1B, the liquid crystal display unit 1 of the first embodiment basically comprises a pixel selecting part 2, a data signal generating part 3, a voltage applying part 4, a liquid crystal display part 5, and a timing signal generating portion 6. This embodiment is an example that realizes four gray-scale levels using a data driver for two gray-scale levels. The pixel selecting part 2 involves a scan driver 7, and data drivers 8. The data signal generating part 3 involves an A/D conversion portion 9, a data conversion portion 10, a first parallel conversion portion 11, a second parallel conversion portion 12, a first-field frame memory 13, a second-field frame memory 14, and a display data switching portion 15. The voltage applying part 4 involves a first-frame liquid crystal driving source 16 serving as a voltage applying portion, a second-frame liquid crystal driving source 17 serving as the voltage applying portion, a driving source switching portion 18, and a common voltage source portion 21. The liquid crystal display part 5 involves a liquid crystal display panel 19.

Figure 2:
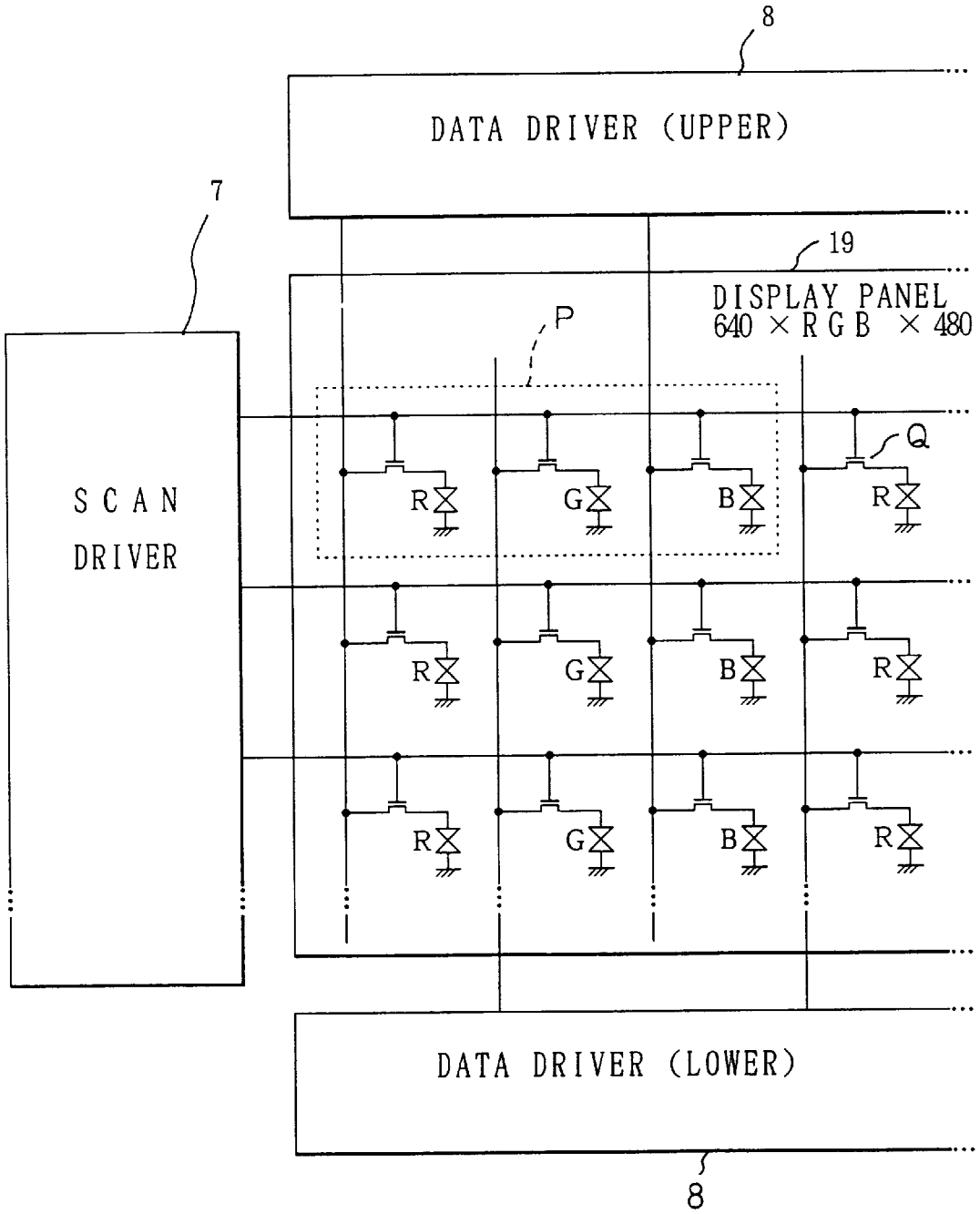
FIG. 2 is a circuit diagram showing a detailed construction of the liquid crystal panel shown in FIGS. 1A and 1B.

FIG. 2 shows a detailed construction of the liquid crystal display panel 19. The liquid crystal display panel 19 involves 480 scan lines connected to the scan driver 7 respectively, 320 data lines for each of RGB the elements connected to the upper data driver 8 and 320 data lines for each of RGB the elements connected to the lower data driver 8. A thin film transistor (TFT) Q is provided close to every crossing point of each scan line and data line with its gate connected to the scan line, source connected to the data line, and drain connected to a liquid crystal element. And as shown by the dotted line, three liquid crystal elements of R, G, and B form one pixel P. Accordingly, the liquid crystal display panel 19 is a TFT active matrix liquid crystal display panel.

Numeral 20 denotes a personal computer serving as an external device for providing data to be displayed on the liquid crystal display unit 1. The personal computer 20 provides the liquid crystal display unit 1 with analog RGB signals and synchronous signals through an analog RGB interface. In this embodiment, the data drivers 8 are for STN type liquid crystal, so that the digital data for each of R, G, and B requires only one bit.

The timing signal generating portion 6 generates timing signals necessary for predetermined processes according to the synchronous signals, i.e., horizontal and vertical synchronous signals provided by the personal computer 20. For example, timing signals are generated by the timing signal generating portion 6, a scan driver signal, a data driver signal, and a field signal.

The A/D conversion portion 9 digitizes the analog RGB signals provided by the personal computer 20, i.e., quantizes colors R, G, and B each with two bits. The A/D conversion portion 9 divides the digitized signal in half into two and outputs them separately as one bit signal for each R, G, and B to the data conversion portion 10.

The data conversion portion 10 converts digital display data provided by the A/D conversion portion 9 depending on a driving method.

The first and second parallel conversion portions 11 and 12 each convert a parallel RGB signal of three bits for colors R, G, and B provided by the data conversion portion 10 into a parallel 16-bit image signal.

Figure 3:
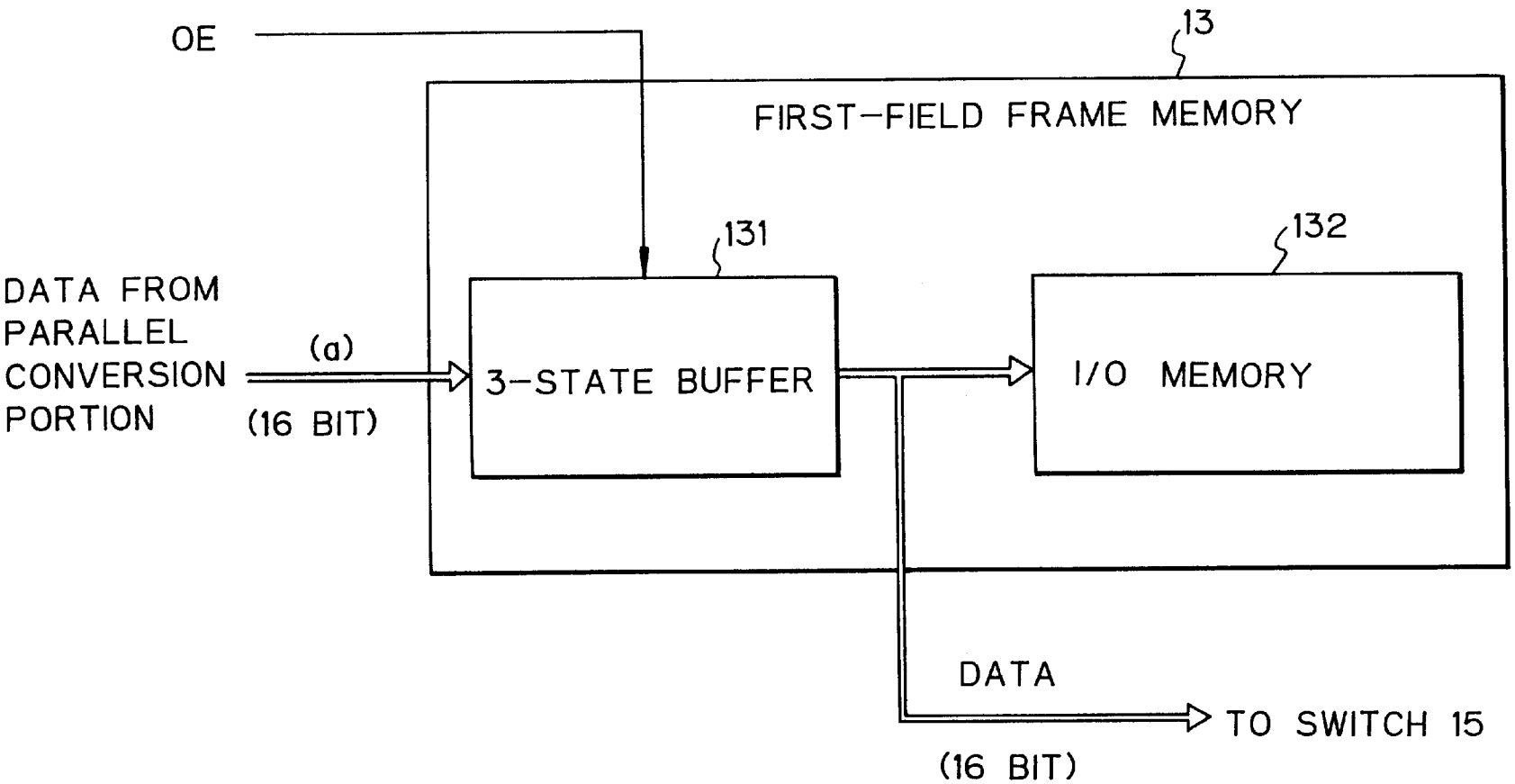
FIG. 3 is a block diagram showing a detailed construction of the first field frame memory shown in FIGS. 1A and 1B.

The first and second field frame memories 13 and 14 each have a capacity of about one megabit (640×480×3=900 kilobits). FIG. 3 shows a detailed construction of the first field frame memory 13. The first field frame memory includes a three-state buffer 131 and a input/output (I/O) memory 132. The data from the parallel conversion portion 11 is written in the I/O memory 132 by the three-state buffer 131 when an output enable signal OE is at a high level and the written data is read out from the I/O memory 132 when the output enable signal OE is at a low level. At this write/read operation, reading speed of the data from the first frame memory 13 is twice as fast as the writing speed of the data to the first frame memory 13 in this embodiment. By maintaining the reading speed of the data twice as fast as the writing speed, flickering is reduced.

Figure 4A:
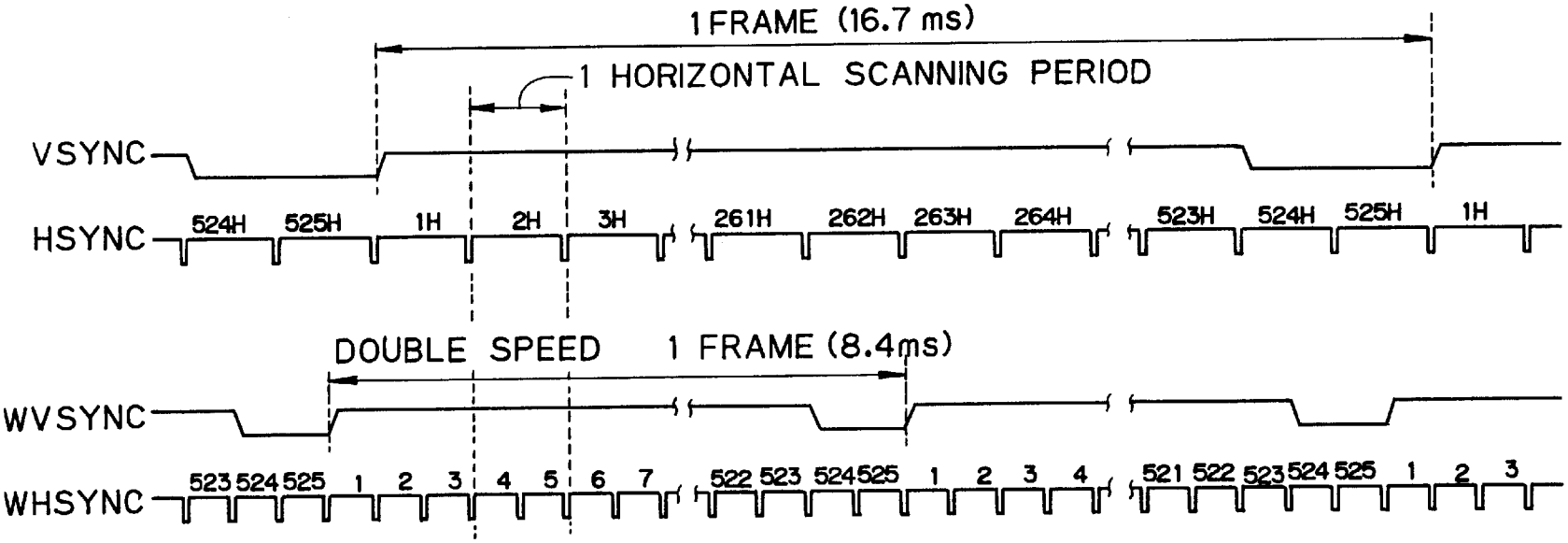
FIGS. 4A and 4B are wave forms showing the operation of the first field memory in FIGS. 1A and 1B.

FIGS. 4A includes timing charts explaining the relationship among a vertical synchronizing signal VSYNC, a horizontal synchronizing signal HSYNC, a double speed vertical synchronizing signal WVSYNC, and a double speed horizontal synchronizing signal WHSYNC under the condition that the static RAM is used as the frame memory. As shown in FIG. 4A, 525 horizontal synchronizing signals are included in one frame. Double speed scanning can be realized by transmitting two scan lines of image data to the data driver in one horizontal scanning period by using the frame memory. For example, the double speed scanning can be realized by writing an image data in the horizontal synchronizing period 2H of the present frame to the frame memory and reading image data in the horizontal synchronizing periods 4H and 5H in a preceeding frame from the frame memory and transmitting the same to the data driver simultaneously.

Figure 4B:
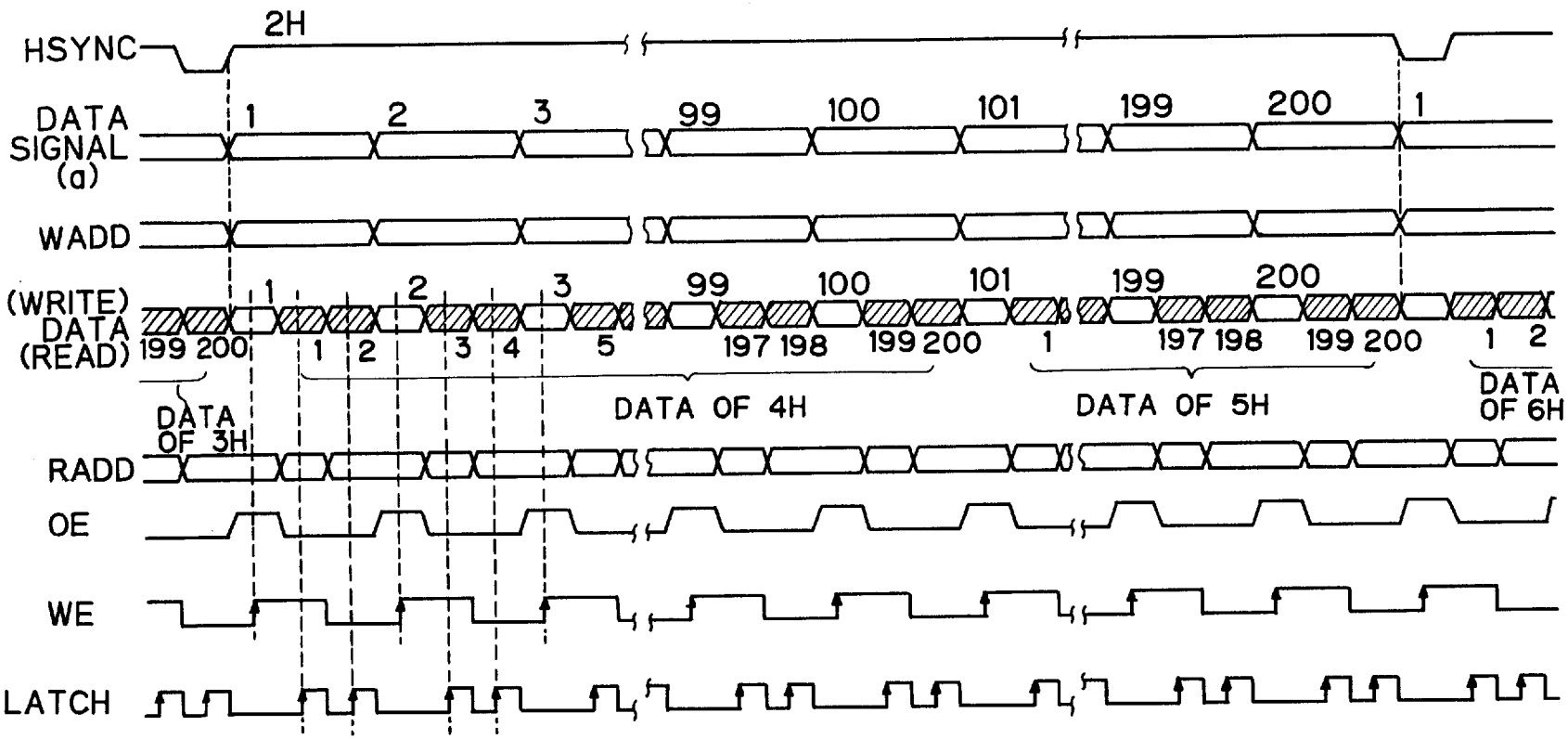

FIG. 4B includes timing charts showing one horizontal synchronizing period 2H in FIG. 4A, the time-scale of which is magnified. In FIG. 4B, HSYNC denotes a horizontal synchronizing signal, WADD denotes a write address, RADD denotes a read address, OE denotes an output enable signal, and WE denotes a write enable signal. Hereinafter, an explanation will be given as 200 groups of series-parallel converted image data (16 bit) are included in one horizontal scanning period. The frame memory becomes a write mode when the output enable signal OE is at a high level, and during this mode, data is written in the frame memory at the rise up of the write enable signal WE. Further, the frame memory becomes read mode when the output enable signal OE is at a low level, and during this mode, data is output in accordance with the address. At this operation, to avoid the collision of write data and read data, it is necessary to provide a three-state buffer in the data bus line. The output enable signal OE can be used as the control signal of the three-state buffer, so that the output of the three-state buffer has a high impedance when the output enable signal OE is at a low level. Furthermore, the output enable signal OE can also be used for switching the write address and the read address, and the write address is selected when the output enable signal OE is at a high level and the read address is selected when the output enable signal OE is low level.

Now in FIG. 4B, a first group of data signals in the horizontal synchronizing period 2H is applied to the three-state buffer and the output enable signal OE is at a high level, so that data is written to the frame memory at the rise of the write enable signal WE. After that, when the output enable signal OE is at a low level, data according to the write address is output from the frame memory and it is taken into the data driver at the rise of the latch signal LATCH. The read address has set an order such that the first and the second groups of data signals in the preceeding horizontal synchronizing period 4H are output at this time. In this way, an image data of one line can be read in a half time of one horizontal scanning period. Namely, the image data of one display panel (=the image data of one frame) can be displayed in a half time of one frame.

The display data switching portion 15 switches display data stored in the first and second field frame memories 13 and 14 from one to another, and provides data for one frame to the data drivers 8. These data signals are used to select the data voltage applied to the data drivers 8 and will be explained hereinafter.

Each of the first and second frame liquid crystal driving sources 16 and 17 generates voltages for driving liquid crystal cells. According to this embodiment, the first frame liquid crystal driving source 16 provides V1=14 (V), V2=10 (V), V3=6 (V), and V4=2 (V), while the second frame liquid crystal driving source 17 provides V1=12 (V), V2=10 (V), V3=6 (V), and V4=4 (V). Though a common voltage level for above-described voltages is 8 (V), it is set to 7 (V) by the common voltage source portion 21 since a source potential changes by about −1 (V) due to parasitic capacitance.

The driving source switching portion 18 switches the first and second frame liquid crystal driving sources 16 and 17 from one to another. The data voltages applied to the data drivers 8 from the first or second frame liquid crystal driving sources 16 and 17 are selected by data signal input to the data drivers 8 from the display data switching portion 15. In other words, the data signal works as a data voltage selecting signal in the data drivers 8.

Figure 5:
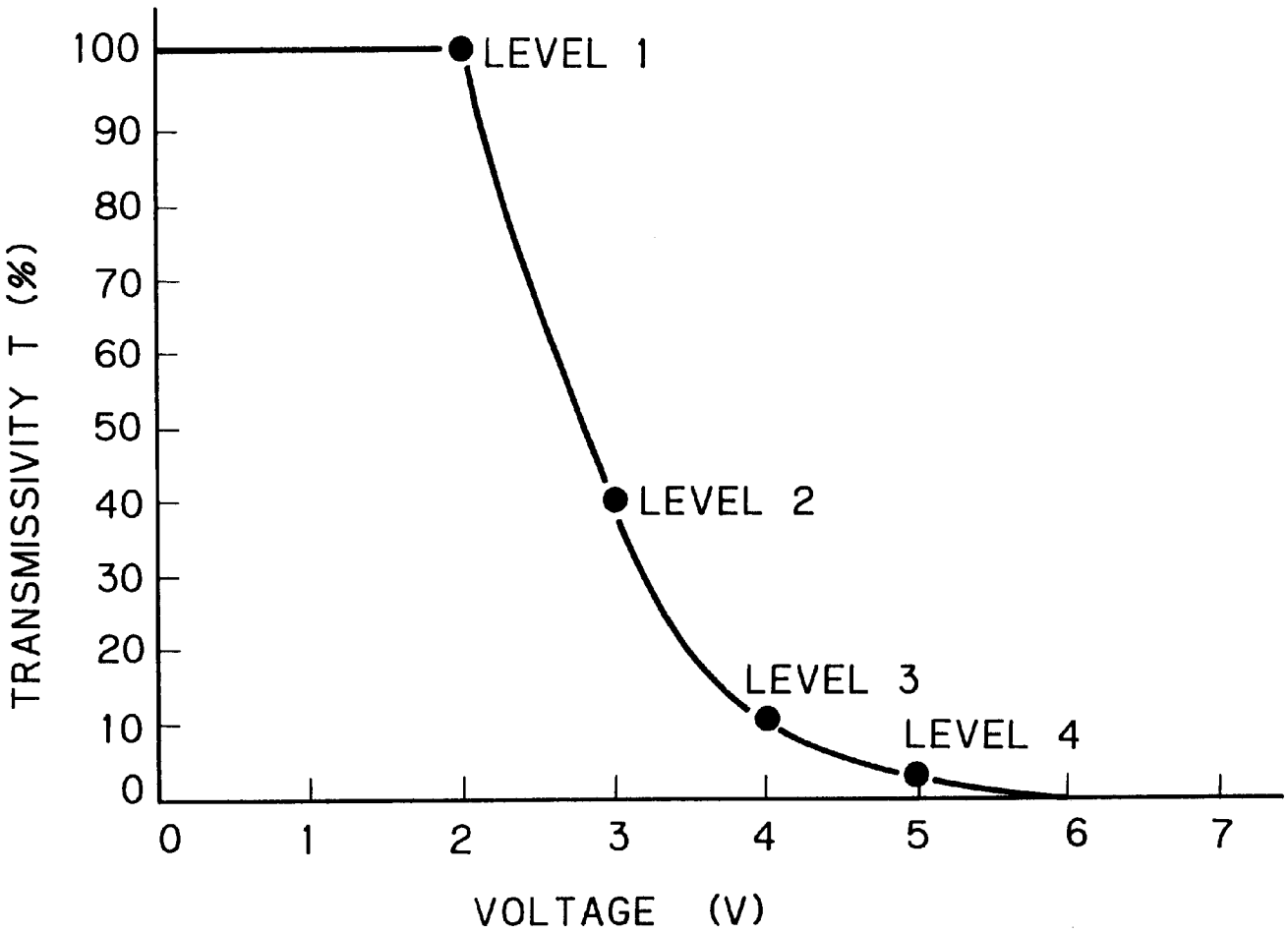
FIG. 5 is a view showing T-V characteristics of liquid crystal.

FIG. 5 explains a principle of assigning multiple gray-scale levels whose number is greater than the maximum number of gray-scale levels achievable by an employed data driver. For example, a data driver for an STN type liquid crystal that is able to simultaneously provide two voltage levels is employed to display 64 colors with 4 gray-scale levels.

Figure 6:
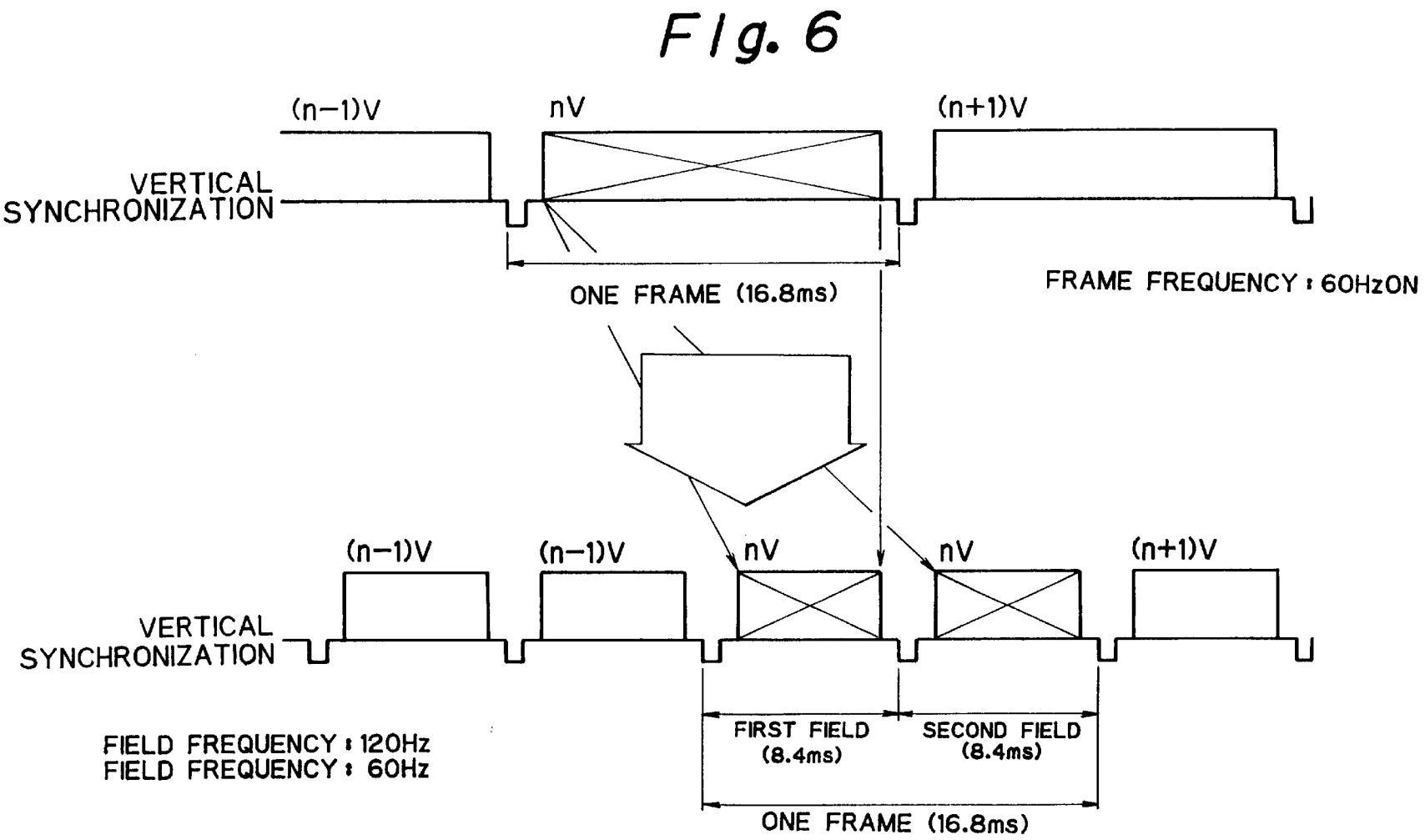
FIG. 6 is an explanatory view of double speed scanning of the first and the second field frame memory shown in FIGS. 1A and 1B.

First, an image of one frame is written in the first and second field frame memories 13 and 14 and read at a speed two times the write speed (double speed scanning), to divide the one frame into first and second fields as shown in FIG. 6. A gray-scale level 1 shown in FIGS. 7A to 7D, for example, is realized by applying a voltage of 2 (V) to each of the first and second fields to produce a mean effective voltage of 2 (V) for the one frame. This mean effective voltage is shown by hatching in FIGS. 7A to 7D. A gray-scale level 2 is realized by applying 2 (V) to the first field and 4 (V) to the second field to produce a mean effective voltage of 3 (V) for the one frame. To realize an gray-scale level 3, 6 (V) is applied to the first field and 2 (V) to the second field to produce a mean effective voltage of 4 (V) for the one frame. To realize an gray-scale level 4, 6 (V) is applied to the first field and 4 (V) to the second fields to produce a mean effective voltage of 5 (V) for the one frame.

In this way, different voltage levels are applied to the first and second fields, respectively, and differences in mean effective voltages occurring in individual frames can realize more gray-scale levels than the gray-scale levels realized by applied data voltages. Namely, an intermediate gray-scale level between two gray-scale levels due to two applied voltages can be realized by the mean effective voltage only.

FIGS. 8A and 8B through 11A and 11B show examples of driving waveforms for respective fields according to the embodiment. For easy understanding, FIGS. 8A and 8B through 11A and 11B will be explained with reference to FIGS. 12A to 12F through 15A to 15F indicating the vertical synchronization, the data voltages, flickering, and synchronized flickering respectively. The value of the data voltages in FIGS. 12B and 12D through 15B and 15D is the voltage difference between the data voltage and the common voltage of 8 (V) in FIGS. 8A and 8B through 11A and 11B.

For example, the data voltage V4 is 6 (V) in FIGS. 8A and 8B through 11A and 11B, but 2 (V) in FIGS. 12B and 12D through 15B and 15D since the difference between the data voltage of 6 (V) and the common voltage of 8 (V) in FIGS. 8A and 8B through 11A and 11B is 2 (V).

Figures 7A, 7B, 7C, 7D:
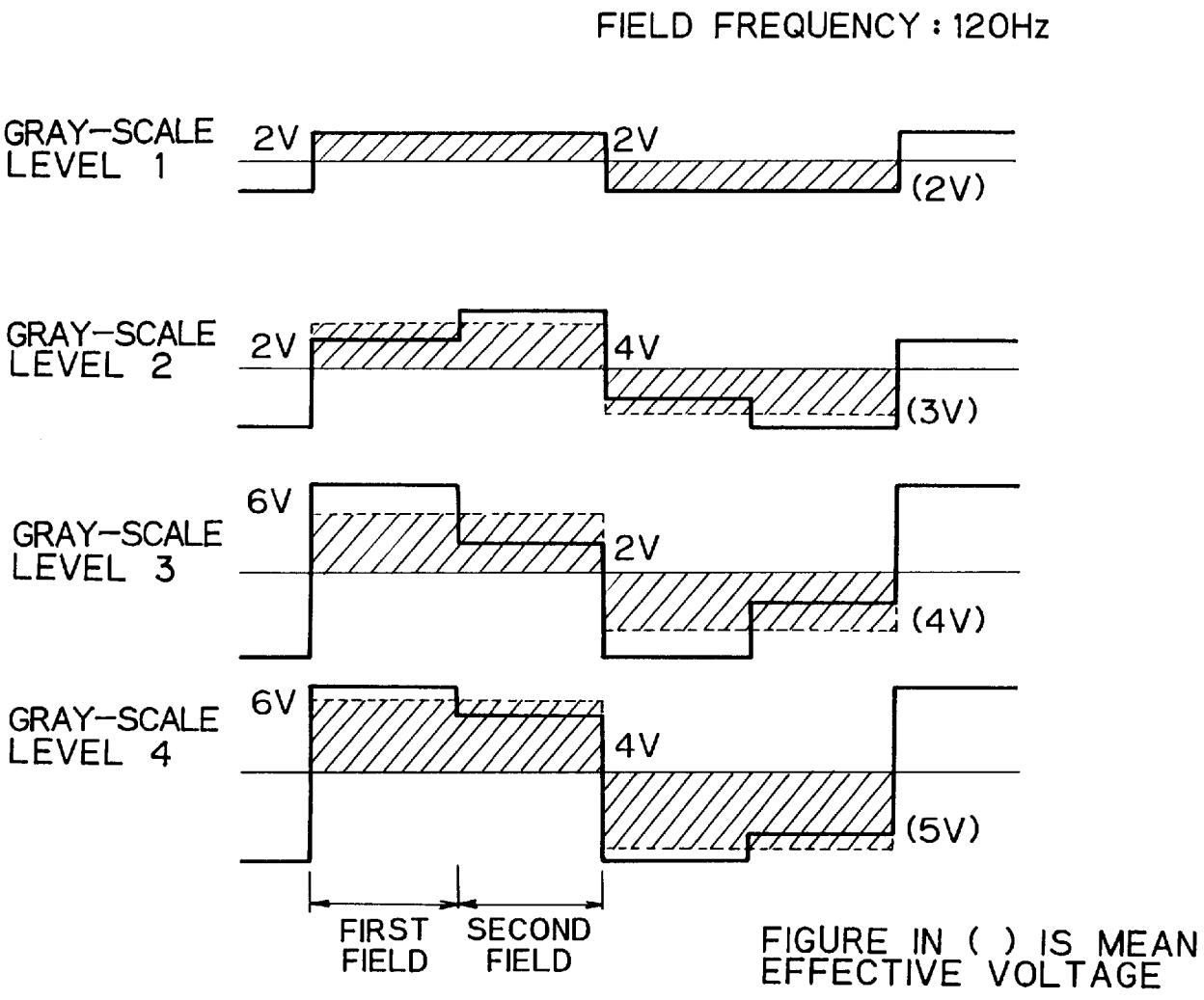
FIGS. 7A to 7D are views showing driving waveforms of a liquid crystal cells according to the first embodiment.
Figure 8A:
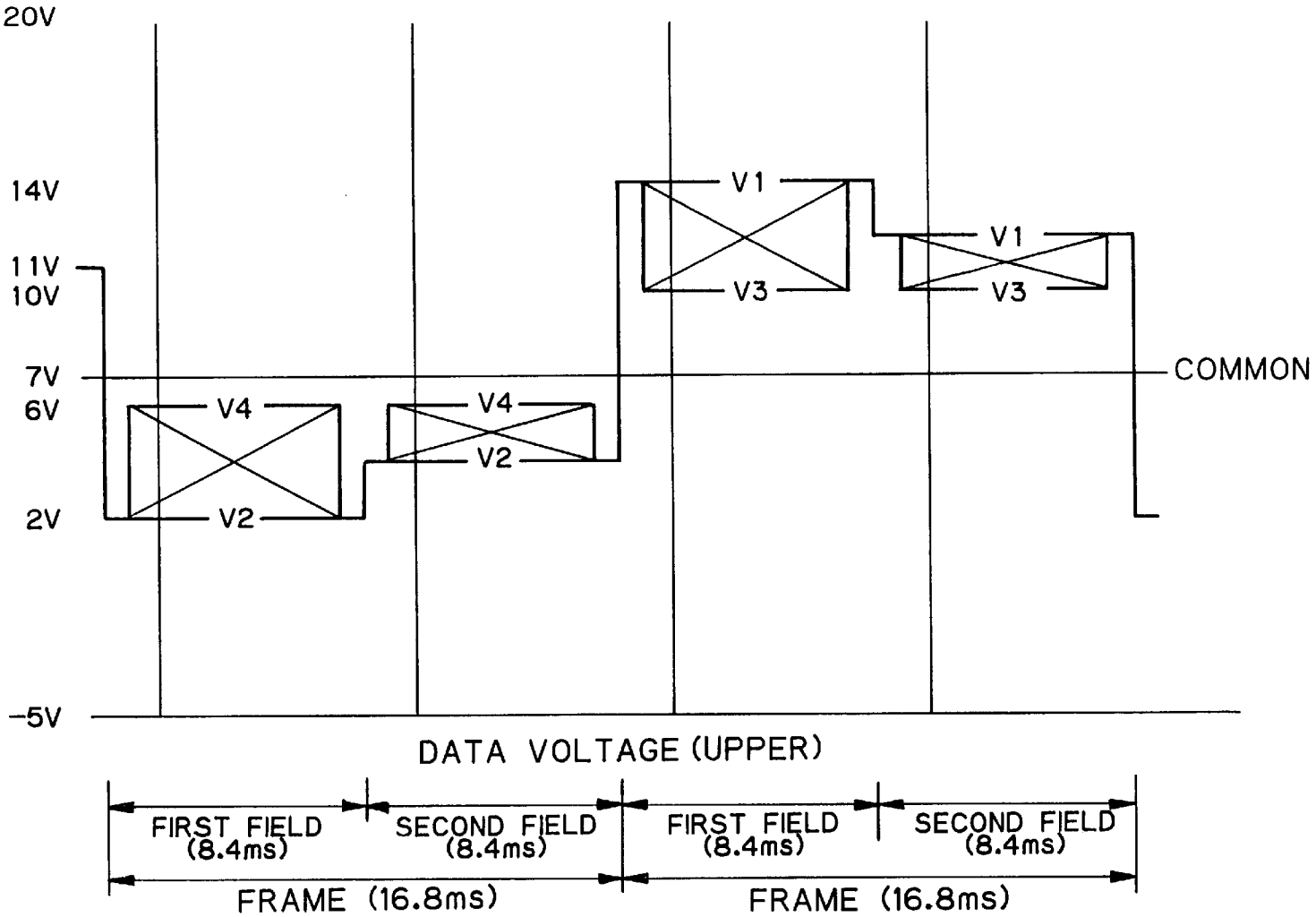
FIGS. 8A and 8B are views showing examples of driving waveforms of the first embodiment.
Figure 8B:
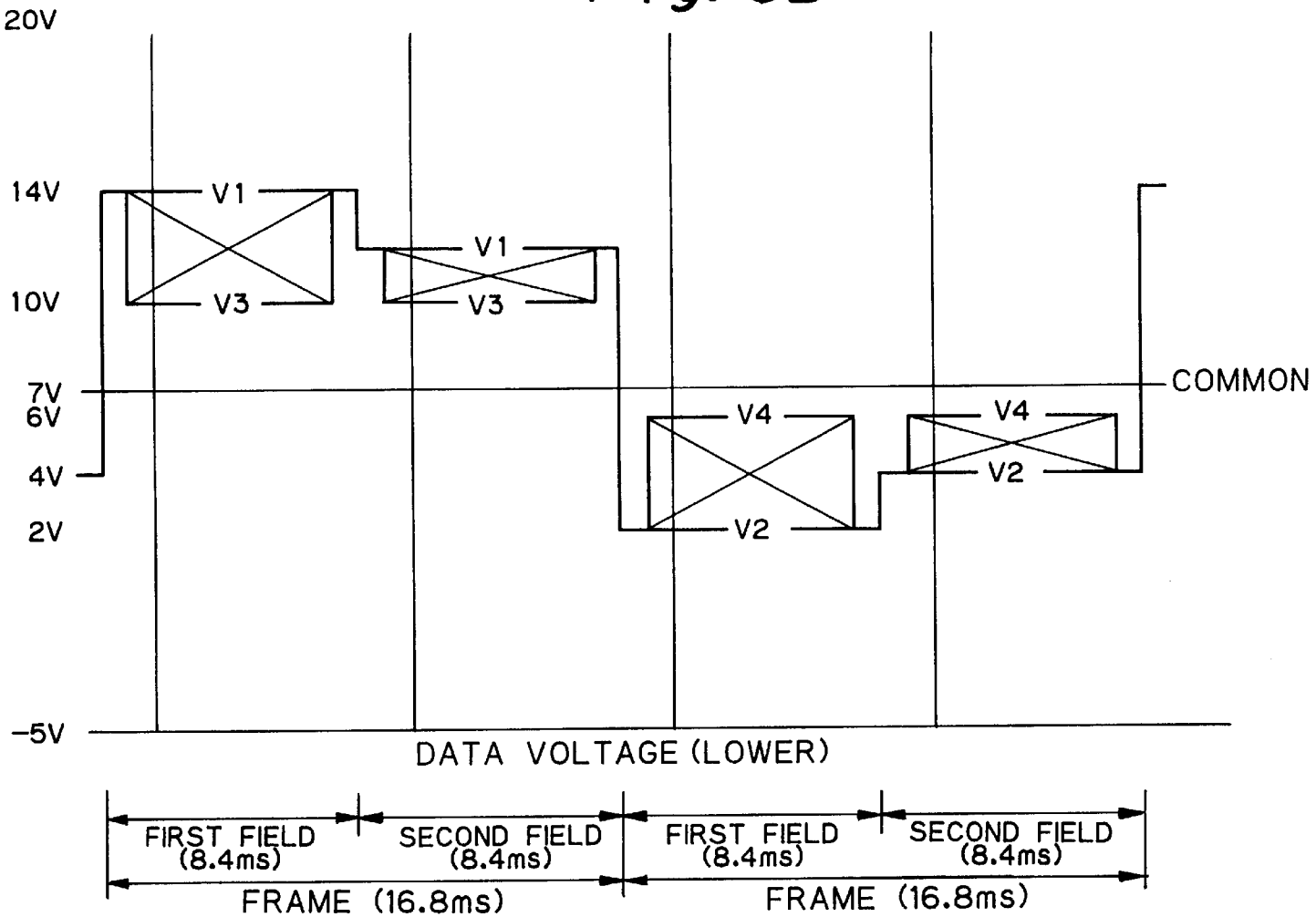

In FIGS. 8A and 8B, two sets of voltage levels are prepared and applied to the fields, respectively. For example, in FIGS. 12B and 12D, which are corresponding to FIGS. 8A and 8B, the gray-scale level 2 as shown in FIG. 7B is realized by applying voltages V4 (=2(V)) and V3 (=2(V)) to the first field, and voltages V2 (=4(V)) and V1 (=4(V)) to the second field. In adjacent liquid crystal cells, white and black are repeatedly displayed with the same flickering phase. Namely, the frequency of the synthesized flickering becomes 60 Hz, which is equal to the flickering frequency of each liquid crystal cell.

Figure 9A:
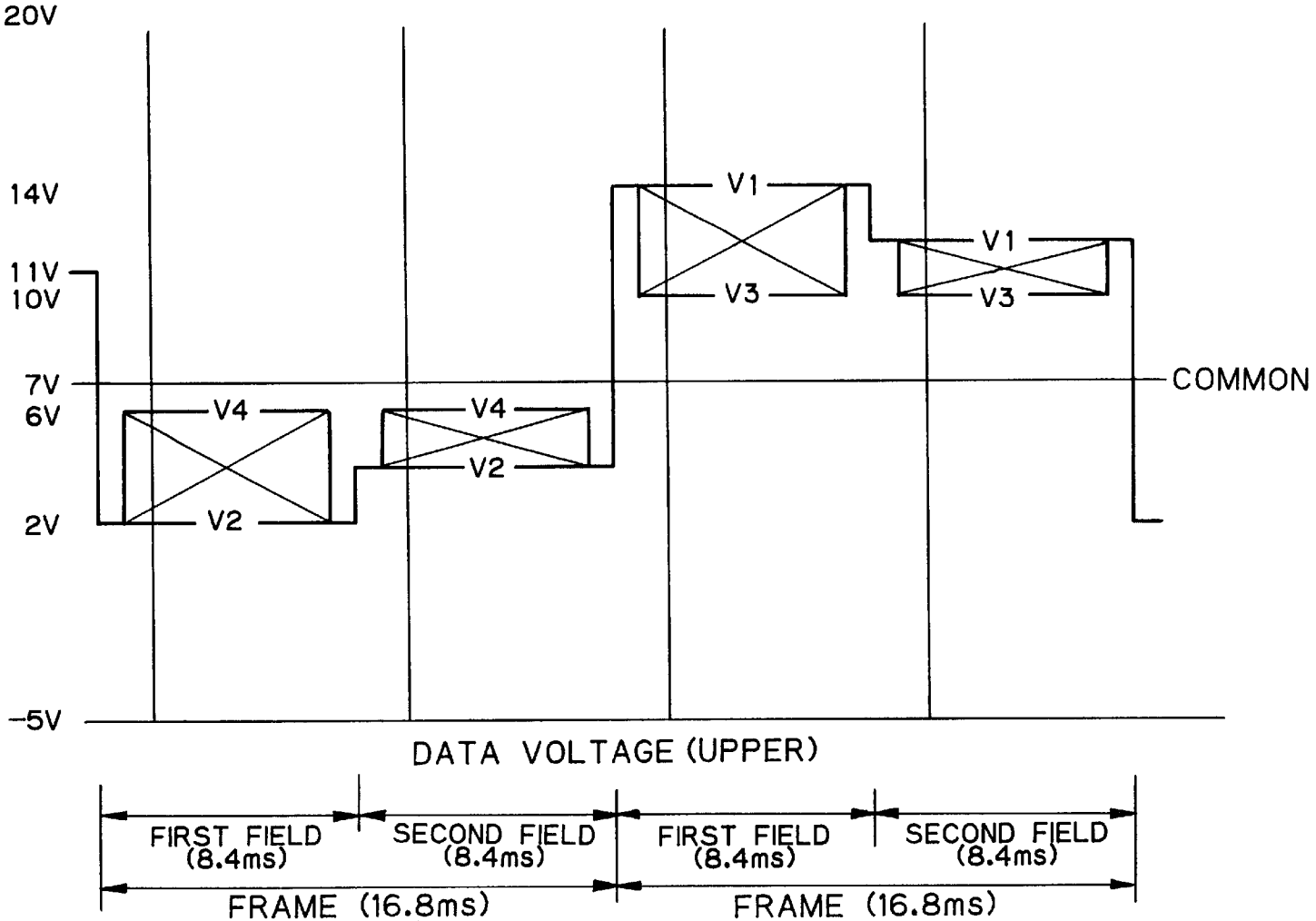
FIGS. 9A and 9B are views showing examples of driving waveforms of the first embodiment wherein the combination of the voltage levels of FIGS. 8A and 8B are changed.
Figure 9B:
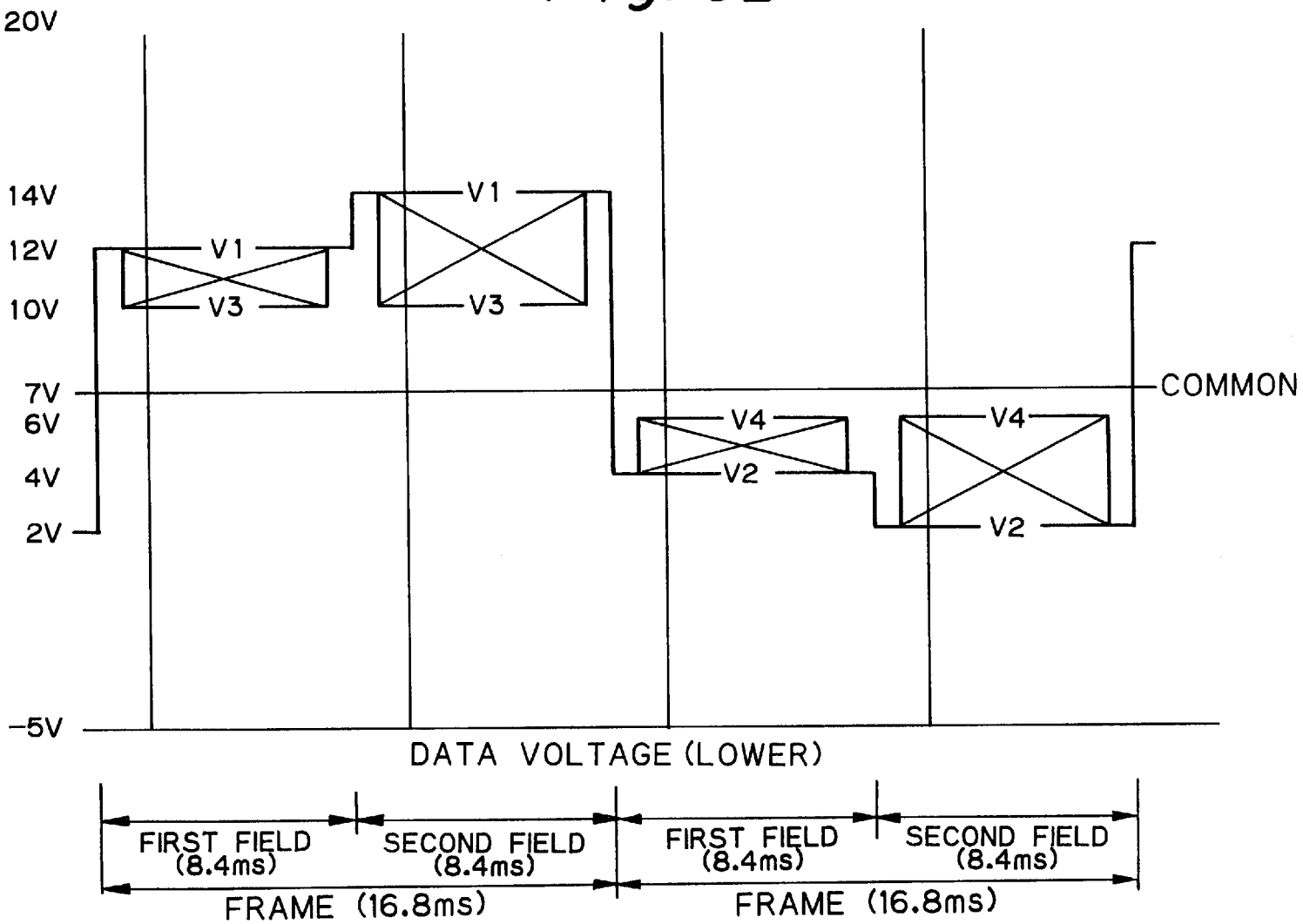
Figures 13A, 13B, 13C, 13D, 13E, 13F:
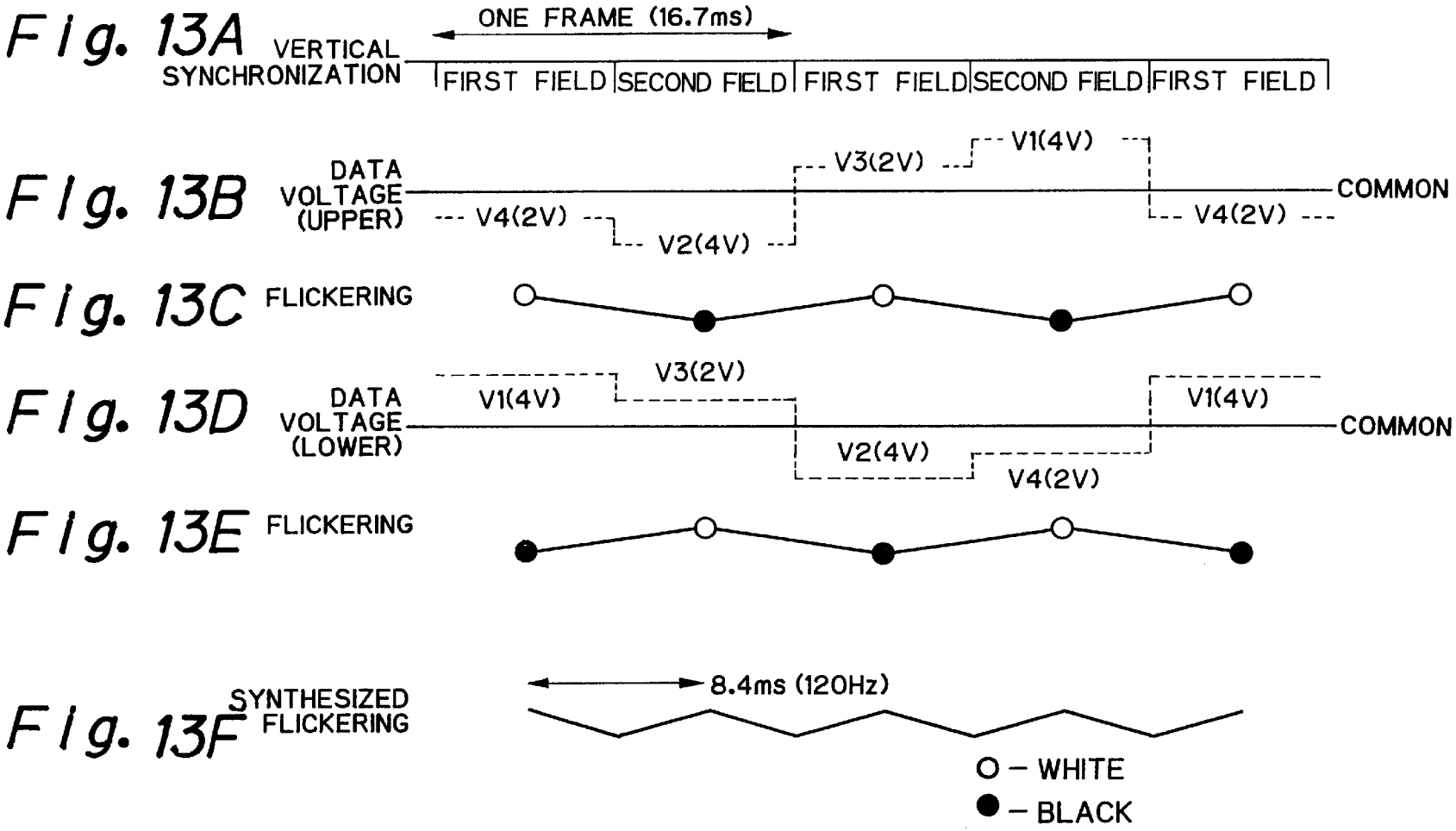
FIGS. 13A to 13F are explanatory views of FIGS. 9A and 9B.

FIGS. 9A and 9B show examples of driving waveforms which are obtained by changing the combination of the voltage levels of FIGS. 8A and 8B. As shown in FIGS. 13B and 13D which are corresponding to FIGS. 9A and 9B, the gray-scale level 2 is realized by applying voltages V4 and V1 to the first field, and V2 and V3 to the second field. Also, voltages V3 and V2 are applied to a first field of another frame, and V1 and V4 to a second field thereof. White and black are repeatedly displayed in adjacent liquid crystal cells with flickering phases being different from each other by 180 degrees.

Figures 12A, 12B, 12C, 12D, 12E, 12F:
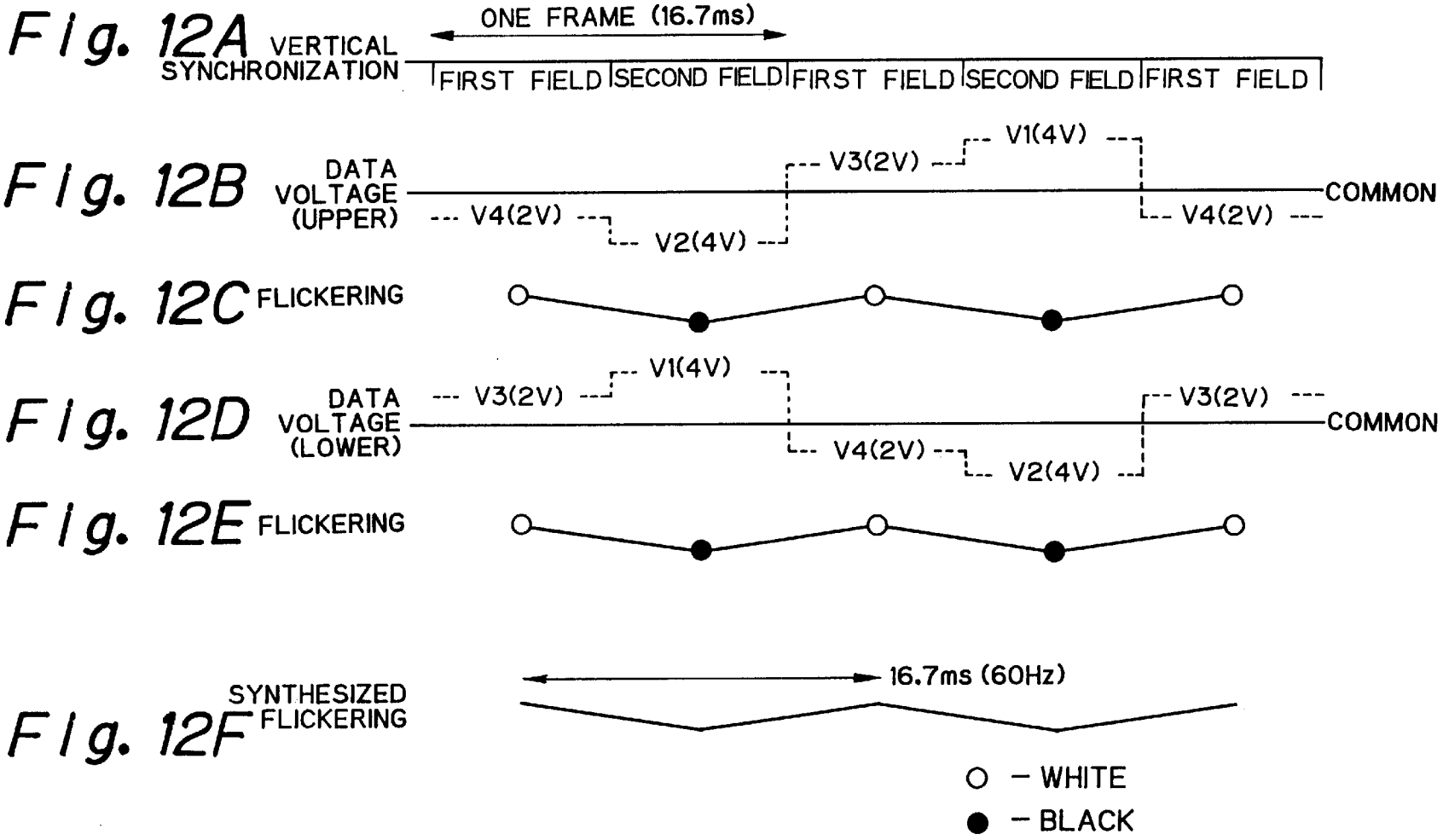
FIGS. 12A to 12F are explanatory views of FIGS. 8A and 8B.

The frequency of synthesized flickering will be 120 Hz, so that the flickering becomes inconspicuous compared with that of FIGS. 12B and 12D.

Figure 10A:
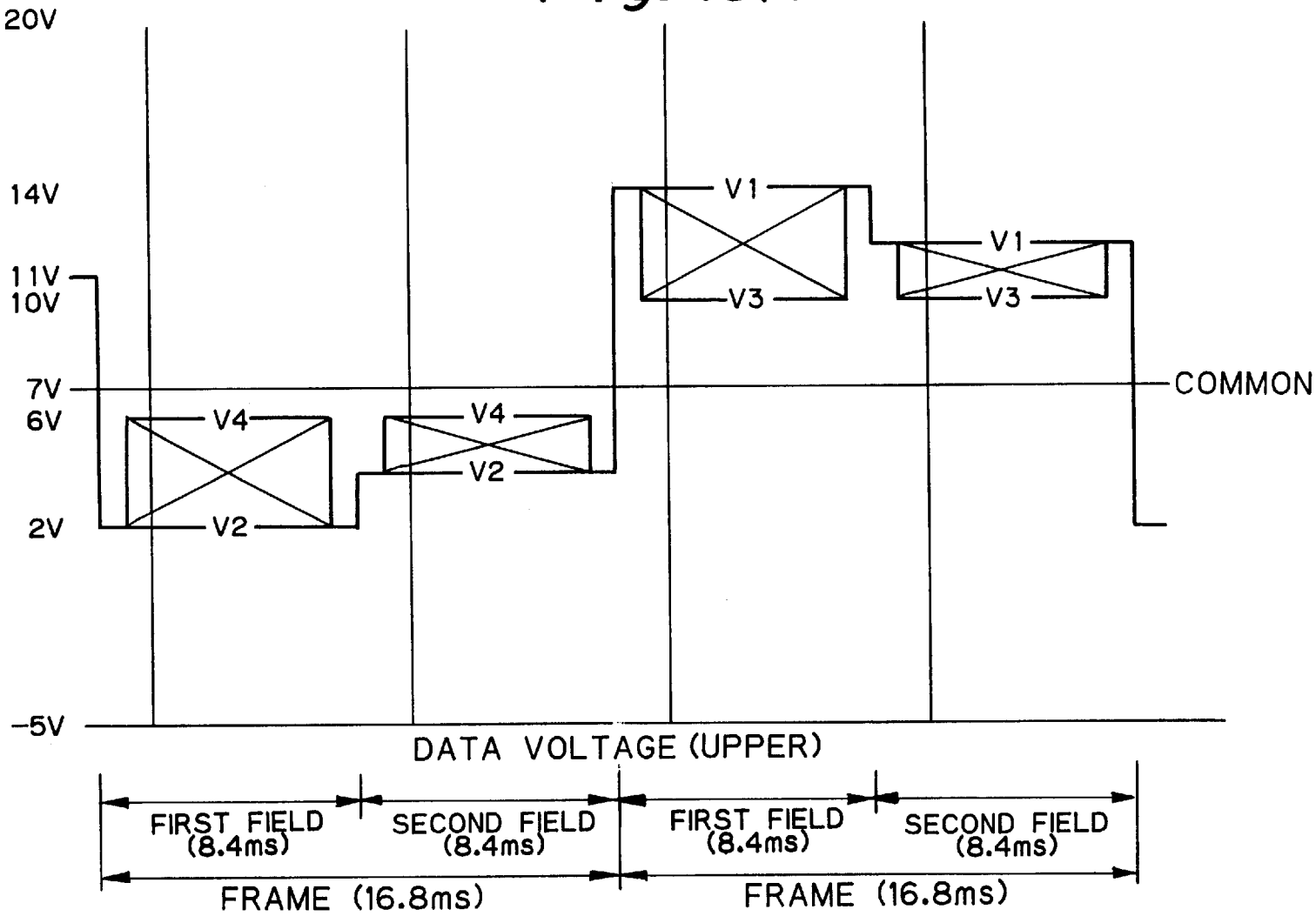
FIGS. 10A and 10B are views showing examples of driving waveforms of the first embodiment wherein the phase of the voltage levels of FIGS. 8A and 8B are changed.
Figure 10B:
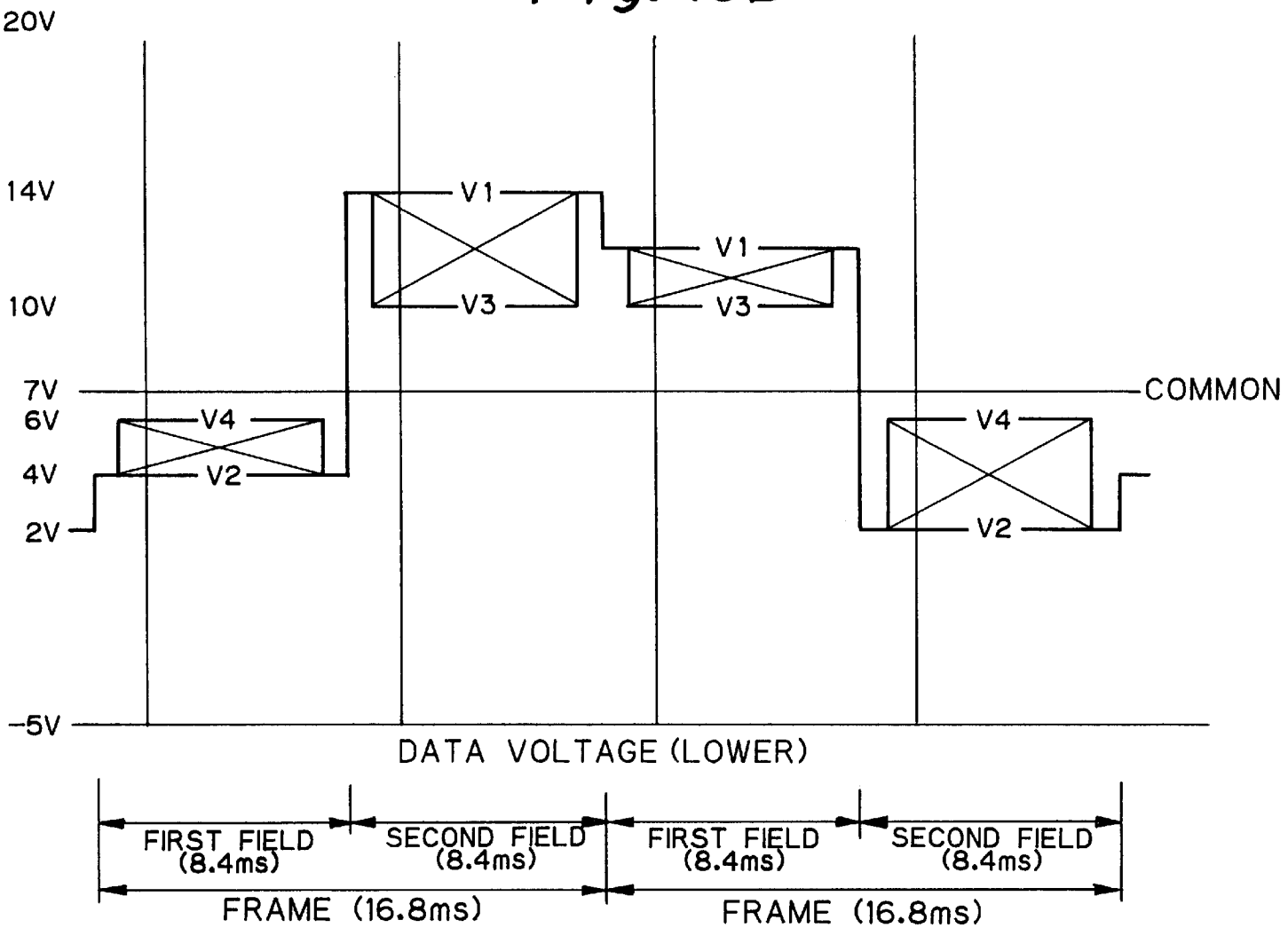
Figures 14A, 14B, 14C, 14D, 14E, 14F:
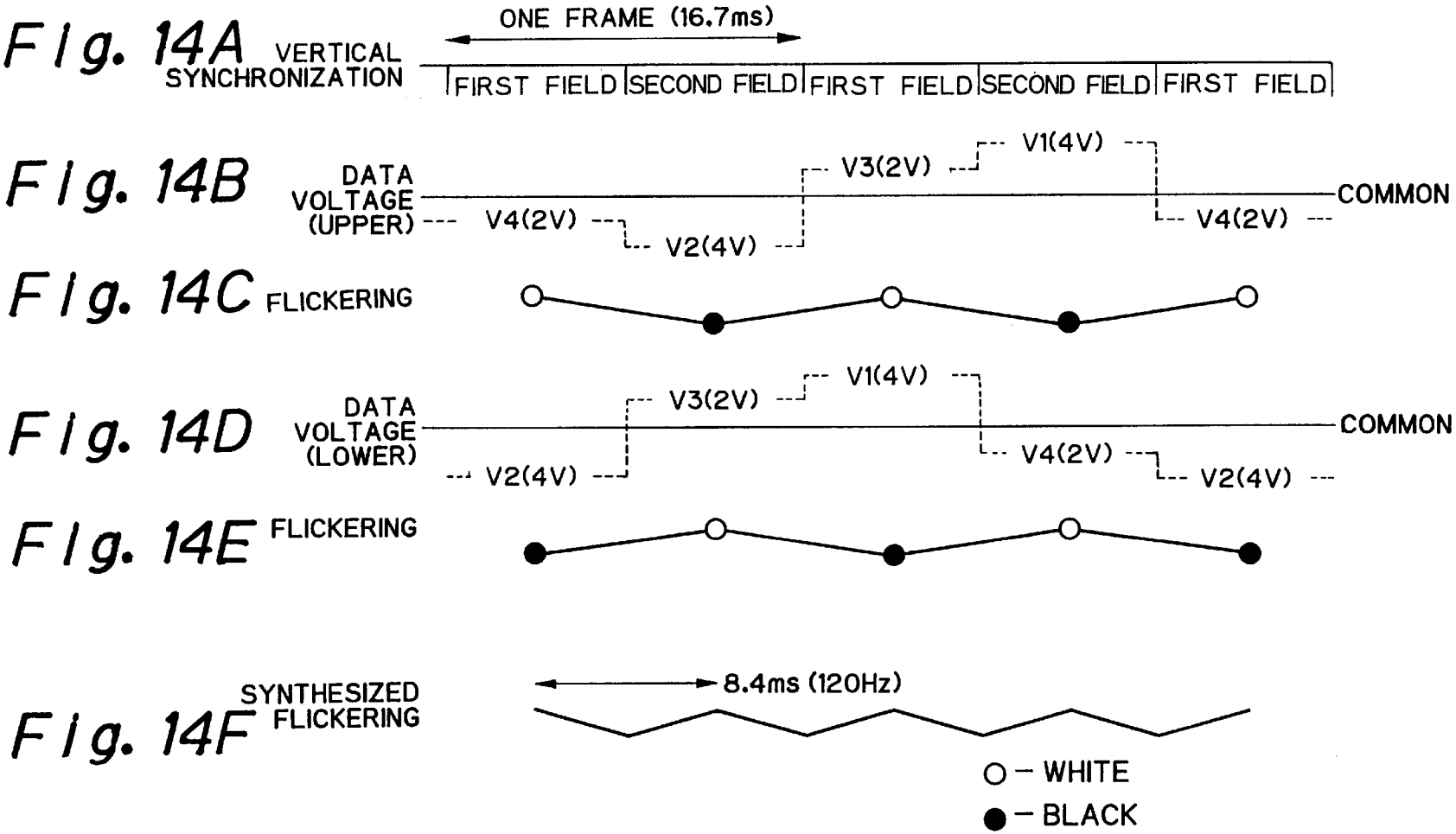
FIGS. 14A to 14F are explanatory views of FIGS. 10A and 10B.

FIGS. 10A and 10B show examples of driving waveforms obtainable by changing the phase of the voltage levels of FIGS. 8A and 8B. As shown in FIGS. 14B and 14D which are corresponding to FIGS. 10A and 10B, the gray-scale level 2 is realized by applying voltages V4 and V2 to the first field, and V2 and V3 to the second field. Also, voltages V3 and V1 are applied to a first field of another frame, and V1 and V4 to a second field thereof. Similar to FIGS. 13B and 13D, white and black are repeatedly displayed in adjacent liquid crystal cells with the phases of flickering being different from each other by 180 degrees. Accordingly, the frequency of synthesized flickering will be 120 Hz.

This may make the flickering more inconspicuous compared with that of FIGS. 12B and 12D.

Figure 11A:
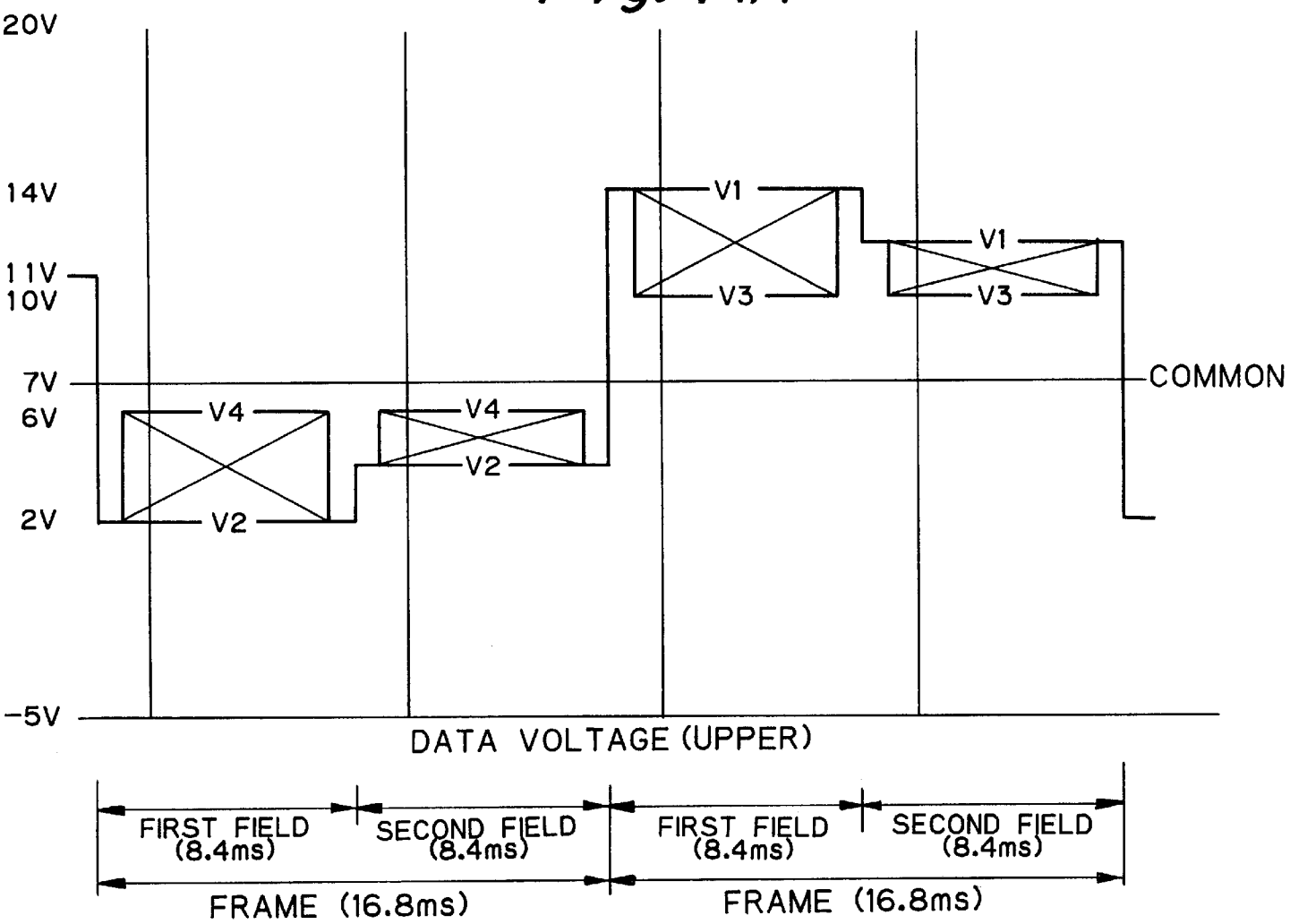
FIGS. 11A and 11B are views showing examples of driving waveforms of the first embodiment wherein the combination and phase of the voltage levels of FIGS. 8A and 8B are changed.
Figure 11B:
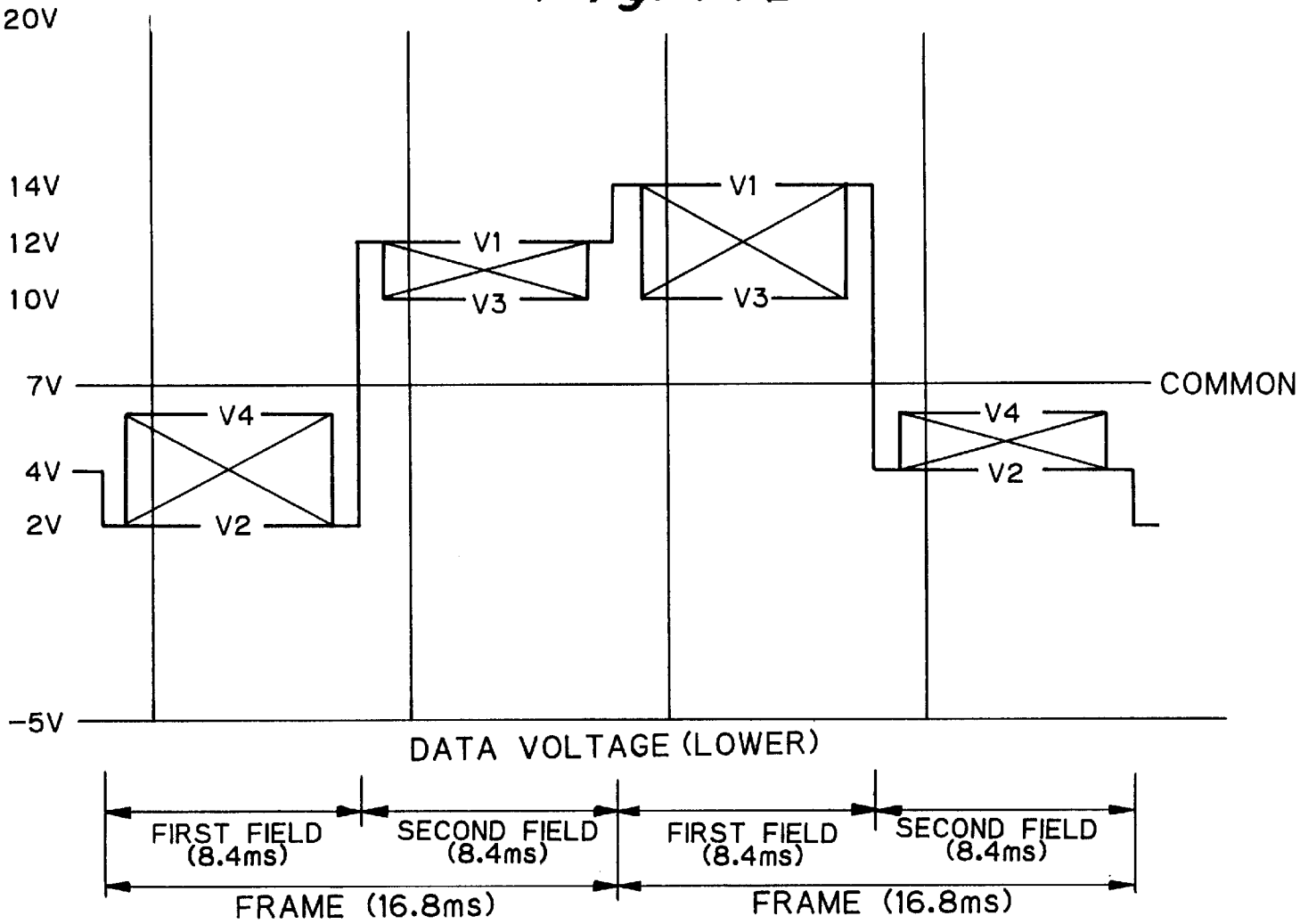
Figures 15A, 15B, 15C, 15D, 15E, 15F:
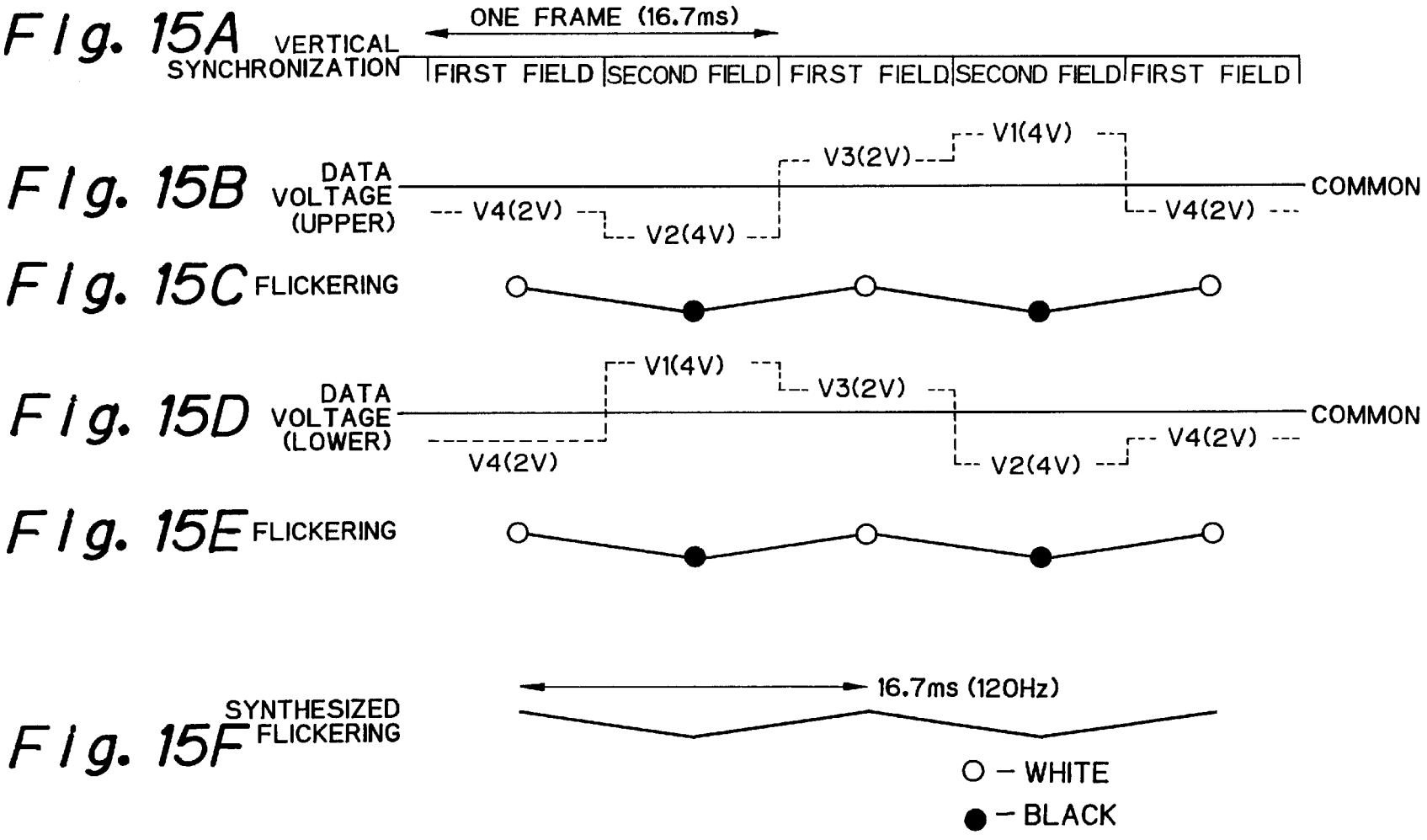
FIGS. 15A to 15F are explanatory views of FIGS. 11A and 12B.

FIGS. 11A and 11B shows examples of driving waveforms which are obtainable by changing the combination and phase of the voltage levels of FIGS. 8A and 8B. As shown in FIGS. 15B and 15D which are corresponding to FIGS. 11A and 11B, the gray-scale level 2 is realized by applying voltages V4 and V4 to the first field, and V2 and V1 to the second field. Also, voltages V3 and V3 are applied to a first field of another frame, and V1 and V2 to a second field thereof. Similar to FIGS. 12B and 12D, white and black are repeatedly displayed in adjacent liquid crystal cells with the same flickering phase.

The frequency of synthesized flickering will be 60 Hz, which is equal to the flickering frequency of each liquid crystal cell.

Figures 16, 16A:
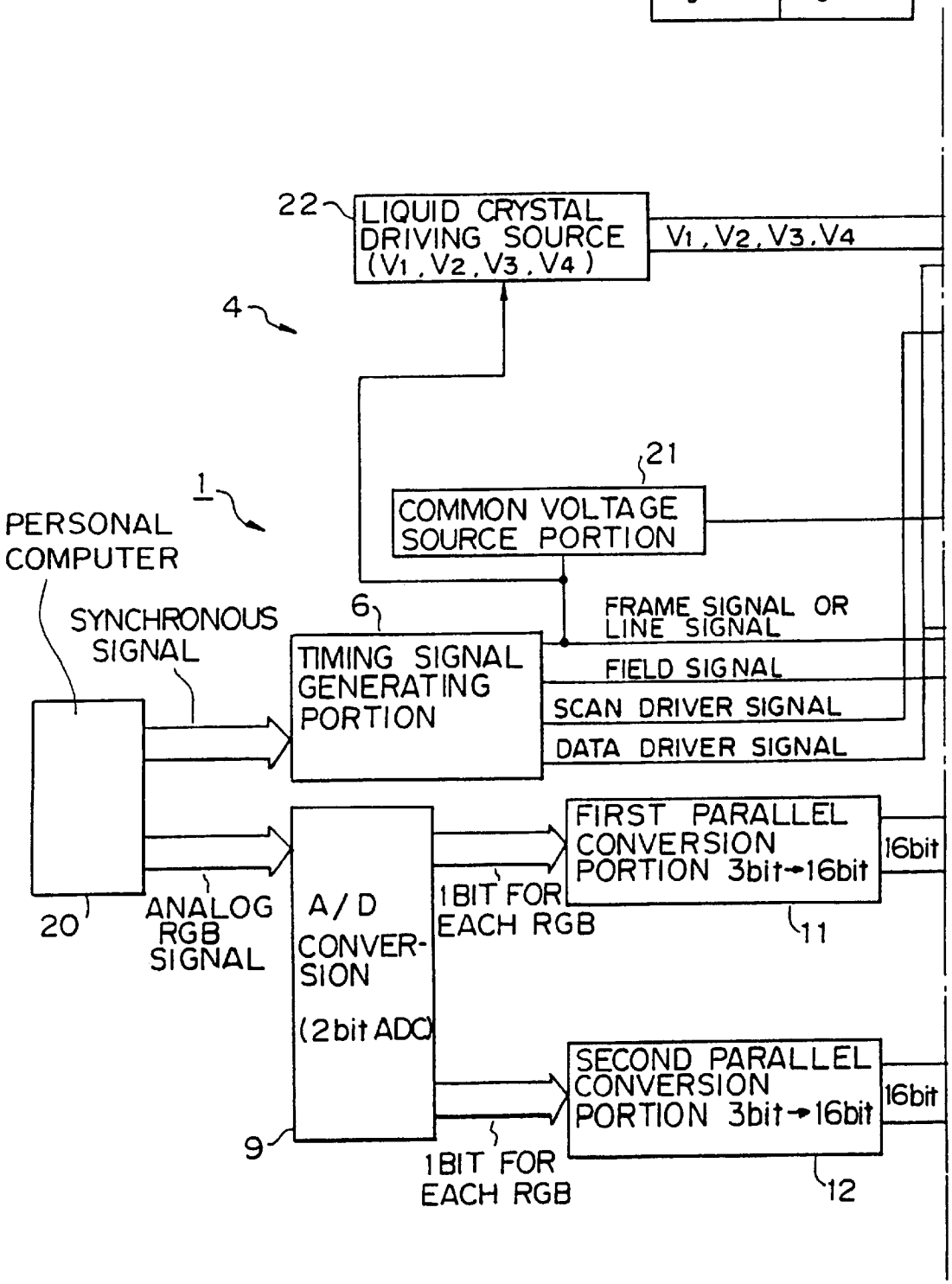
FIGS. 16A and 16B are a block diagram showing a general arrangement of a second embodiment.
Figure 16B:
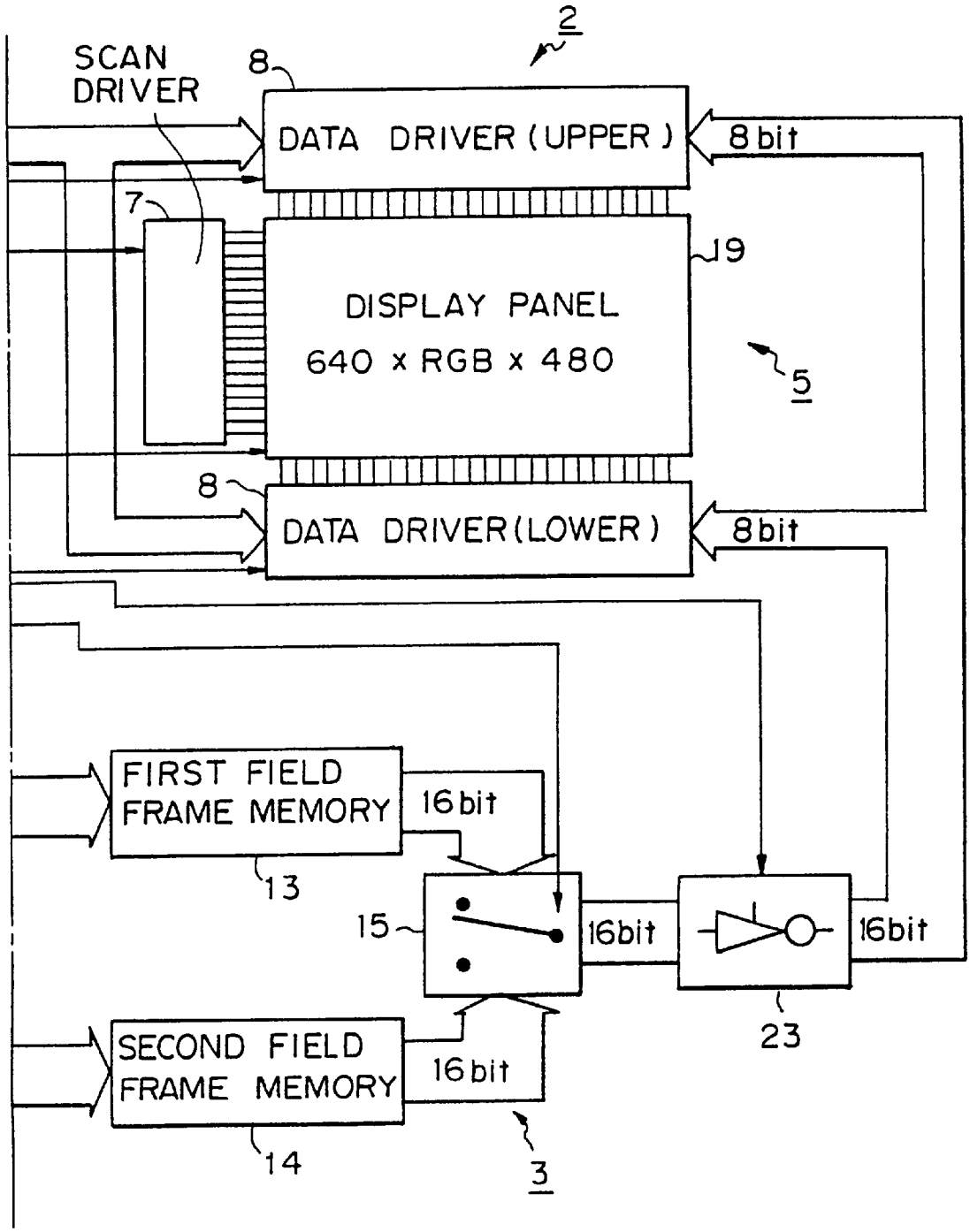
Figure 17A:
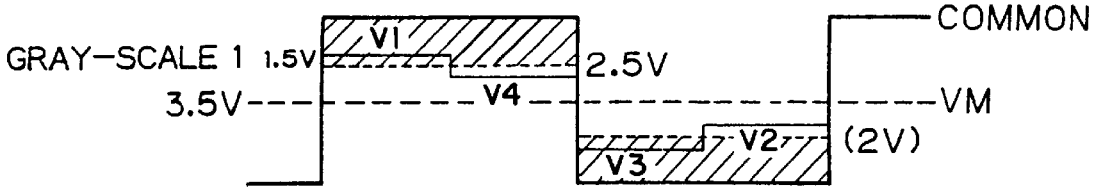
FIGS. 17A to 17D are views showing driving waveforms of a liquid crystal cells of the second embodiment.
Figure 17B:
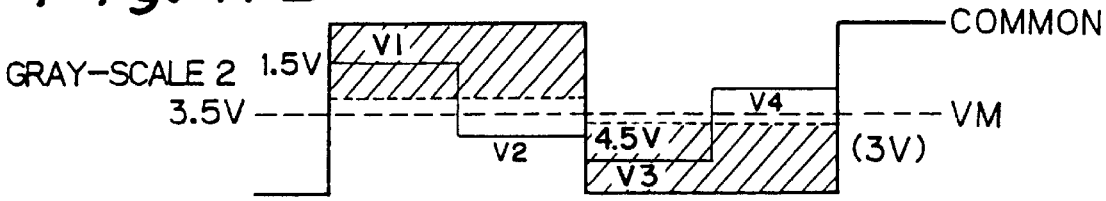
Figure 17C:
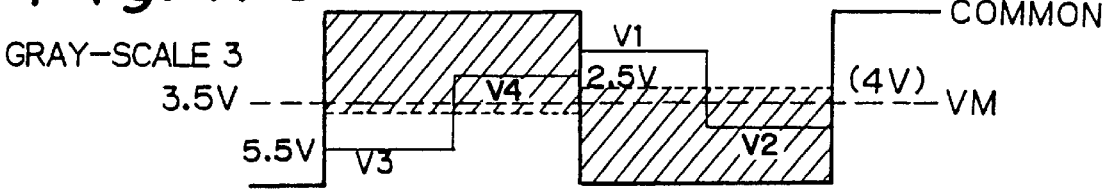
Figure 17D:
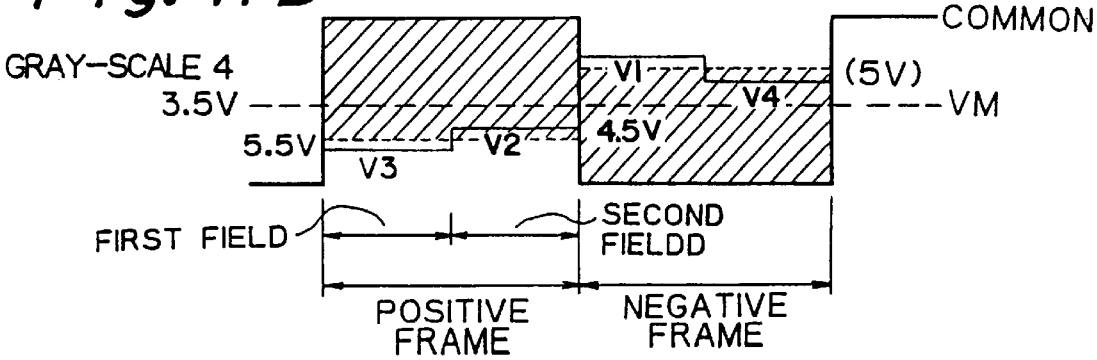

FIGS. 16A through 18 are views showing a liquid crystal display unit according to a second embodiment of the present invention, in which FIGS. 16A and 16B are a block diagram showing a general arrangement of the embodiment.

In FIGS. 16A and 16B, the same reference numerals as those of the first embodiment of FIGS. 1A and 1B represent the same parts. In this embodiment, the voltage applying part 4 comprises a liquid crystal driving power source 22 and a common voltage source portion 21. Numeral 23 denotes a three-state inverter, which inverts display data for every frame or line.

FIGS. 17A to 17D explain a principle of assigning multiple gray-scale levels whose number is greater than the maximum number of gray-scale levels achievable by a data driver employed. For example, a data driver for STN type liquid crystal that is able to simultaneously provide two voltage levels is employed to display 64 colors with 4 gray-scale levels.

First, similar to the first embodiment, an image of one frame is once written into the first and second field frame memories 13 and 14, and read therefrom at a speed of two times the write speed (double speed scanning) as shown in FIG. 6, to divide one frame into first and second fields. As shown in FIGS. 17A to 17D, an gray-scale level 1, for example, is realized by applying 1.5 (V) to the first field and 2.5 (V) to the second field, to produce a mean effective voltage of 2 (V) for the one frame. This mean effective voltage is shown by hatching in FIGS. 17A to 17D. A gray-scale level 2 is realized by applying 1.5 (V) to the first field and 4.5 (V) to the second field, to produce a mean effective voltage of 3 (V) for the one frame. An gray-scale level 3 is realized by applying 5.5 (V) to the first field and 2.5 (V) to the second field, to produce a mean effective voltage of 4 (V) for the one frame. An gray-scale level 4 is realized by applying 5.5 (V) to the first field and 4.5 (V) to the second field, to produce a mean effective voltage of 5 (V) for the one frame.

Here, the voltage levels for realizing the gray-scale level 1 in a positive frame are equal to those for realizing the gray-scale level 4 in a negative frame. Similarly, the voltage levels for realizing the gray-scale level 1 in a negative frame are equal to those for realizing the gray-scale level 4 in a positive frame. The voltage levels for realizing the gray-scale level 2 in a positive frame are equal to those for realizing the gray-scale level 3 in a negative frame. The voltage levels for realizing the gray-scale level 2 in a negative frame are equal to those for realizing the gray-scale level 3 in a positive frame.

Namely, only four kinds of voltage levels V1, V2, V3, and V4 are required in this embodiment to realize the same gray-scale levels in the first embodiment. In this embodiment, common voltage level is inverted by the common voltage source portion 21 and display data is inverted by the three-state inverter 23 for every frame or line to utilize a small number of the voltage levels for applying different voltage levels to the first and second fields of each frame, respectively. As a result, gray-scale levels are assigned according to differences in the mean effective voltages in respective frames.

Figure 18:
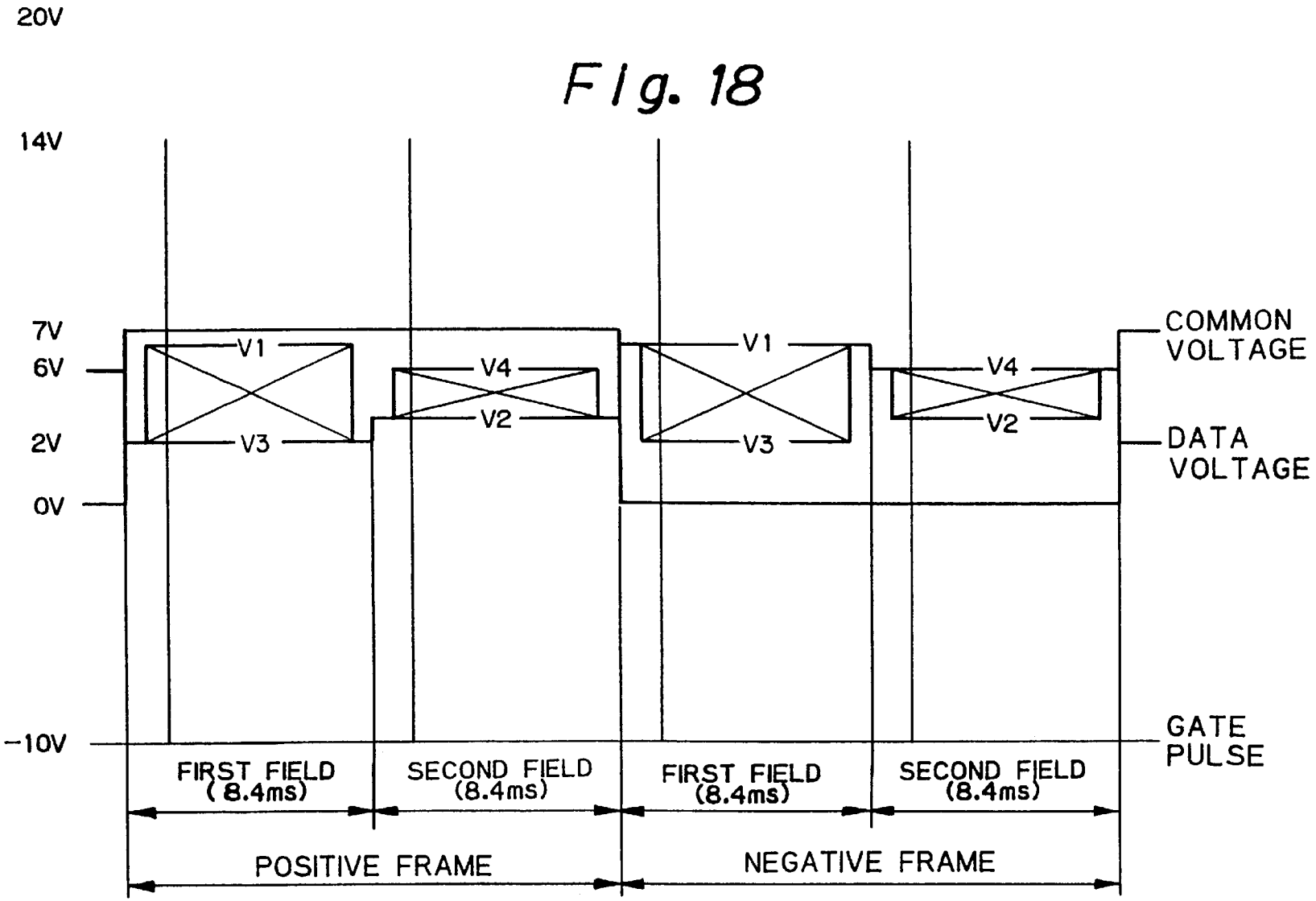
FIG. 18 is a view showing an example of a driving waveform of the second embodiment.

FIG. 18 shows an example of a driving waveform in each field according to this embodiment. In FIG. 18, the liquid crystal driving source 22 provide voltages of V1=6.5 (V), V2=3.5 (V), V3=2.5 (V), and V4=5. 5 (V). Since a change (about −1 (V)) occurs in a source potential due to parasitic capacitance, the common voltage levels are set to 7 (V) and 0 (V). An OFF voltage of a gate pulse of the three-state inverter 23 is −10 (V), and an ON voltage thereof 15 (V).

Figure 19:
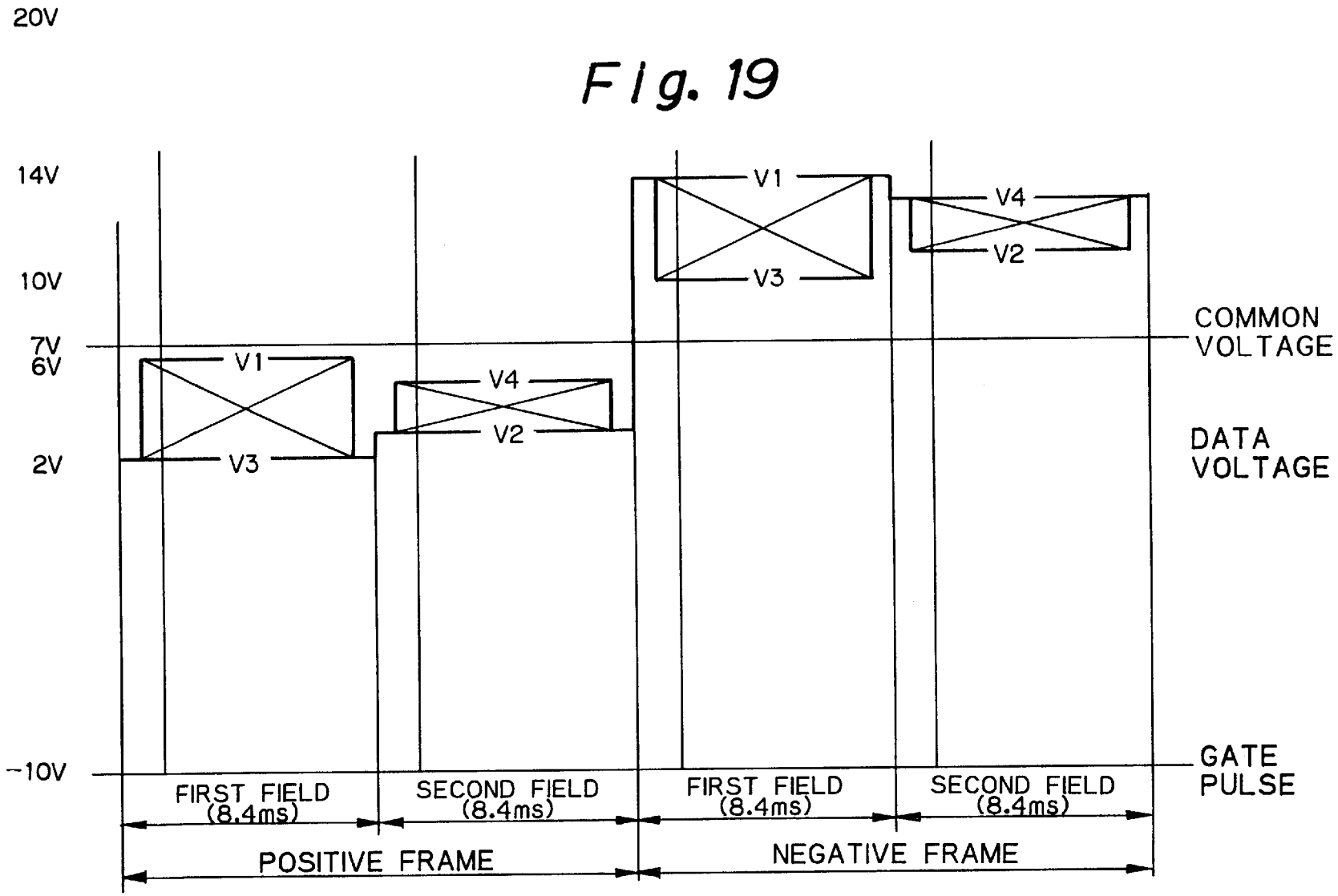
FIG. 19 is a view showing a comparison example of a driving waveform of the second embodiment.

FIG. 19 shows a comparison example of a driving waveform in each field according to the first embodiment wherein the common voltage level is constant. As shown in FIG. 19, voltages of V1=13.5 (V), V2=10. 5 (V), V3=9.5 (V), and V4=12.5 (V) are further required for the liquid crystal driving source 22 other than the voltages required in FIG. 18.

Because of the inversion of the common voltage level, the voltage applying part 4 in the liquid crystal display unit of this embodiment is simpler than that of the liquid crystal display unit in the first embodiment.

Figures 20, 20A:
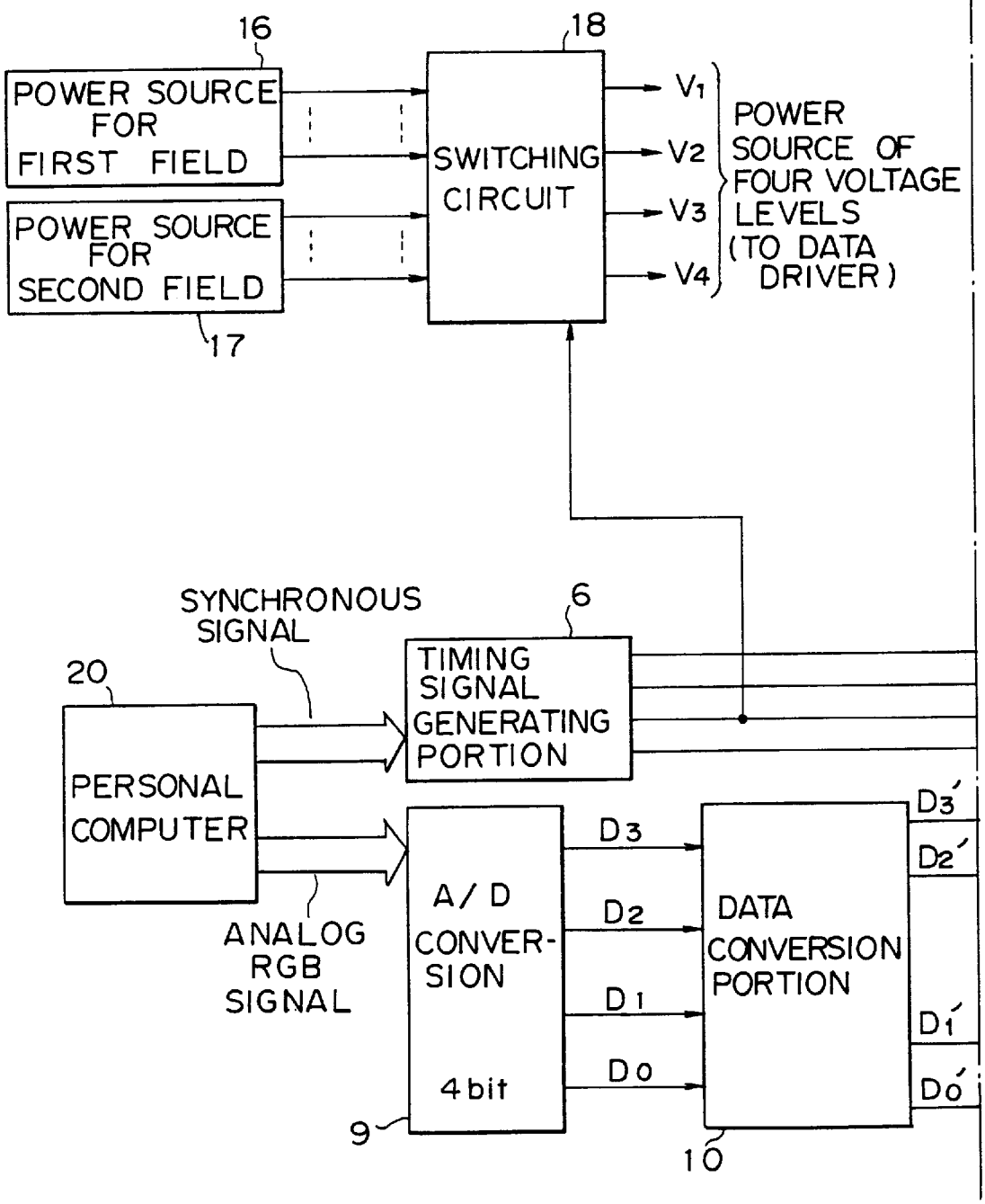
FIGS. 20A and 20B are a block diagram showing a general arrangement of a third embodiment.
Figure 20B:
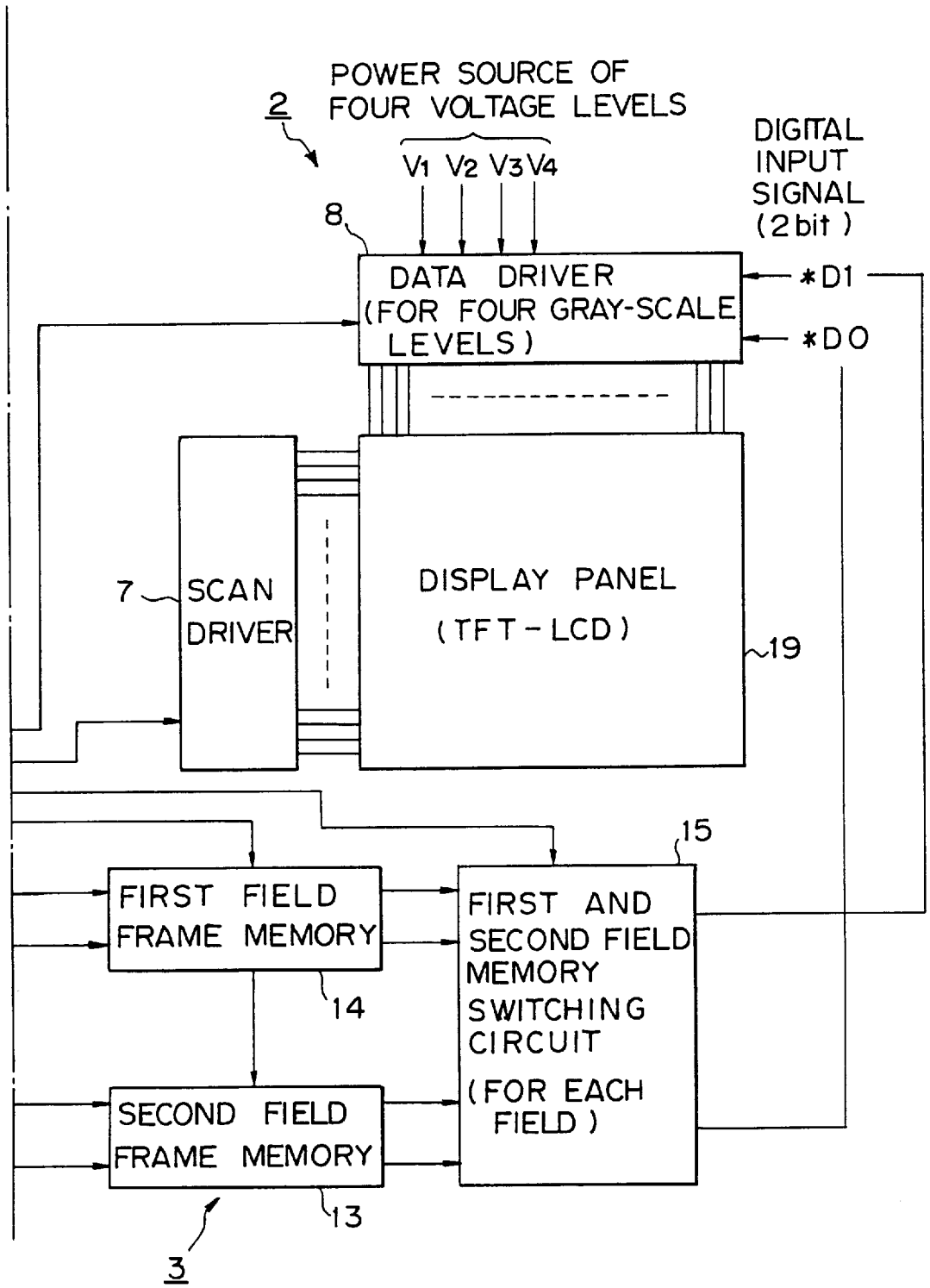

FIGS. 20A through 27 are views showing a liquid crystal display unit according to a third embodiment of the present invention, in which FIGS. 20A and 20B are a block diagram showing a general arrangement of the embodiment. In FIGS. 20A and 20B, the same reference numerals as those shown in the first embodiment of FIGS. 1A and 1B represent the same parts. Accordingly, there are a pixel selecting part 2 having a scan driver 7 and a data driver 8; a data signal generating part 3 having an A/D conversion portion 9, a data conversion portion 10, a first field frame memory 13, a second-field frame memory 14, and a display data switching portion 15; a voltage applying part 4 having a first frame liquid crystal driving source 16, a second frame liquid crystal driving source 17, and a switching circuit 18; a liquid crystal display part 5 having a liquid crystal display panel 19; and a timing signal generating portion 6 in FIGS. 20A and 20B. A common voltage source portion is omitted.

A data conversion portion 10 of this embodiment uses, for example, a conversion table stored in a ROM (Read Only Memory) to swap predetermined gray-scale levels with one another according to digital input display data corresponding to gray-scale levels. When multiple gray-scale levels are assigned with combinations of multiple voltage levels as achieved in the first and second embodiments, a problem occurs that gray-scale level characteristics shift.

Figures 21A, 21B:
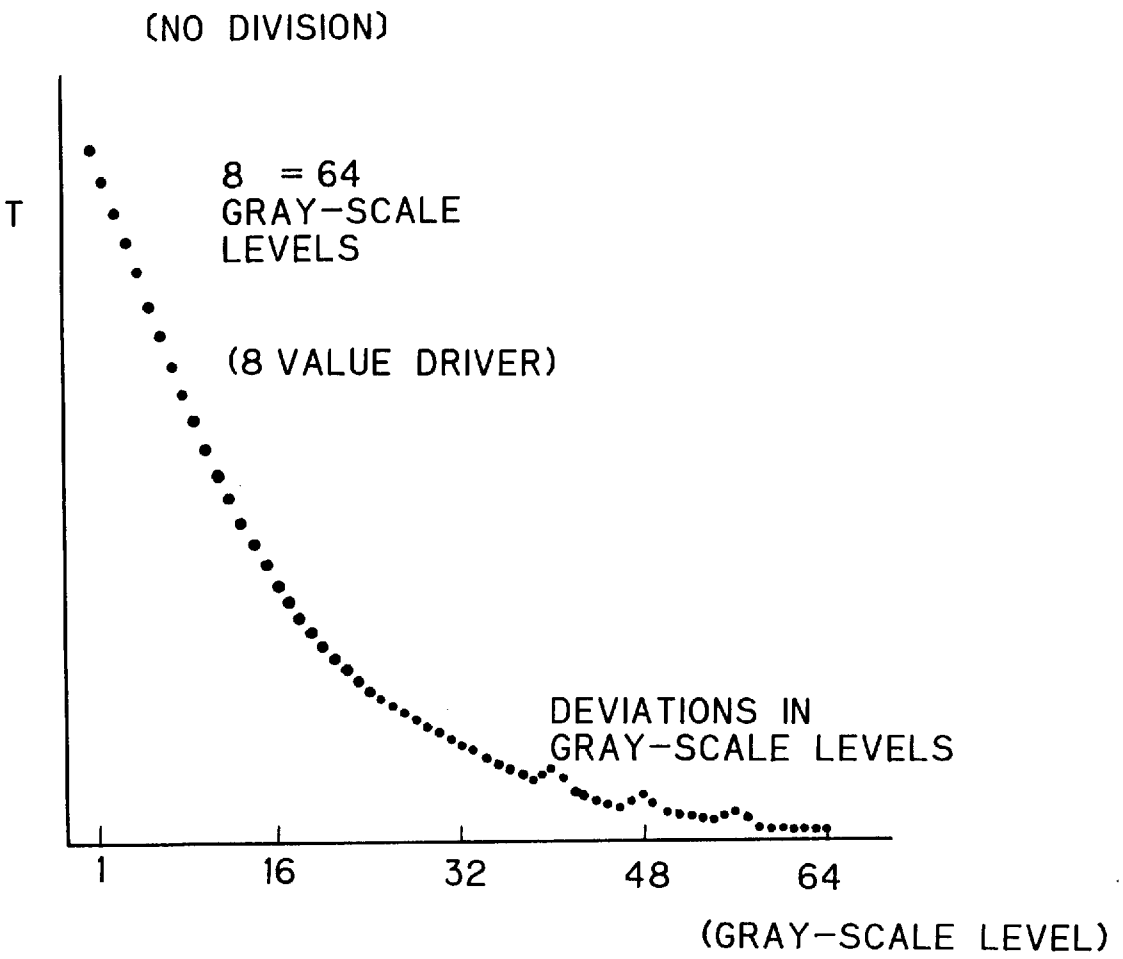
FIGS. 21A and 21B are a view showing characteristics of assignment of 64 gray-scale levels.
Figure 22:
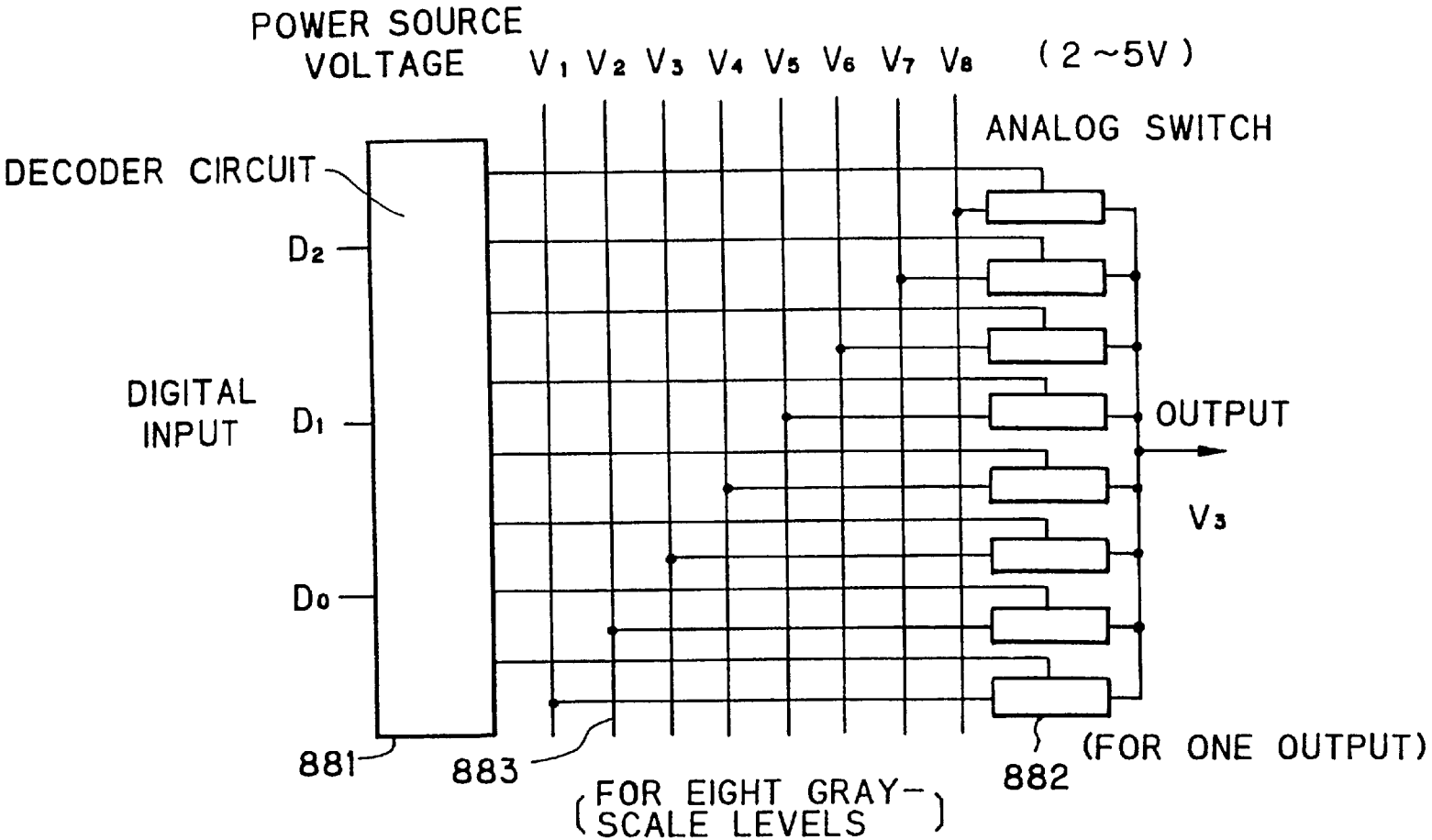
FIG. 22 is a block circuit diagram showing a digital data driver of eight gray-scale levels.

FIGS. 21A and 21B show a result of the measurement of characteristics of 64 gray-scale levels assigned with use of an eight-value digital driver (a digital data driver for eight gray-scale levels). FIG. 22 shows a part of the eight-value digital driver 88 having a decoder circuit 881, eight analog switches 882, and eight data voltage lines 883 to which eight power source voltage V1 to V8 are applied. Normally, this eight-value digital driver 88 can realize eight gray-scale levels by switching ON one of the analog switches 882 in accordance with eight kinds of digital input signals. But when this eight-value digital driver 88 is installed in the circuit in FIG. 20, it can output 64 gray-scale levels. As shown in FIGS. 21A and 21B, shifts in the gray-scale levels are observed at positions over a gray-scale level 32. At these positions, the order of brightness is inverted.

Figure 23:
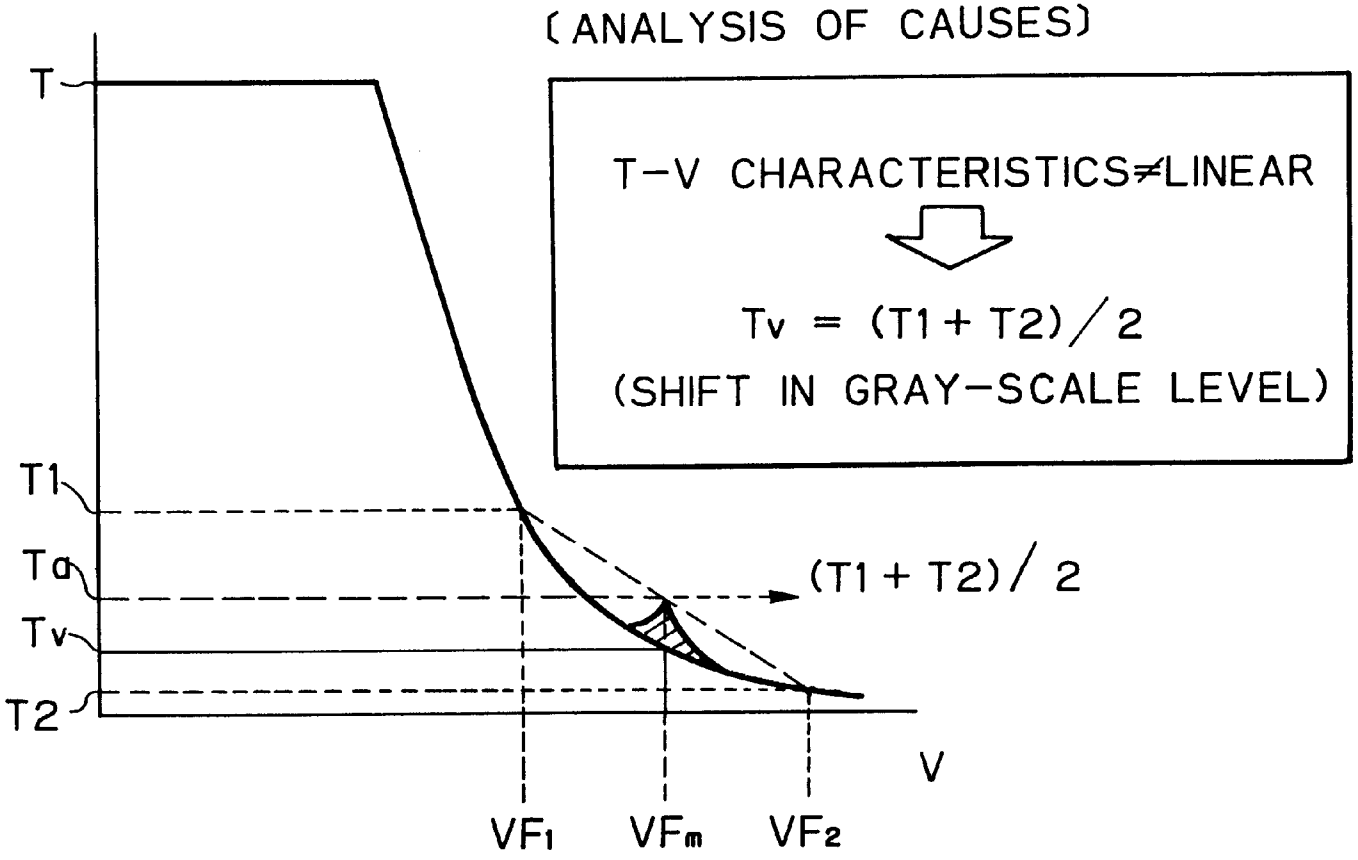
FIG. 23 is an explanatory view showing causes of deviations in gray-scale levels.

This is caused because, as shown in FIG. 23, T-V (Transmissivity-Voltage) characteristics of liquid crystals are nonlinear especially in the high field voltage part. Due to this nonlinearity, a transmissivity Ta which is an average of transmissivities T1 and T2 obtainable from field voltages VF1 and VF2 is different from the actual transmissivity Tv obtainable from an average voltage VFm=(VF1+VF2)/2.

Accordingly, this embodiment rearranges the order of shifted gray-scale levels to provide normal gray-scale level characteristics. A principle of this will be explained with reference to FIGS. 24 and 25, for the case of 4 values×4 values=16 gray-scale levels.

Figure 24:
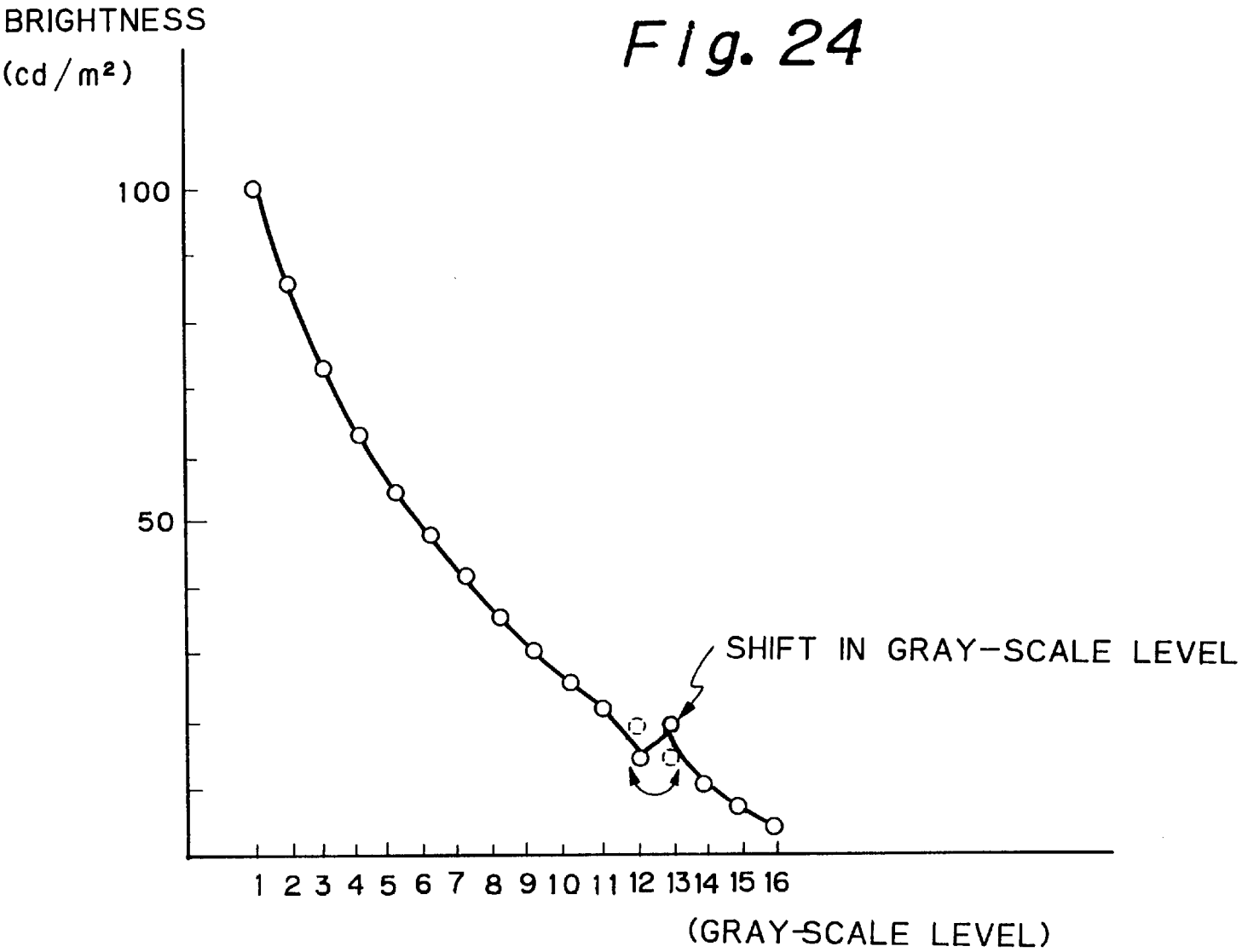
FIG. 24 is an explanatory view showing a principle of swapping deviated gray-scale levels with each other.

FIG. 24 shows T-V characteristics of liquid crystal display panel 19 in FIG. 20 using the normal data signal. In FIG. 24, it is clear that gray-scale levels 12 and 13 are shifted from normal positions. Accordingly, normal gray-scale levels are obtained by swapping input data for the gray-scale levels 12 and 13 with each other in this embodiment.

Concretely, as shown in FIG. 26, input data [1011] for the gray-scale level 12 and input data [1100] for the gray-scale level 13 are switched into [1100] for the gray-scale level 12 and [1011] for the gray-scale level 13. In this way, the gray-scale levels are swapped with each other to prevent the shift.

Figure 27:
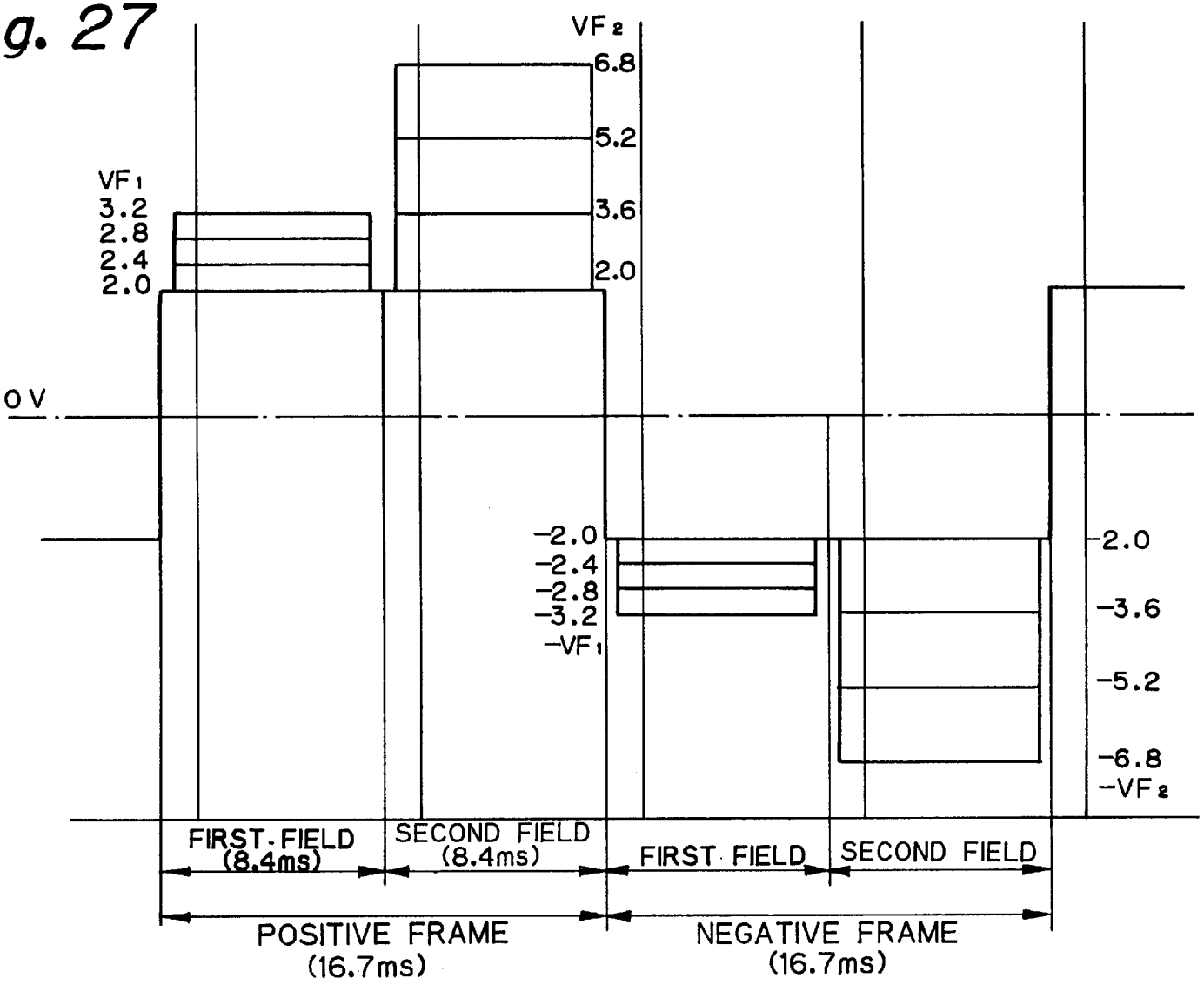
FIG. 27 is a view showing examples of driving waveforms of the third embodiment.

FIG. 27 shows an example of a driving waveform of this embodiment showing the field voltages of VF1 and VF2 to obtain gray-scale levels shown in FIG. 25.

Figures 28, 28A:
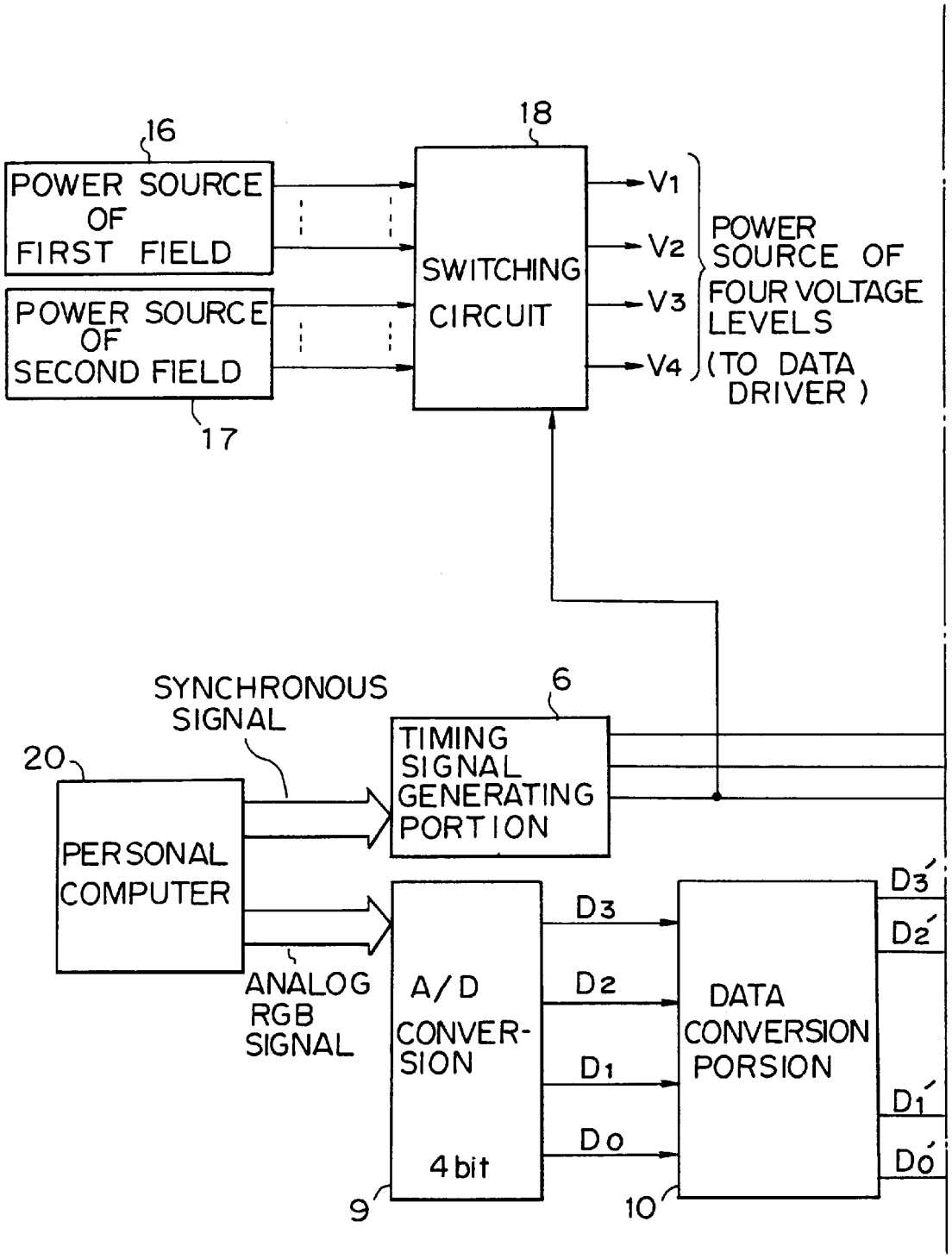
FIGS. 28A and 28B are a block diagram showing a general arrangement of a fourth embodiment.
Figure 28B:
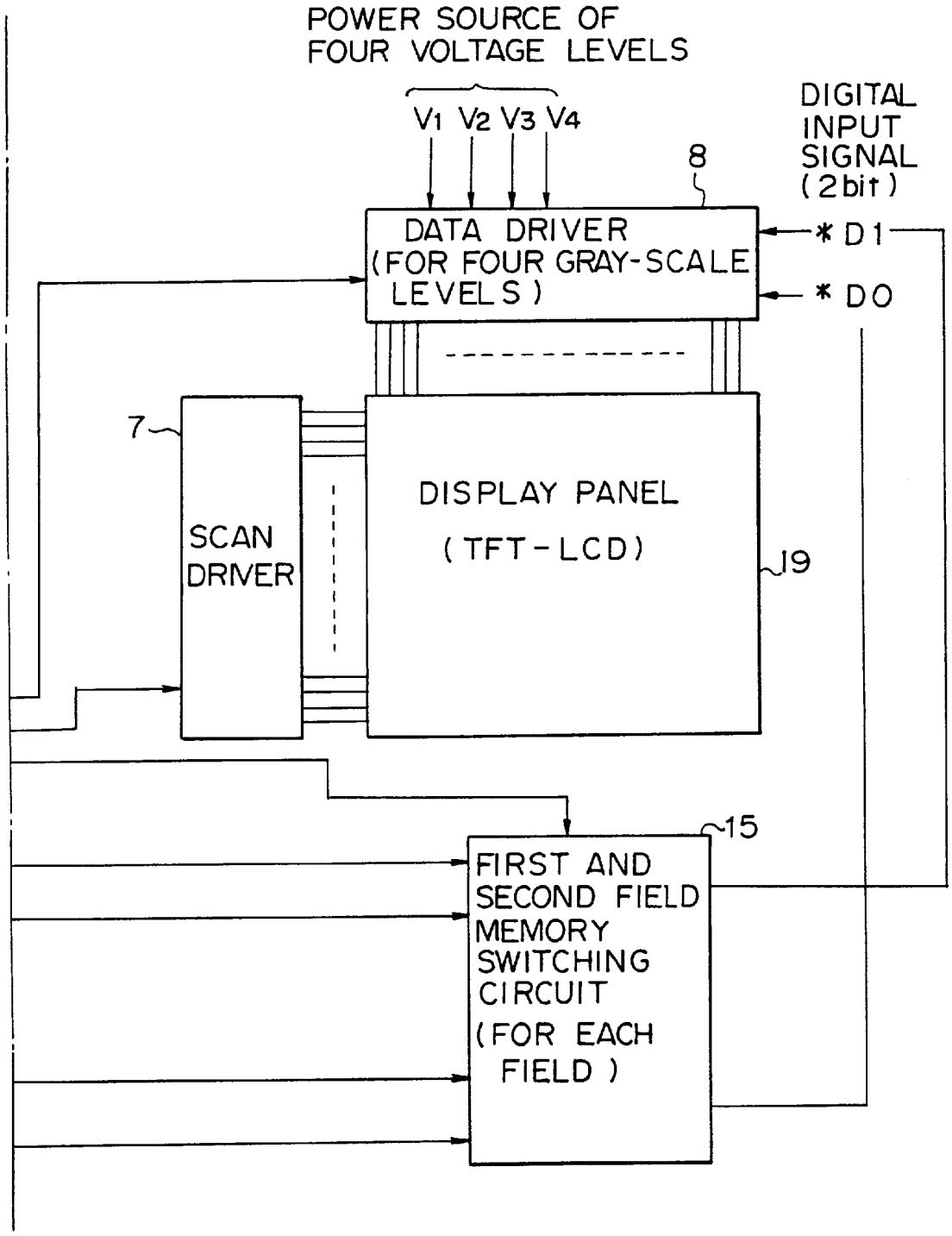
Figure 29:
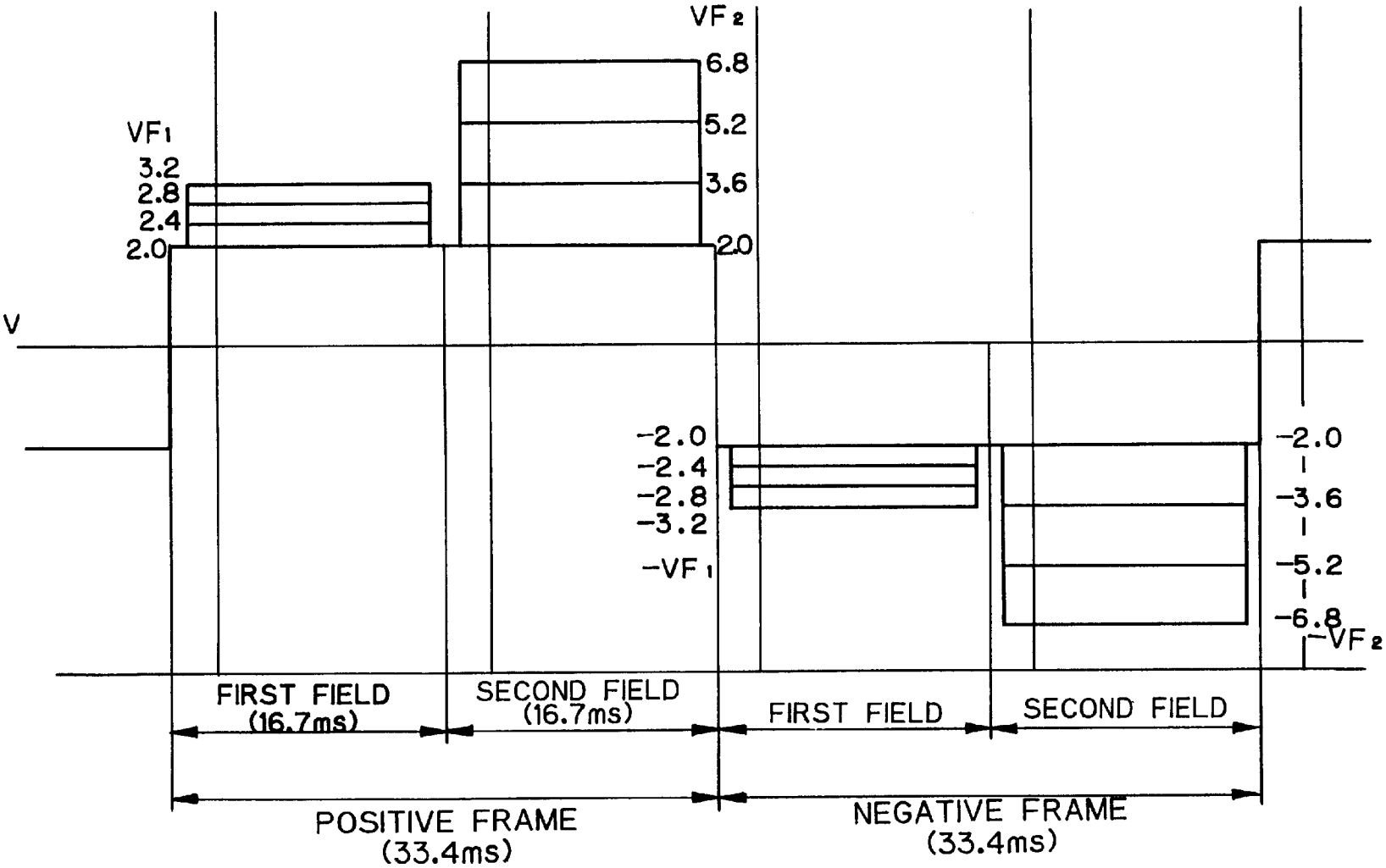
FIG. 29 is a view showing examples of driving waveforms of the fourth embodiment.

FIGS. 28A and 29 are views showing a liquid crystal display unit according to a fourth embodiment of the present invention, in which FIGS. 28A and 28B is a block diagram showing a general arrangement of this embodiment. In FIGS. 28A and 28B, the same reference numerals as those shown in the third embodiment of FIGS. 20A and 28B denote the same parts.

The liquid crystal display unit 1 of the third embodiment carries out the double speed scanning in displaying an image, while the liquid crystal display unit 1 of this embodiment does not carry out the same. Accordingly, the difference between the third embodiment and the fourth embodiment is that the display unit 1 of this embodiment is not provided with the first and second field frame memories 13 and 14 of the third embodiment of FIG. 20.

As a result, a driving waveform shown in FIG. 29 of this embodiment is twice as long, along a temporal axis, as the driving waveform of FIG. 27, so that this embodiment is slightly disadvantageous in terms of flickering but requires no frame memories.

Figures 30, 30A:
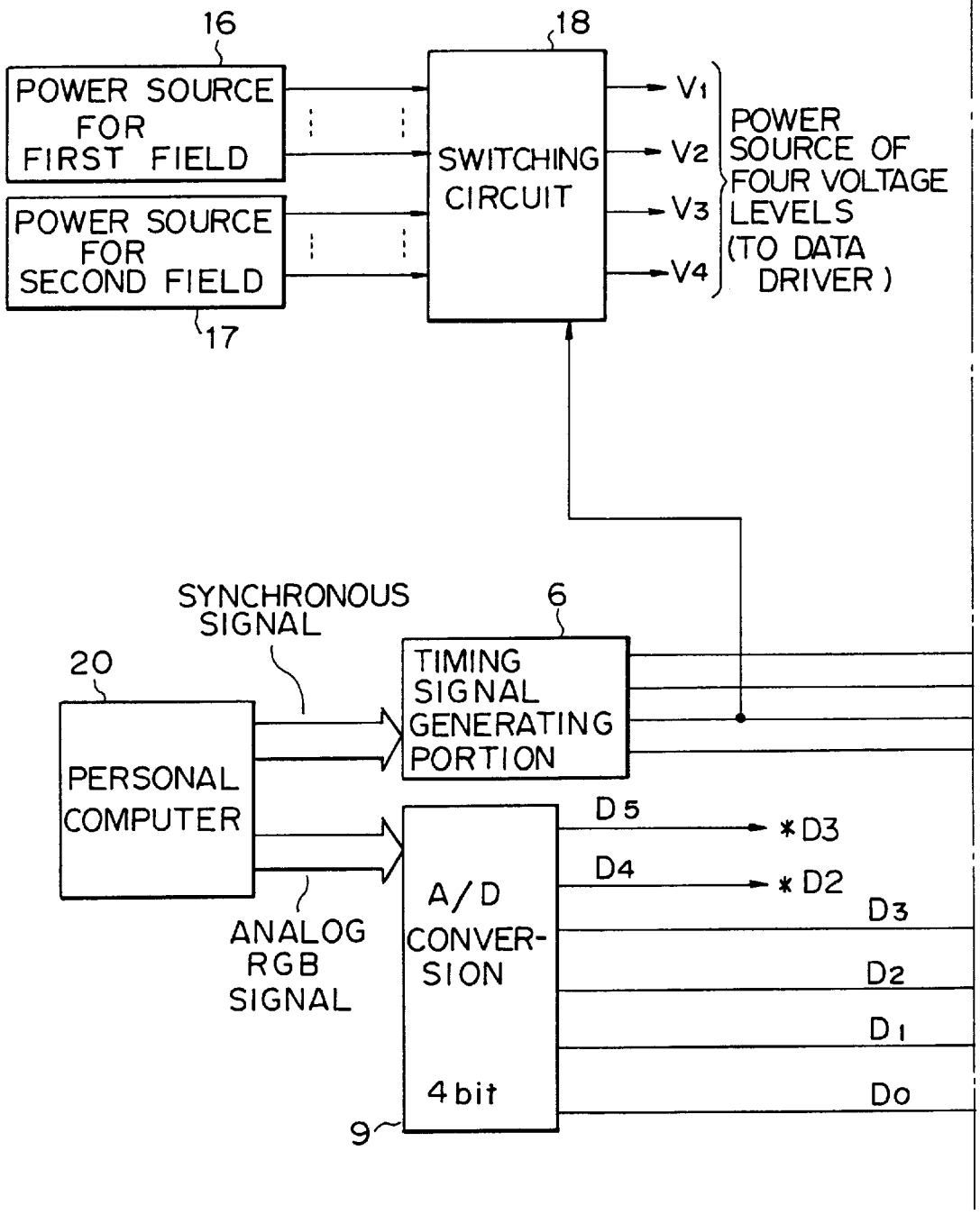
FIGS. 30A and 30B are a block diagram showing a general arrangement of a fifth embodiment.
Figure 30B:
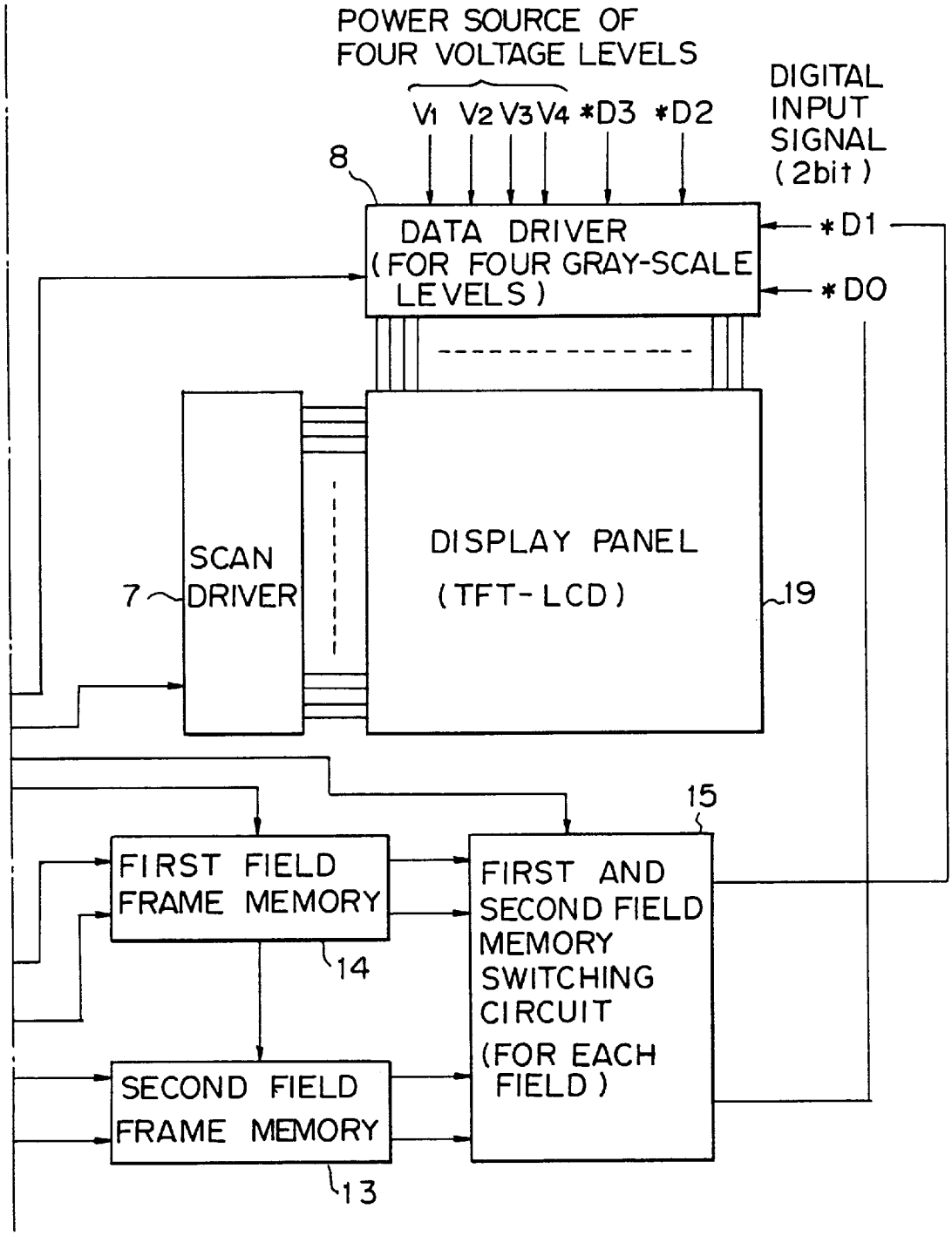

FIGS. 30 through 39 are views showing a liquid crystal display unit according to a fifth embodiment of the present invention, in which FIG. 30 is a block diagram showing a general arrangement of the embodiment. In FIG. 30, the same reference numerals as those shown in the third embodiment of FIG. 20 represent the same parts.

The liquid crystal display unit 1 of this embodiment has substantially the same arrangement as that of the third embodiment shown in FIG. 20 except that the data conversion portion 10 is not provided for this embodiment.

Figure 31:
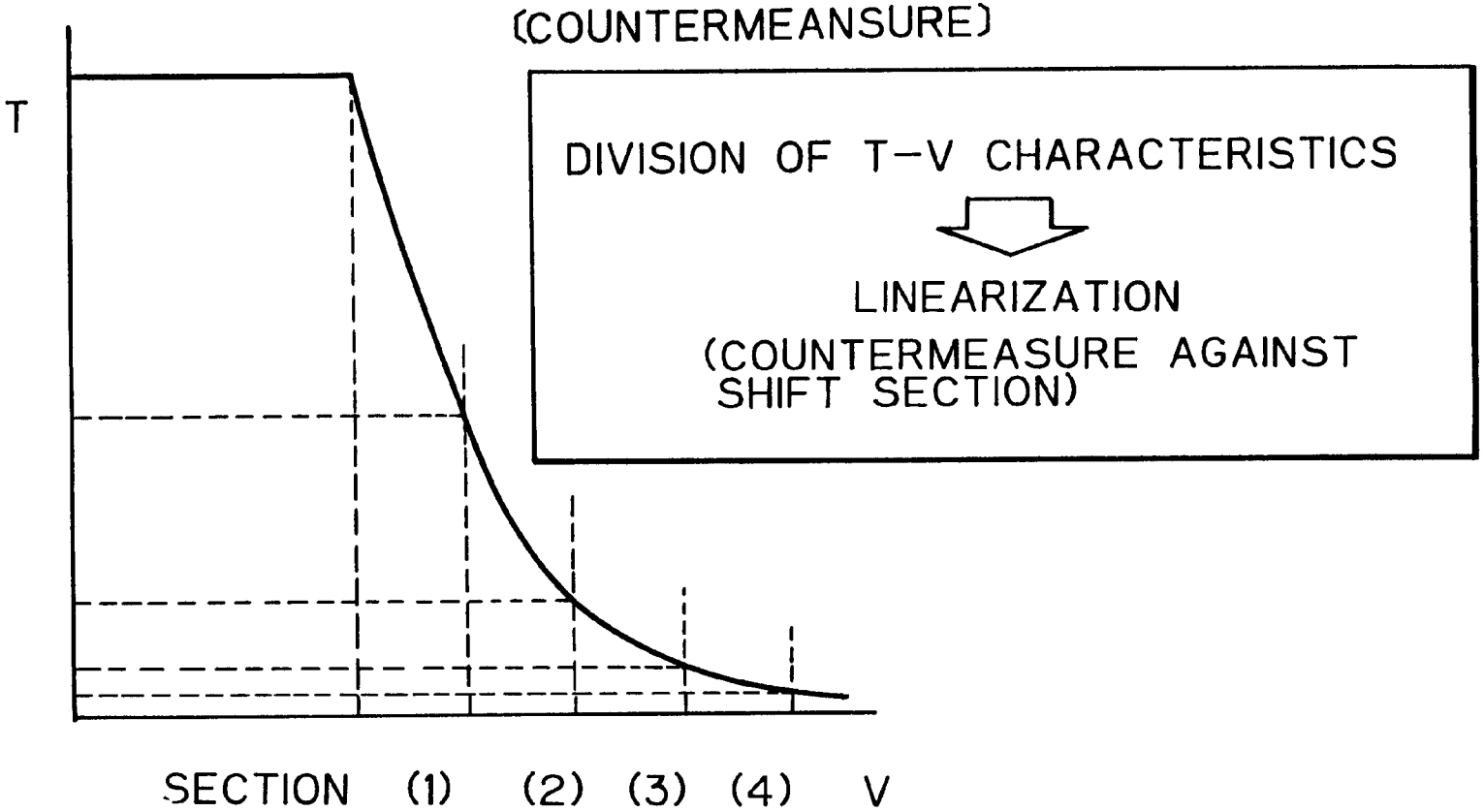
FIG. 31 are the T-V characteristics explaining a division of data voltage range.

To deal with the problem that gray-scale level characteristics shift when multiple gray-scale levels are assigned with combinations of multi-valued voltage levels, this embodiment divides, as shown in FIG. 31, a range of applied voltage levels into a plurality (for example, four in this embodiment) of sections according to T-V characteristics of liquid crystal, and in each of the sections, carries out a field voltage selection.

Namely, by dividing the range of applied voltage levels into sections, non-linearity of the T-V characteristics is relaxed and linearly corrected in each of the sections, thereby correcting a deviation between an actual transmissivity and a transmissivity obtained from a mean voltage, and realizing normal gray-scale level characteristics.

Figures 32A, 32B:
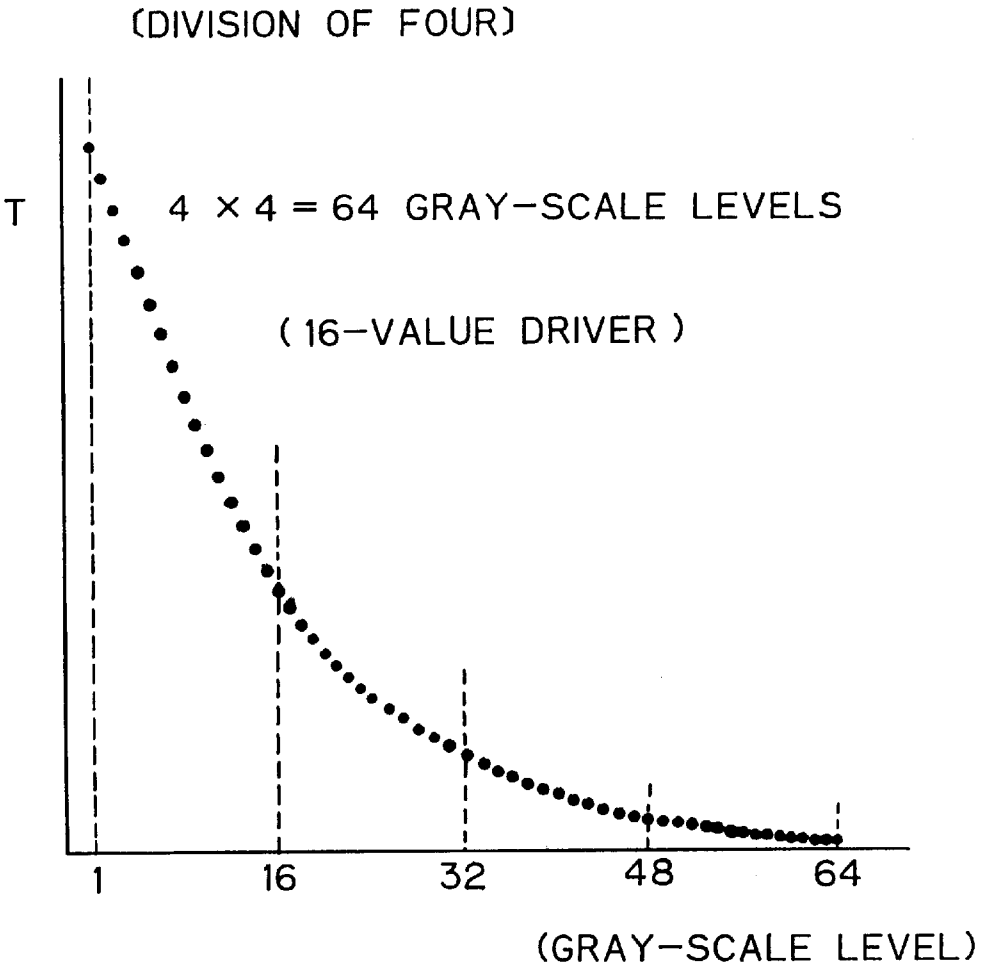
FIGS. 32A and 32B are the characteristics of assigning 64 gray-scale levels.

FIGS. 32A and 32B shows a result of a measurement of gray-scale level characteristics over a whole range of applied voltage levels divided into four sections each involving four voltage levels to assign 4 values×4 values=16 gray-scale levels.

Figure 33:
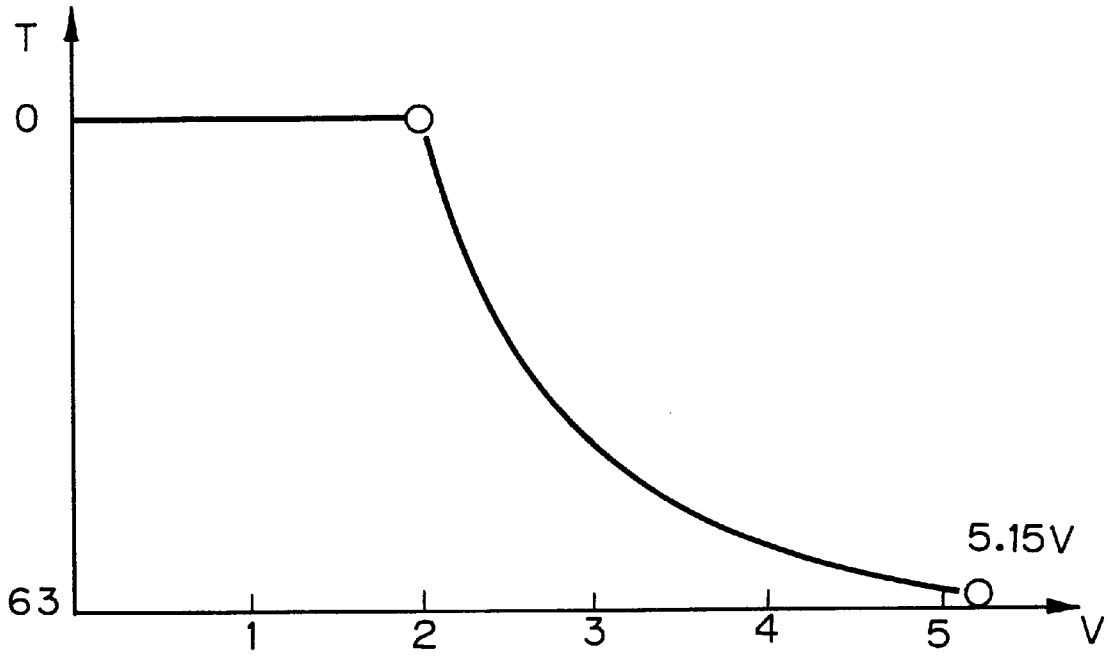
FIG. 33 are the transmissivity-voltage characteristics of liquid crystal.

FIG. 33 shows a concrete example of a T-V characteristic curve of liquid crystal. In this case, 2(V) corresponds to a white level, i.e., a gray-scale level 0, and 5.15 (V) corresponds to a black level, i.e., a gray-scale level 63.

FIG. 34 shows gray-scale levels, digital input signals, and combinations of first and second field voltages VF1 and VF2 in assigning about 260,000 colors with 64 gray-scale levels with use of a 16-value data driver 8 and field voltage modulation with four divided sections.

Figure 35:
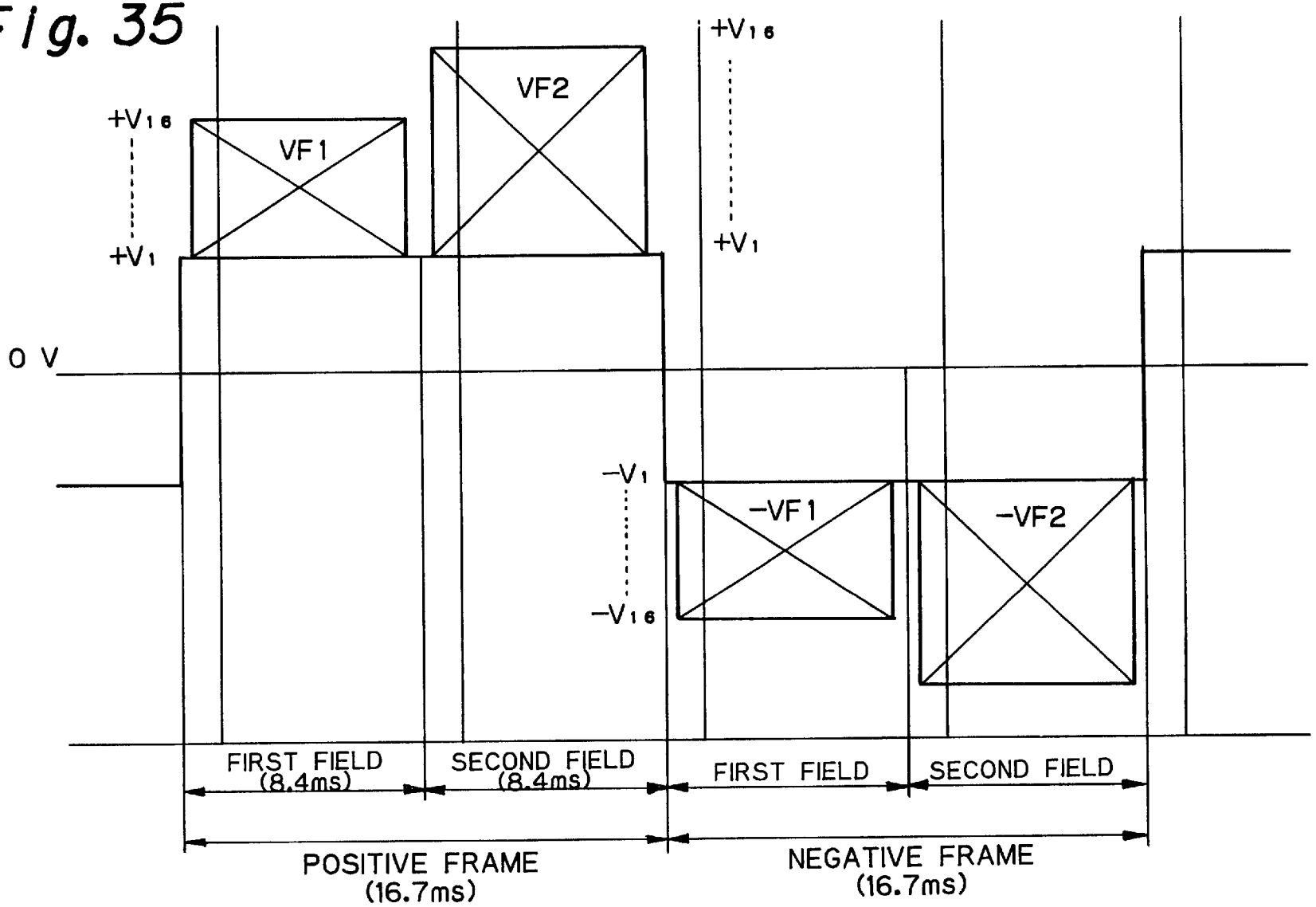
FIG. 35 is a view showing an example of a driving waveform of the fifth embodiment.

FIG. 35 shows an example of a driving voltage waveform according to this embodiment. In the figure, VF1 denotes a voltage of a first field in a positive frame, VF2 denotes a voltage of a second field in the positive frame, −VF1 denotes a voltage of a first field in a negative frame, and −VF2 denotes a voltage of a second field in the negative frame. Each voltage VF1, VF2, −VF1, and −VF2 involves data voltages shown as follows:

+VF1(2.0, 2.1, 2.2, 2.3, 2.8, 2.9, 3.0, 3.1, 3.6, 3.7, 3.8, 3.9, 4.4, 4.5, 4.6, 4.7);

+VF2(2.0, 2.4, 2.8, 3.2, 3.6, 4.0, 3.6, 4.0, 4.4, 4.8, 4.4, 4.8, 5.2, 5.6).

−VF1(−2.0, −2.1, −2.2, −2.3, −2.8, −2.9, −3.0, −3.1, −3.6, −3.7, −3.8, −3.9, −4.4, −4.5, −4.6, −4.7);

−VF2(−2.0, −2.4, −2.8, −3.2, −3.6, −4.0, −3.6, −4.0, −4.4, −4.8, −4.4, −4.8, −5.2, −5.6).

These voltages are switched from one to another and provided to the data driver 8. Among voltages provided by the data driver 8, a voltage level corresponding to input data is selected and provided to drive a liquid crystal display panel 19. Here, one frame corresponds to 16.7 ms, and a field period is 8.4 ms. With these conditions, the double speed scanning is carried out.

FIGS. 36A and 36B through 39A and 39B are views showing driving waveforms in individual fields according to this embodiment. As explained with reference to FIGS. 8A and 8B through 11A and 11B, combinations of voltage levels and/or voltage level waveforms having different phases are applied to adjacent liquid crystal pixels, thereby reducing flickering due to fluctuations in transmissivity of a liquid crystal.

Figure 36A:
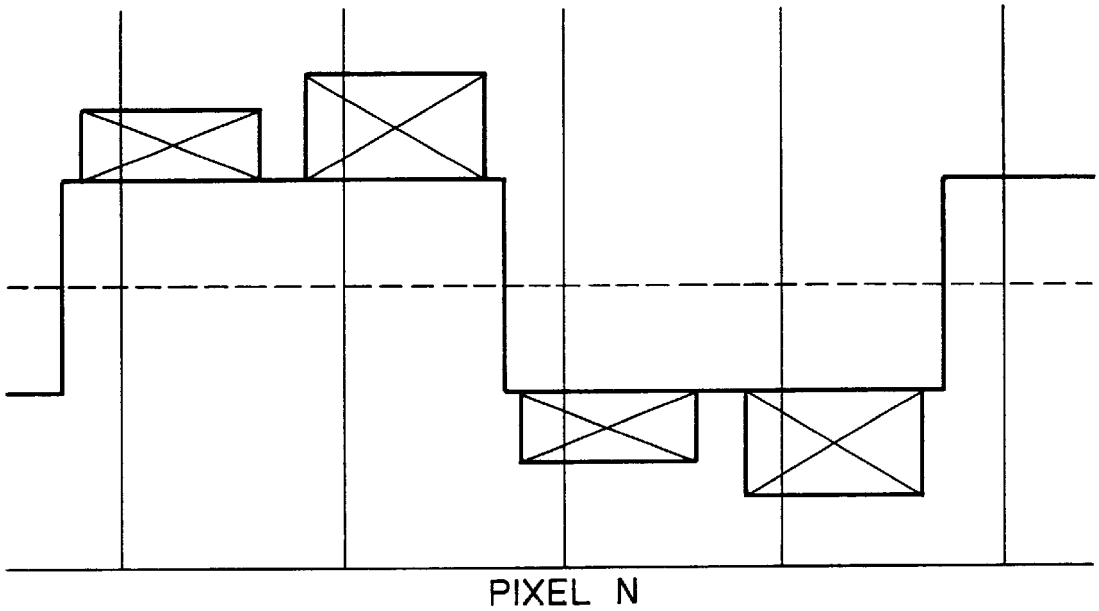
FIGS. 36A and 36B are views showing examples of driving waveforms of the fifth embodiment.
Figure 36B:
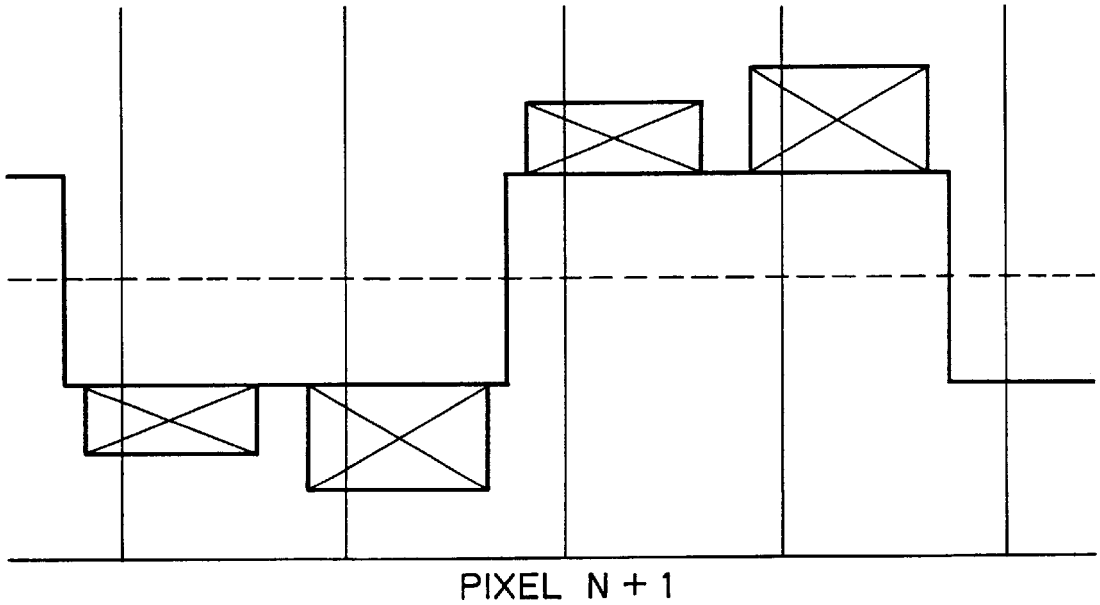
Figure 37A:
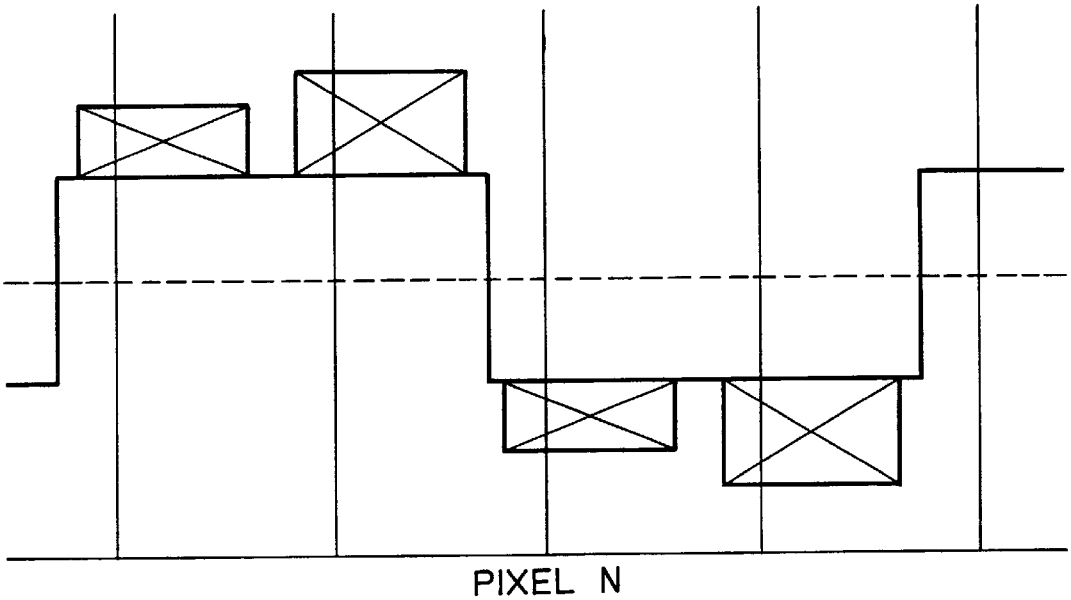
FIGS. 37A and 37B are views showing examples of driving waveforms of the fifth embodiment.
Figure 37B:
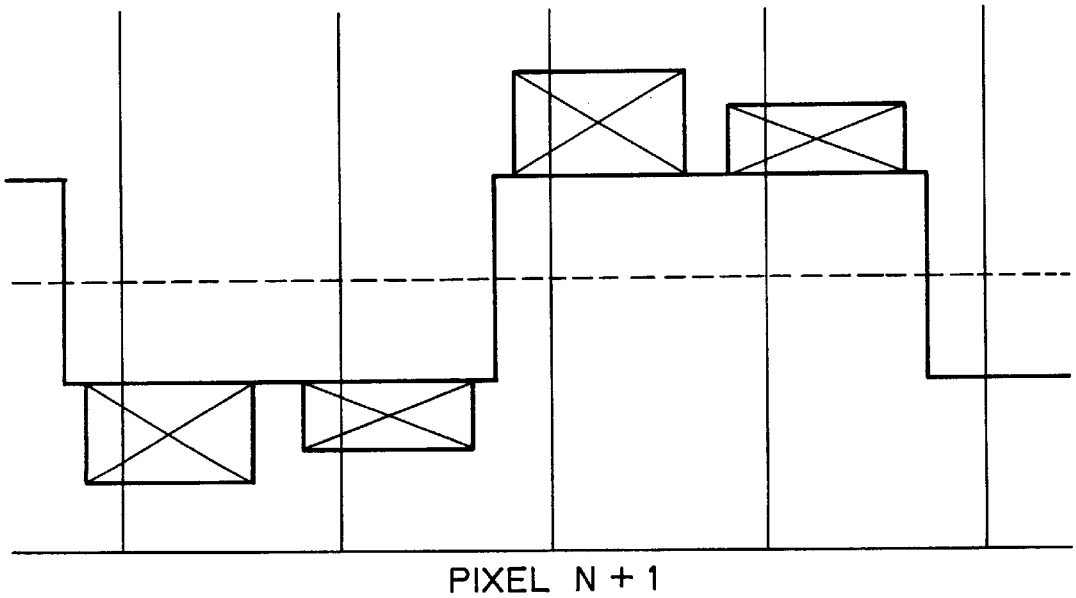
Figure 38A:
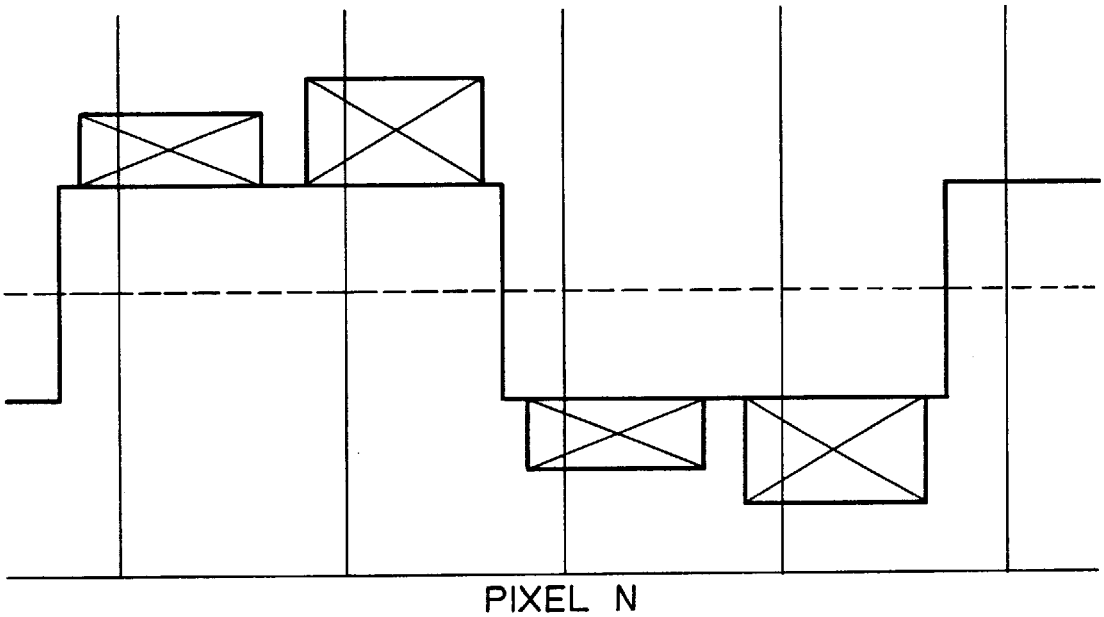
FIGS. 38A and 38B are views showing examples of driving waveforms of the fifth embodiment.
Figure 38B:
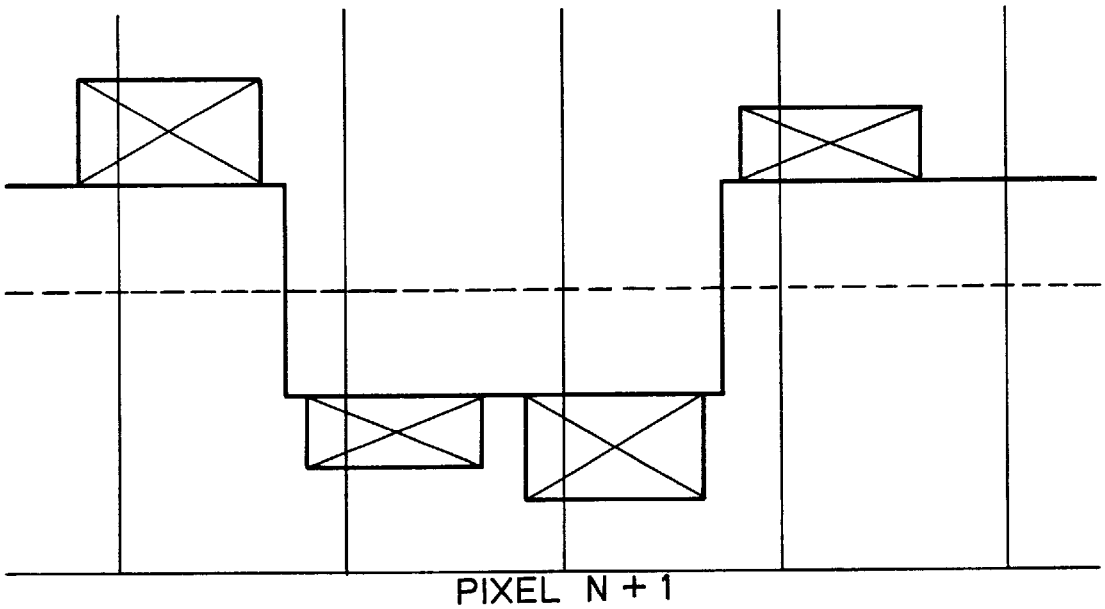
Figure 39A:
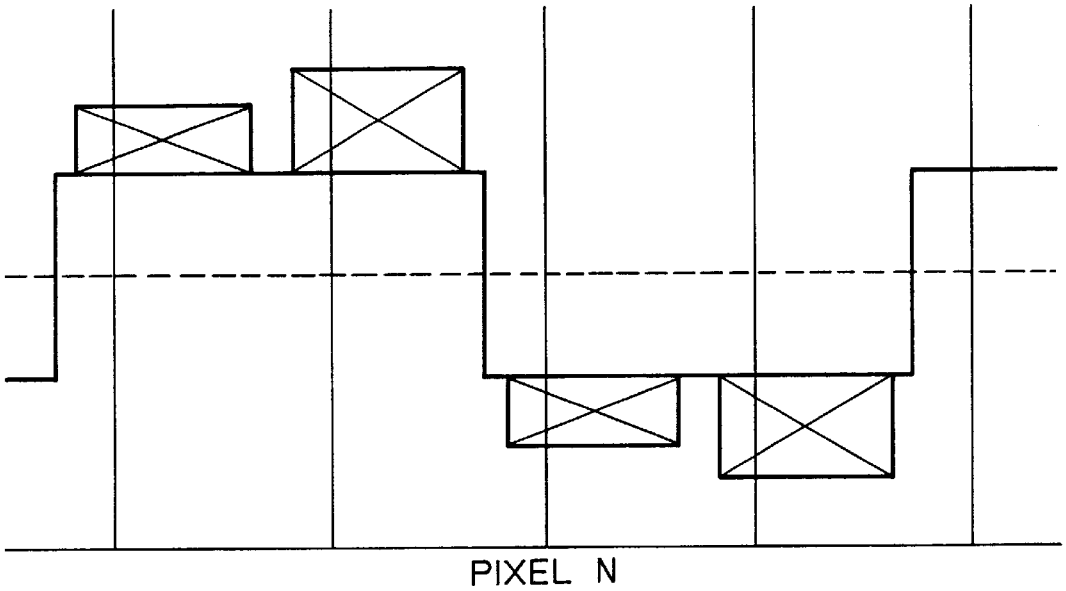
FIGS. 39A and 39B are views showing examples of driving waveforms of the fifth embodiment.
Figure 39B:
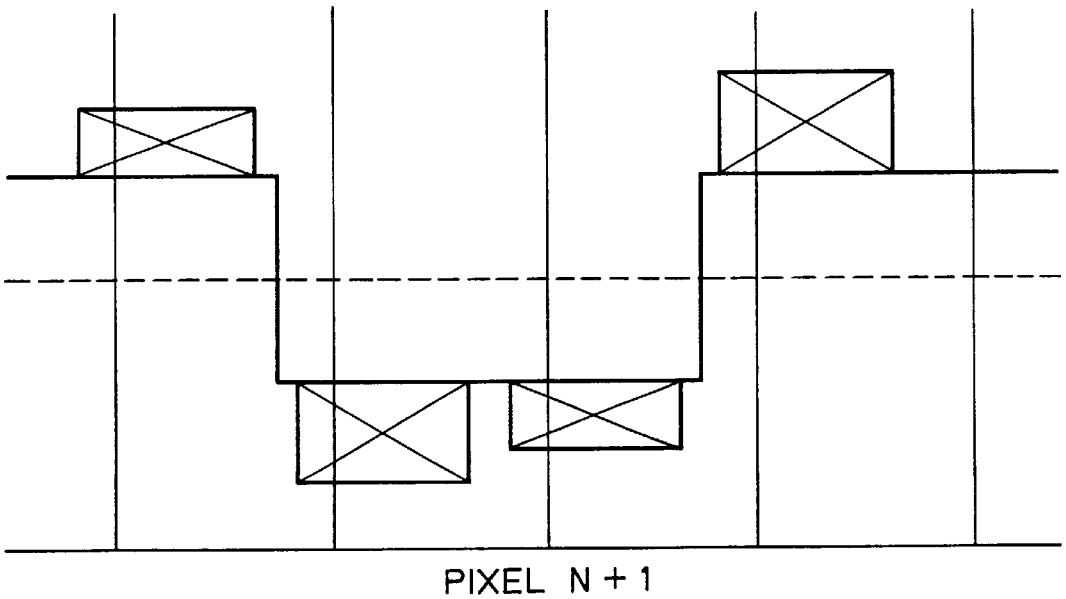

In FIGS. 36A and 36B, two sets of voltage levels are prepared and applied to each field, respectively, in FIGS. 37A and 37B changing the combinations of the voltage levels of FIGS. 36A and 36B is carried out, in FIGS. 38A and 38B changing the phase of the voltage levels of FIGS. 36A and 36B is carried out, and in FIGS. 39A and 39B changing the combination and phase of the voltage levels of FIGS. 36A and 36B is carried out.

Figures 40, 40A:
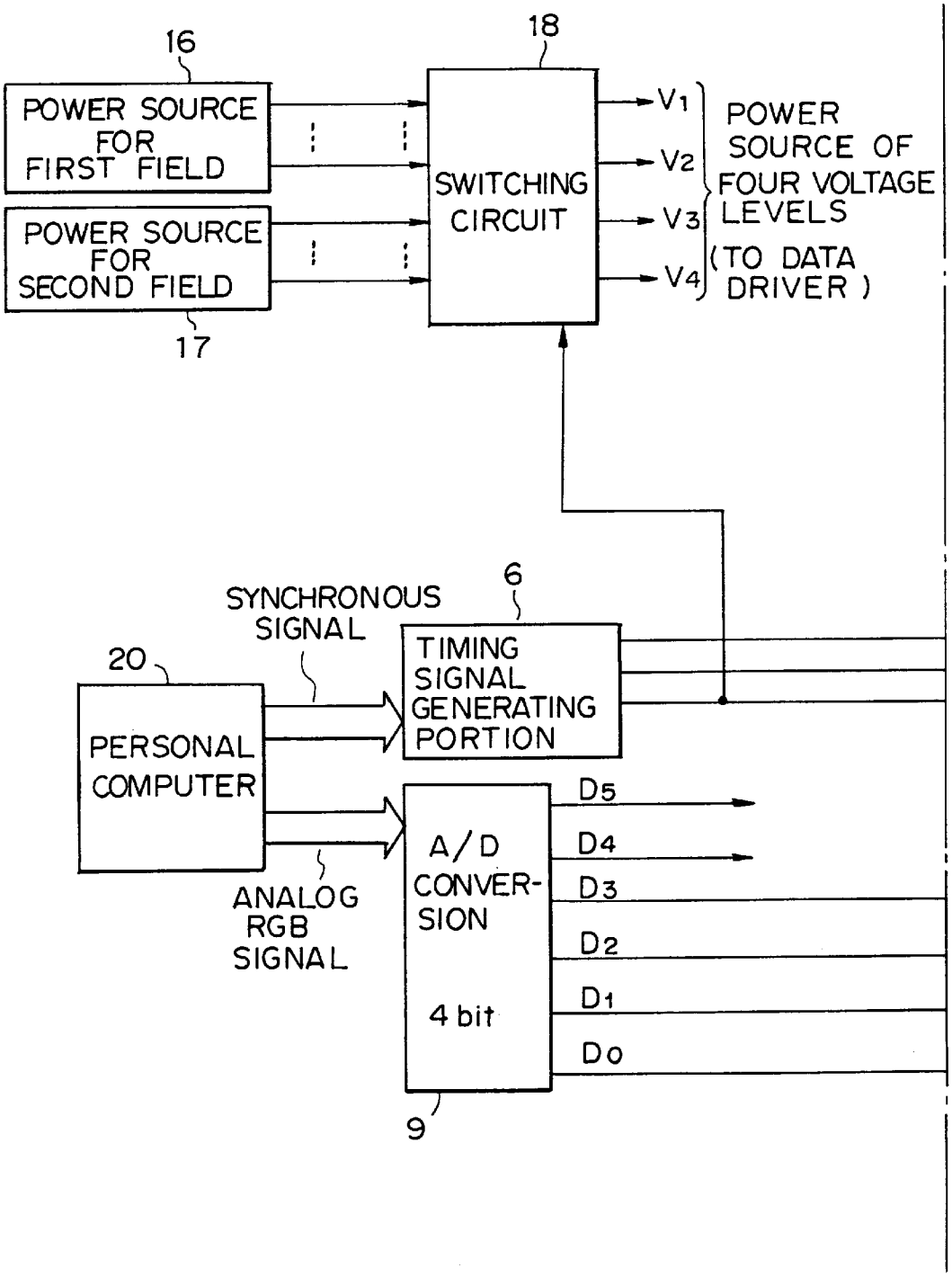
FIGS. 40A and 40B are a block diagram showing a general arrangement of a sixth embodiment.
Figure 40B:
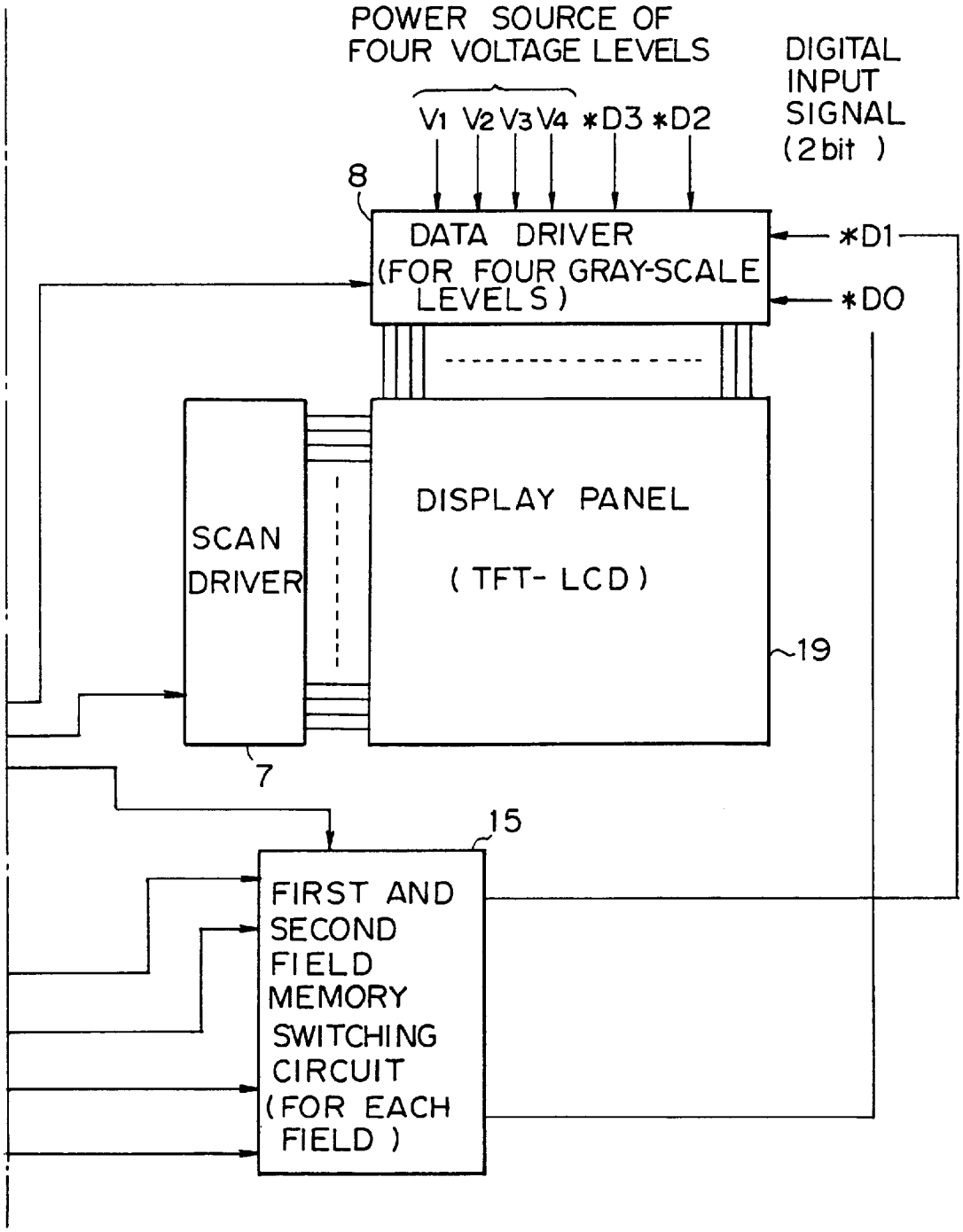
Figure 41:
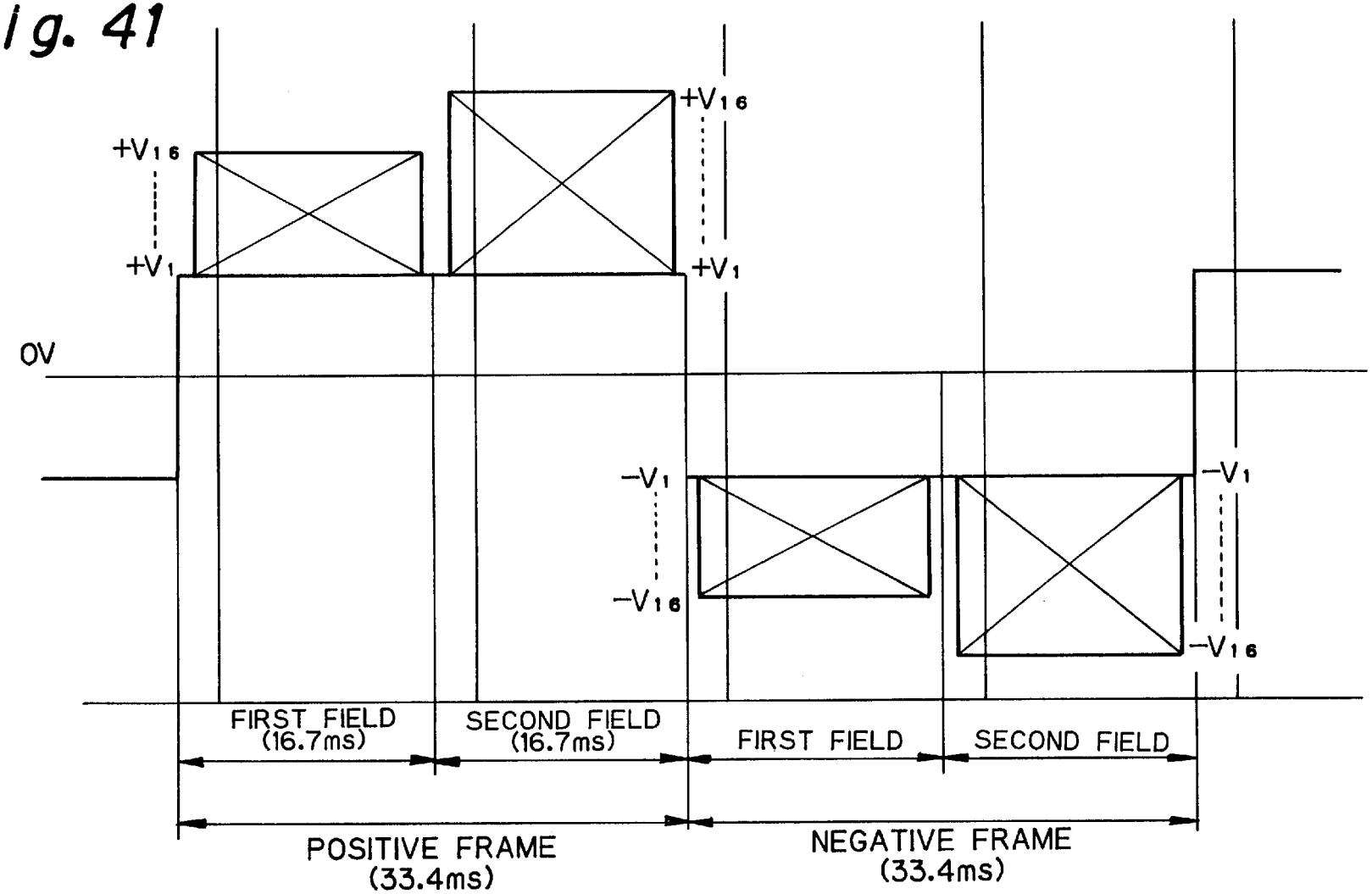
FIG. 41 is a view showing an example of a driving waveform of the sixth embodiment.

FIGS. 40A and 41 are views showing a liquid crystal display unit according to a sixth embodiment of the present invention, in which FIGS. 40A and 40B are a block diagram showing a general arrangement of the embodiment. In FIGS. 40A and 40B, the same numerals as those of the fifth embodiment of FIG. 30 denote the same parts.

The liquid crystal display unit 1 of the fifth embodiment carries out the double speed scanning, while the liquid crystal display unit 1 of this embodiment does not carry out the same so that the first and second field frame memories 13 and 14 of the fifth embodiment of FIG. 30 are not provided for this embodiment.

Compared with the driving waveform shown in FIG. 35, a driving waveform of this embodiment shown in FIG. 41 is twice as long, along a temporal axis so that this embodiment is slightly disadvantageous in terms of flickering but advantageous in eliminating the frame memories.

Figures 42, 42A:
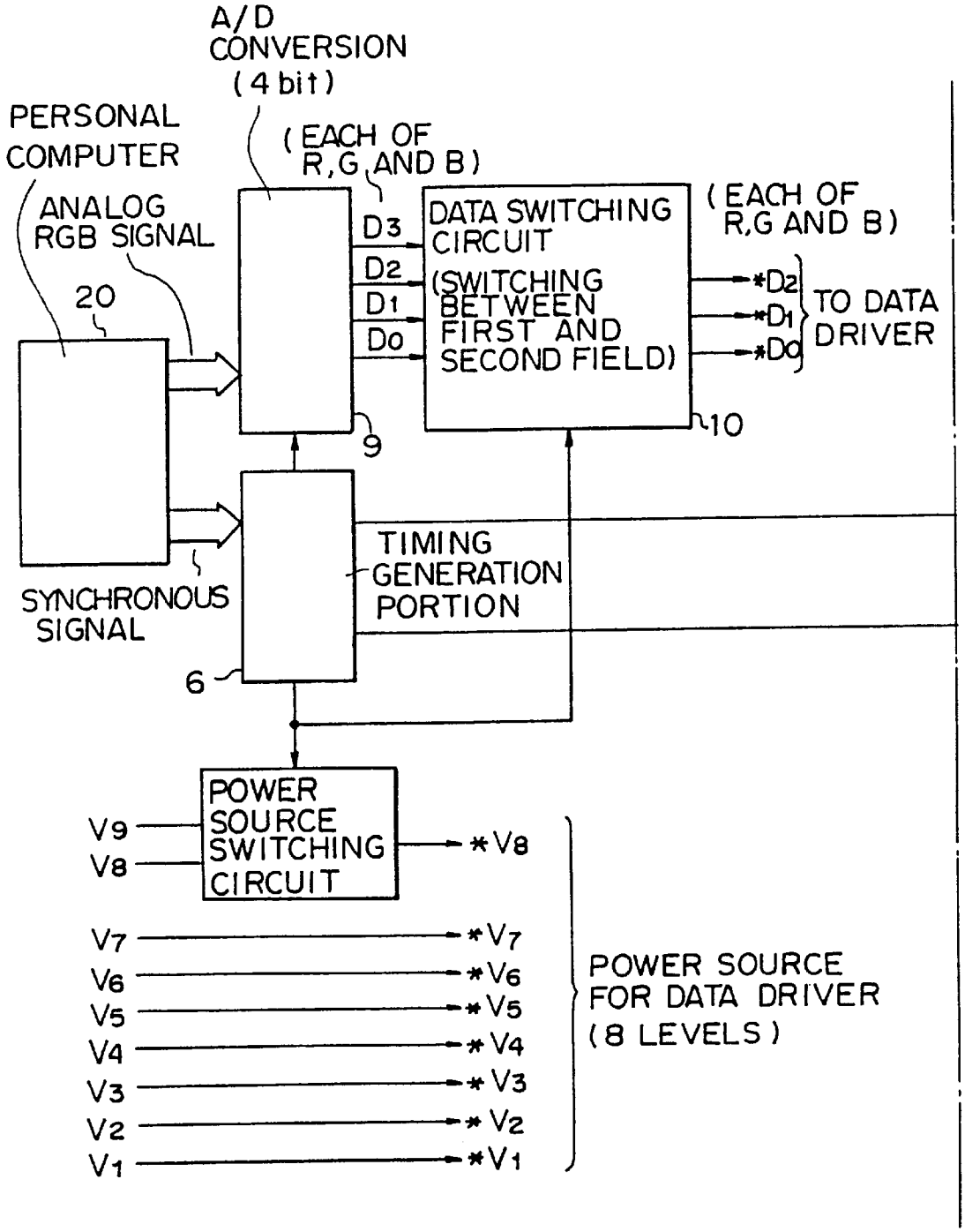
FIGS. 42A and 42B are a block diagram showing a general arrangement of a seventh embodiment.
Figure 42B:
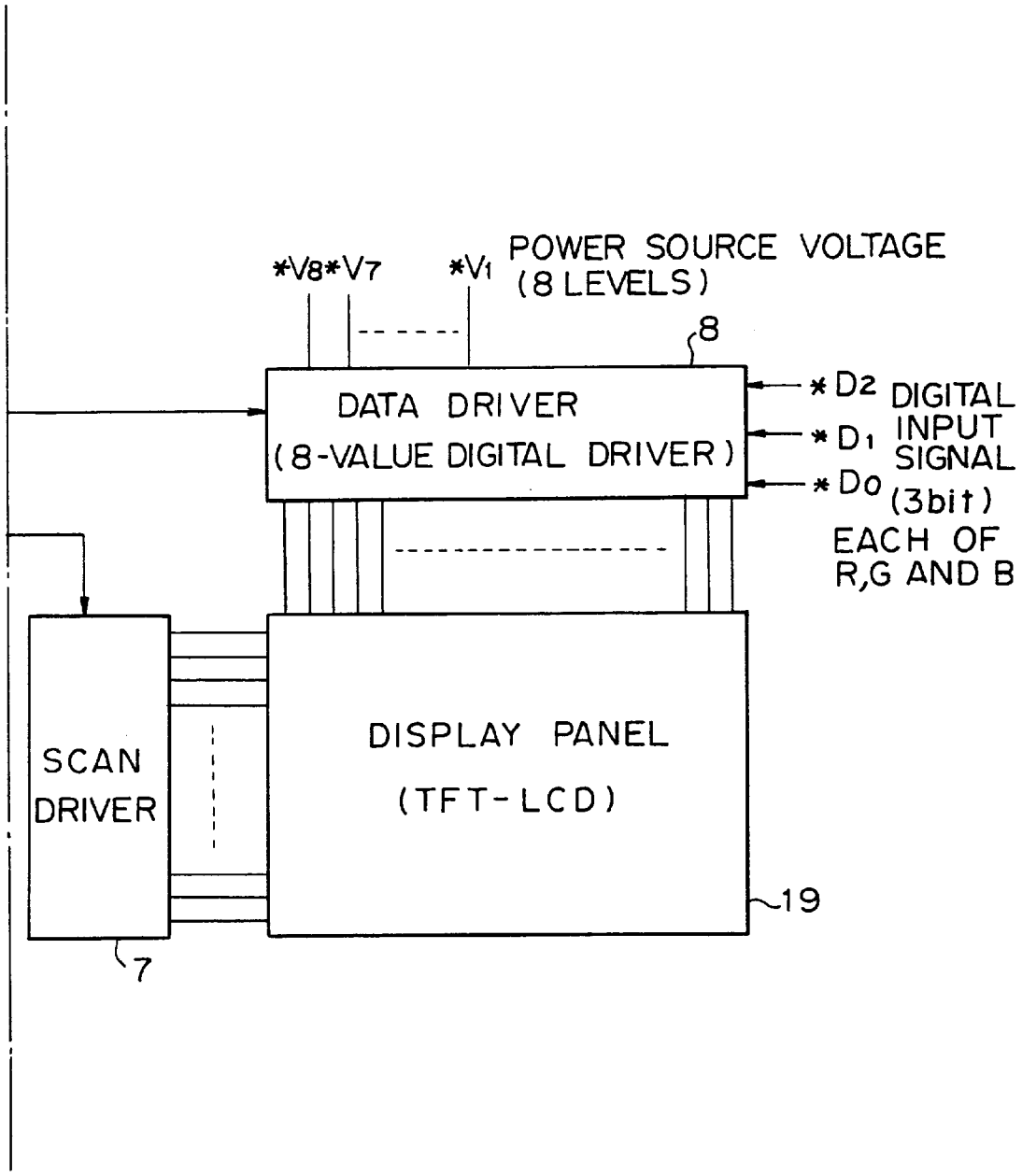
Figure 46:
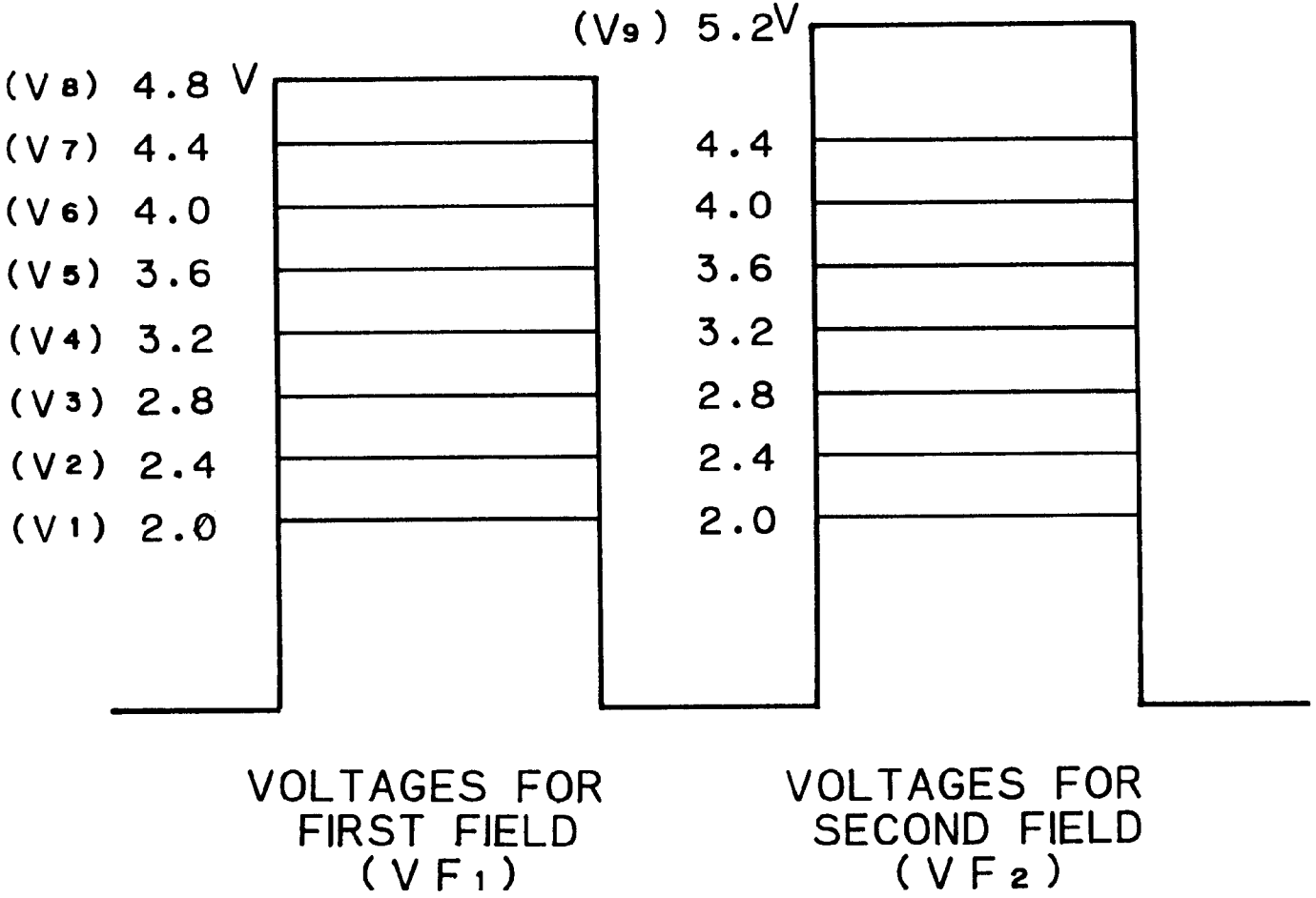
FIG. 46 is a view showing examples of combinations of first and second field voltages.
Figure 47:
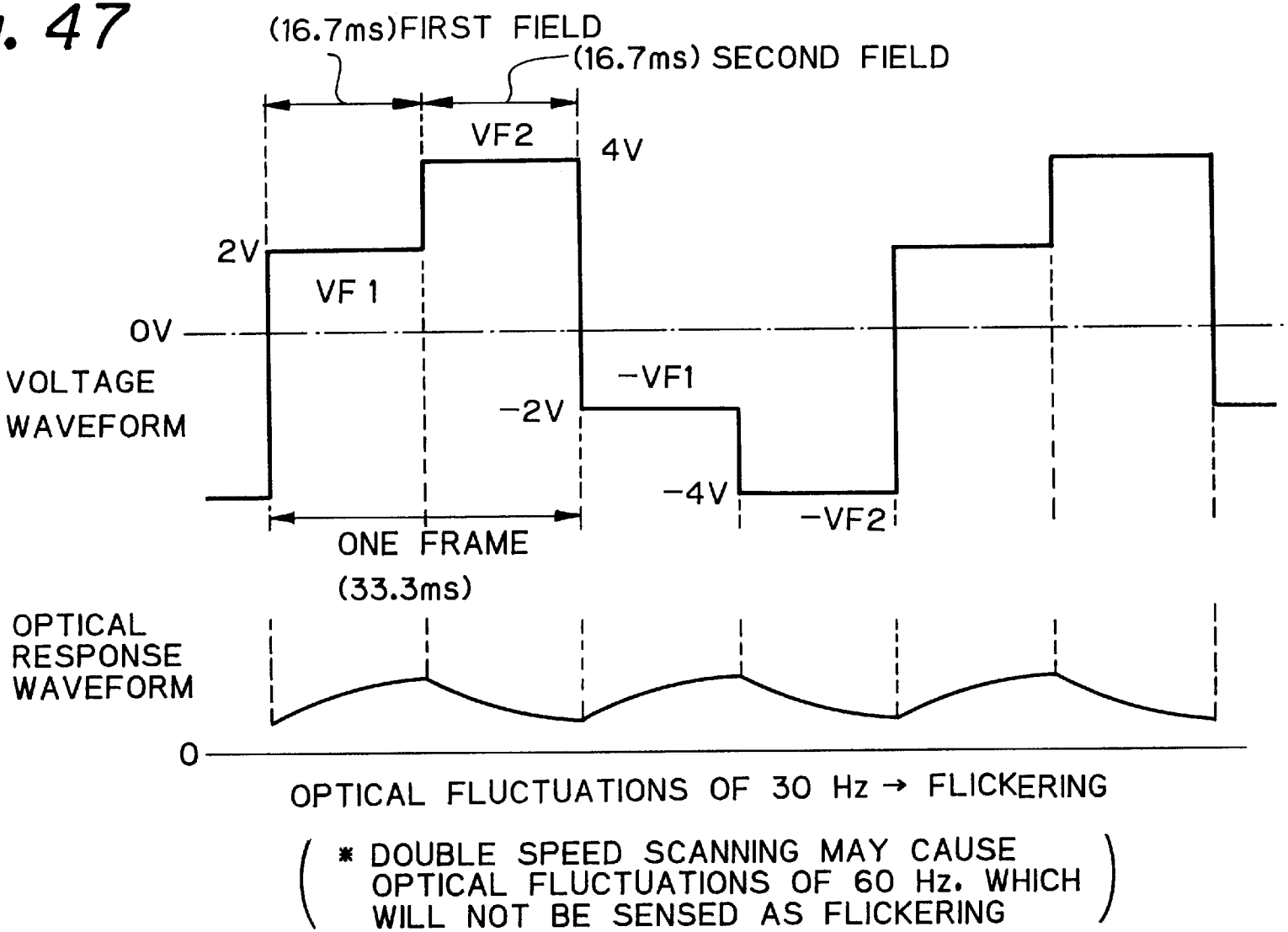
FIGS. 47A and 47B are explanatory views showing flickering according to a field voltage modulation method (with no double scanning)

FIGS. 42A through 52 are views showing a liquid crystal display unit according to a seventh embodiment of the present invention, in which FIGS. 42A and 42B is a block diagram showing the embodiment serving as a circuit for assigning 16 gray-scale levels with the use of an 8-gray-scale-level driver. Though this embodiment does not carry out double speed scanning, it can realize elimination of frame memories and suppression of flickering of 30 Hz.

In FIGS. 42A and 42B, an A/D conversion portion 9 converts each of RGB data from a personal computer 20 into data of four bits (D0 to D3) corresponding to 16 gray-scale levels. Thereafter, a data conversion portion 10 converts the data into data of three bits (*D0 to *D2) for first and second fields, and according to the data of three bits, the data driver 8 selects eight-level power source voltages (*V1 to *V8) for assigning 16 gray-scale levels.

FIG. 43 is a table showing a relationship between input and output data of the data conversion portion 10, and FIG. 44 is a table showing a relationship between input data (gray-scale levels) of the data conversion portion 10, selected power source voltages, and mean output voltages. These relations may be expressed, for example, as a conversion table written in a ROM (not shown).

In FIG. 44, for example, input data for a gray-scale level 1 are all zeroes by which VF1 is selected for both a first field voltage VF1 and a second field voltage VF2 and a mean voltage will be (V1+V1)/2=V1. Further, input data for a gray-scale level 4 are [0011], and the first and second field voltages VF1 and VF2 are V2 and V3, respectively, so that a mean voltage will be (V2+V3)/2. Furthermore, input data for a gray-scale level 16 are all is, and the first and second field voltages VF1 and VF2 are V8 and V9, respectively, so that a mean voltage will be (V8+V9)/2.

Here, the gray-scale level 1 is the brightest level (a white level), and the gray-scale level 16 is the darkest level (a black level). As shown in FIG. 45, a voltage difference between VF1 and VF2 is set to be smaller than a predetermined voltage (preferably 0.5 (V)) except for the gray-scale level 15 on the black level side. This is realized by setting the voltages V1 through V9 as, for example, 2.0 (V), 2.4 (V), 2.8, (V), 3.2 (V), 3.6 (V), 4.0 (V), 4.4 (V), 4.8 (V), and 5.2 (V). (Refer to FIG. 46.)

As shown in FIGS. 47A and 47B, the 30 Hz flickering is observed when different voltages are applied to fields, respectively, and when polarity is inverted in adjacent frames. The 30 Hz flickering may be solved by carrying out the double speed scanning with the use of frame memories to double the frequency of flickering to 60 Hz. This method, however, requires a memory to be provided for each frame, thereby increasing the cost and scale of a circuit.

To deal with this, inventors of the present invention have considered a relationship between a voltage difference between fields and an optical response frequency, and repeatedly conducted tests. As a result, the inventors have found a range (a flickerless range) below a predetermined voltage difference where the flickering is not conspicuous.

Figure 48:
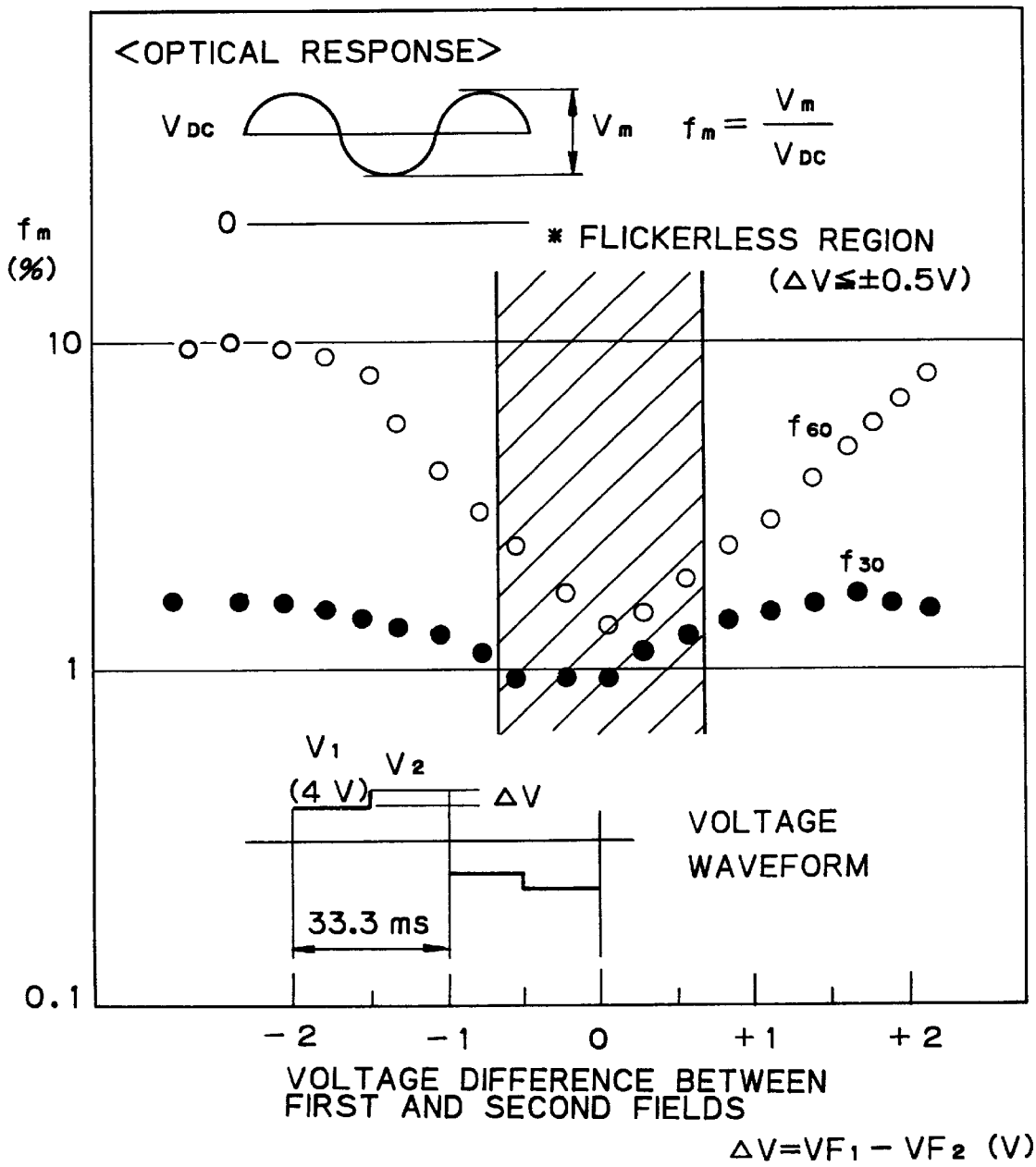
FIG. 48 is an explanatory view showing a relationship between a voltage difference (VF1−VF2) and flickering.

A hatched portion in FIG. 48 indicates the flickerless range. This range corresponds to a voltage difference of about 0.5 (V) or smaller between the first and second fields (or a difference of about 1~3% or smaller in terms of flickering rate). This means that, if combinations of voltages to be applied for a plurality of fields are determined such that a voltage difference between the applied voltages is less than the predetermined voltage difference (namely, if a difference between VF1 and VF2 is set to be less than 0. 5 (V)) on at least the white level side, the 30 Hz flickering will be inconspicuous.

Figure 49A:
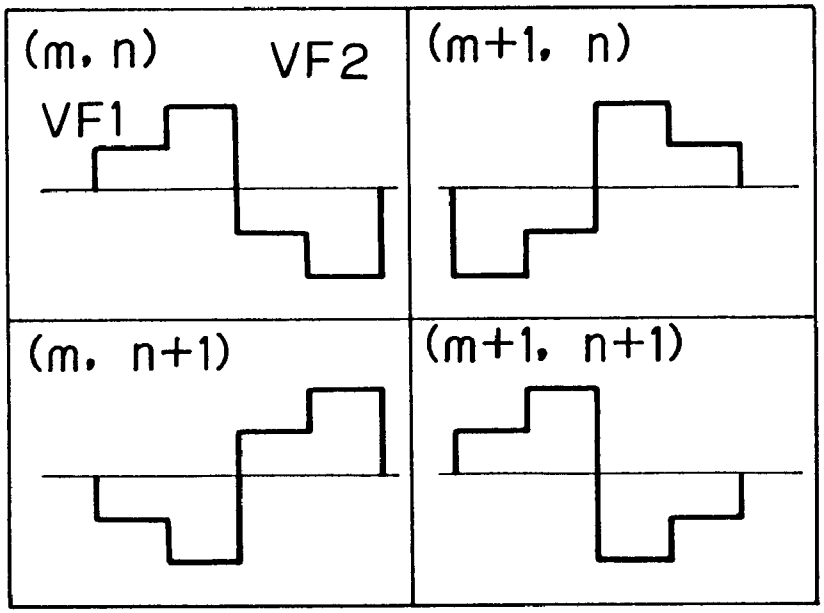
FIG. 49A is a view showing examples of voltage waveforms between adjacent cells and FIGS. 49B to 49F are response waveforms of the cells.
Figures 49B, 49C, 49D, 49E, 49F:
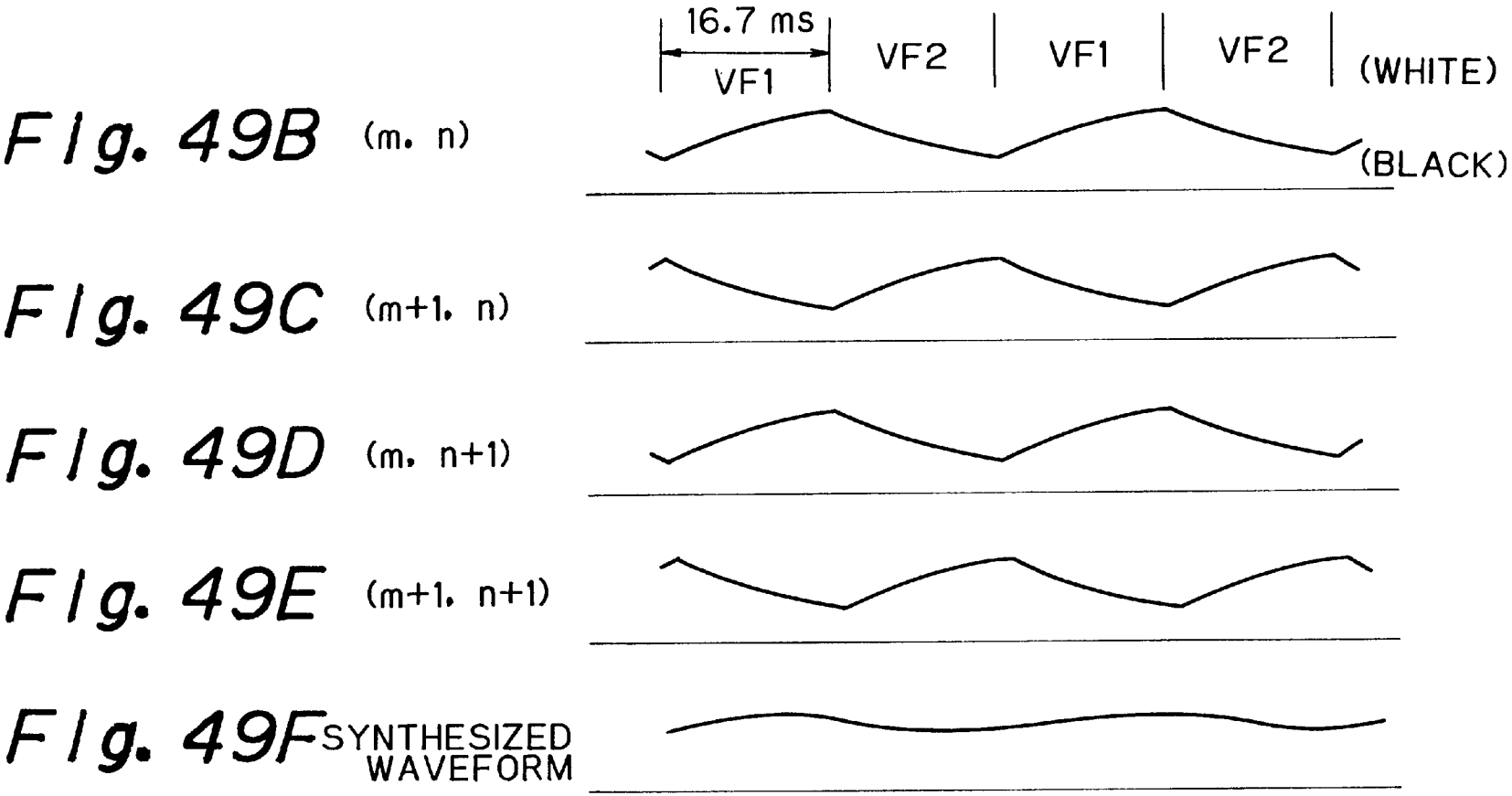

Further, as shown in FIG. 49A, according to this embodiment, combinations of first field voltage VF1 and second field voltage VF2 are applied to adjacent liquid crystal cells, respectively, and also, voltage polarities differ from each other between the cells. FIGS. 49B to 49F show response waveforms of the adjacent liquid crystal cells shown in FIG. 49A. By applying the field voltage like this, different optical response waveforms may scatter over the surface uniformly, thereby more effectively suppressing the flickering between the cells.

In this way, this embodiment inverts the polarities of voltages applied to adjacent cells, to differ the flickering phases of the adjacent cells by 180 degrees. This doubles a flickering frequency to 60 Hz in terms of surface average, thereby suppressing the 30 Hz flickering. In addition, a difference in field voltages in one frame is less than 0.5 (V) to surely suppress the 30 Hz flickering.

In this embodiment, a voltage difference of a gray-scale level 15 is 0.8 (V), which exceeds the preferable voltage difference (0.5 (V)). This causes no actual problem because the gray-scale level 15 is on the black level side where the flickering is inconspicuous.

Figure 50:
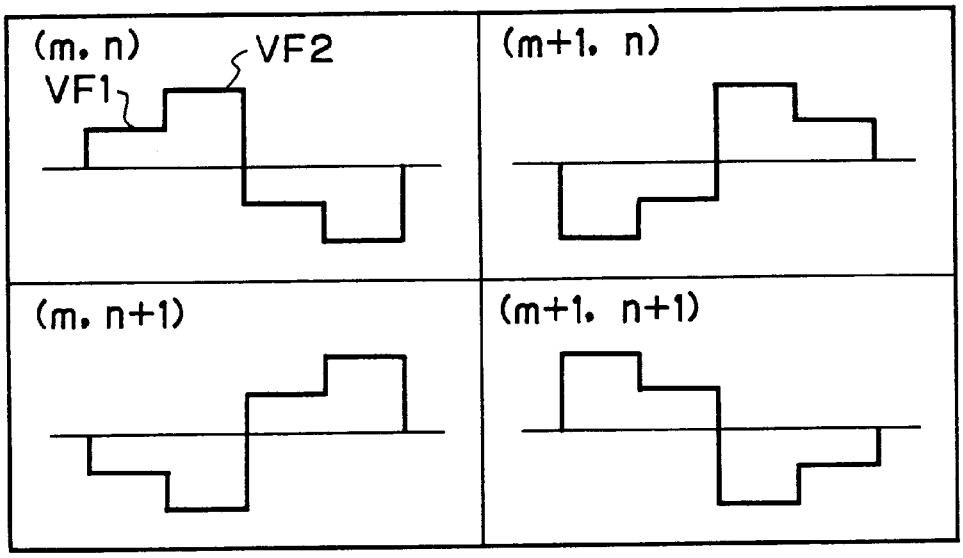
FIG. 50 is a view showing other examples of voltage waveforms between adjacent cells.
Figure 51:
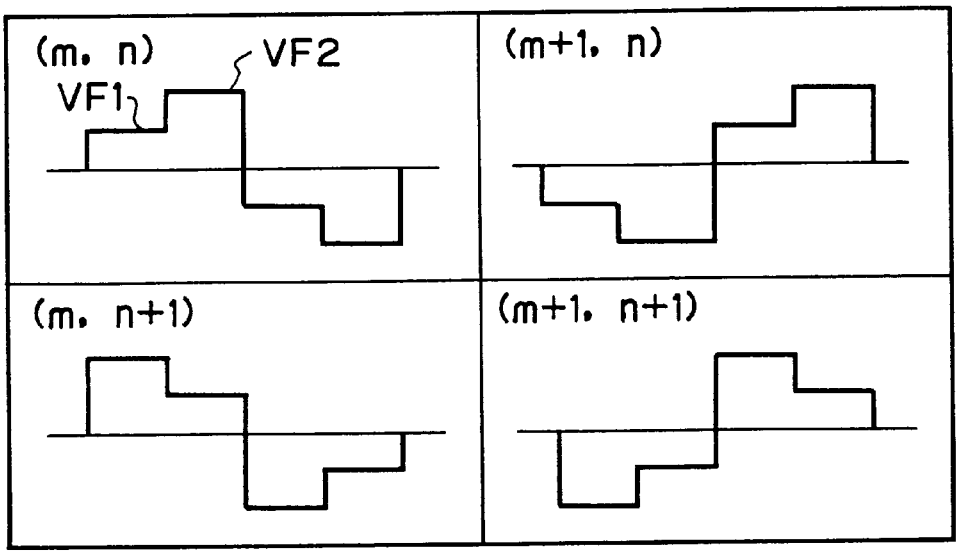
FIG. 51 is a view showing other examples of voltage waveforms between adjacent cells.
Figure 52:
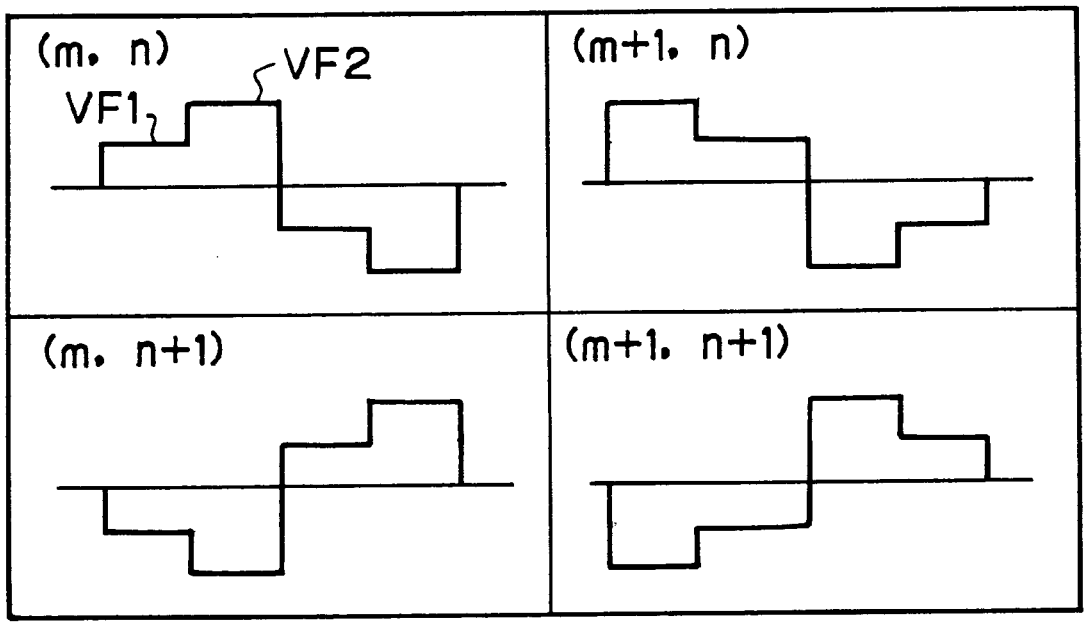
FIG. 52 is a view showing other examples of voltage waveforms between adjacent cells.

Voltage waveforms between adjacent cells are not limited to the above examples but may be as those shown in FIGS. 50 through 52. In FIG. 50, the combination and polarity of VF1 and VF2 are changed in a horizontal direction (data line direction: m, m+1), while the polarity of voltages is changed in a vertical direction (scan line direction: n,n+1). In FIG. 51, the polarity of voltages is changed in the horizontal direction (data line direction: m, m+1), and combinations of VF1 and VF2 are changed in the vertical direction (scan line direction: n, n+1). In FIG. 52 combinations of VF1 and VF2 are changed in the horizontal direction (data line direction: m, m+1), and the polarity of voltages is changed in the vertical direction (scan line direction:

n, n+1).

In any of the examples, the flickering frequency may be doubled to 60 Hz in terms of surface average, thereby suppressing the 30 Hz flickering.

Figures 33, 53A:
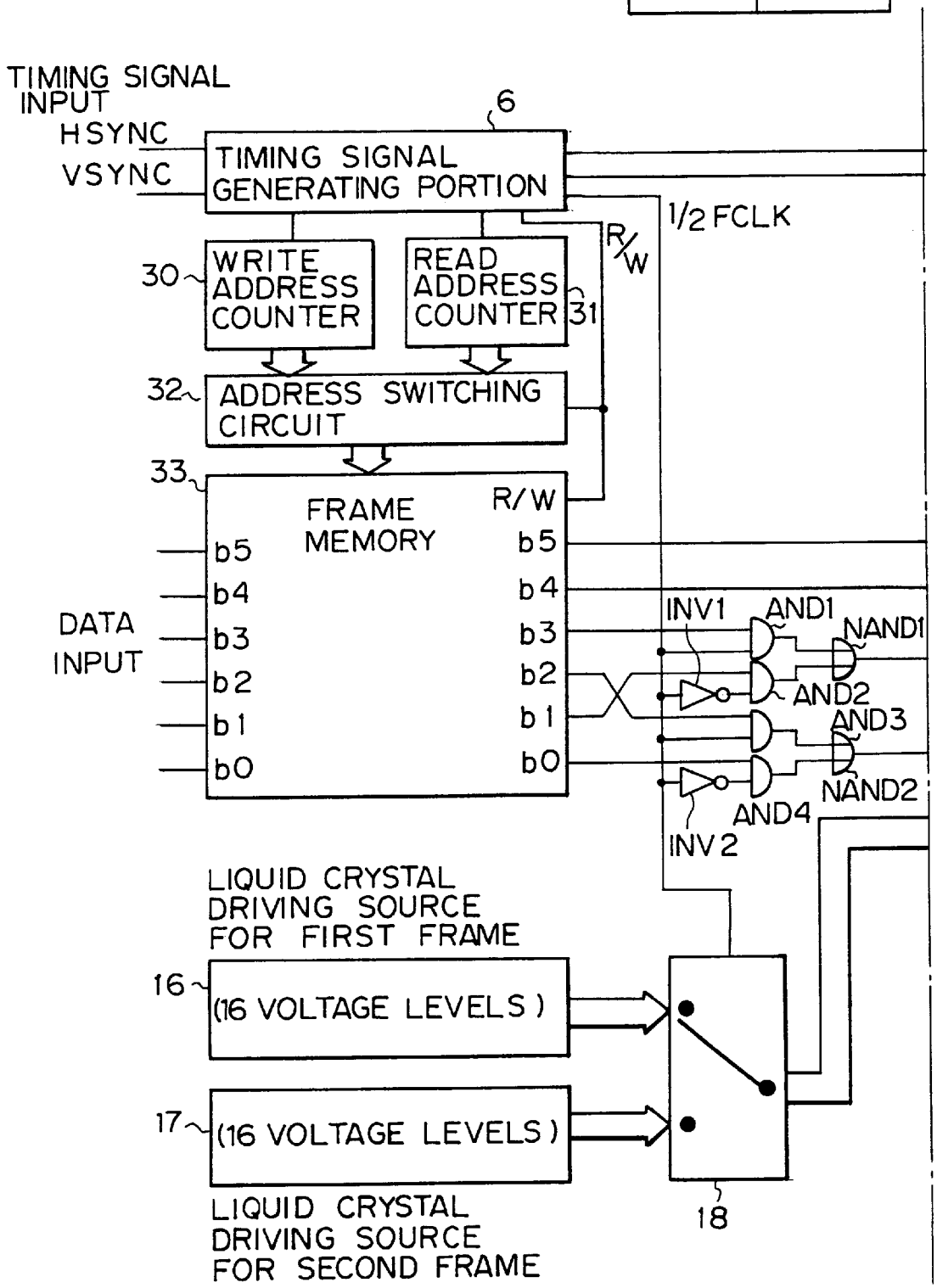
FIGS. 53A and 53B are a block diagram showing a general arrangement of an eighth embodiment.
Figure 53B:
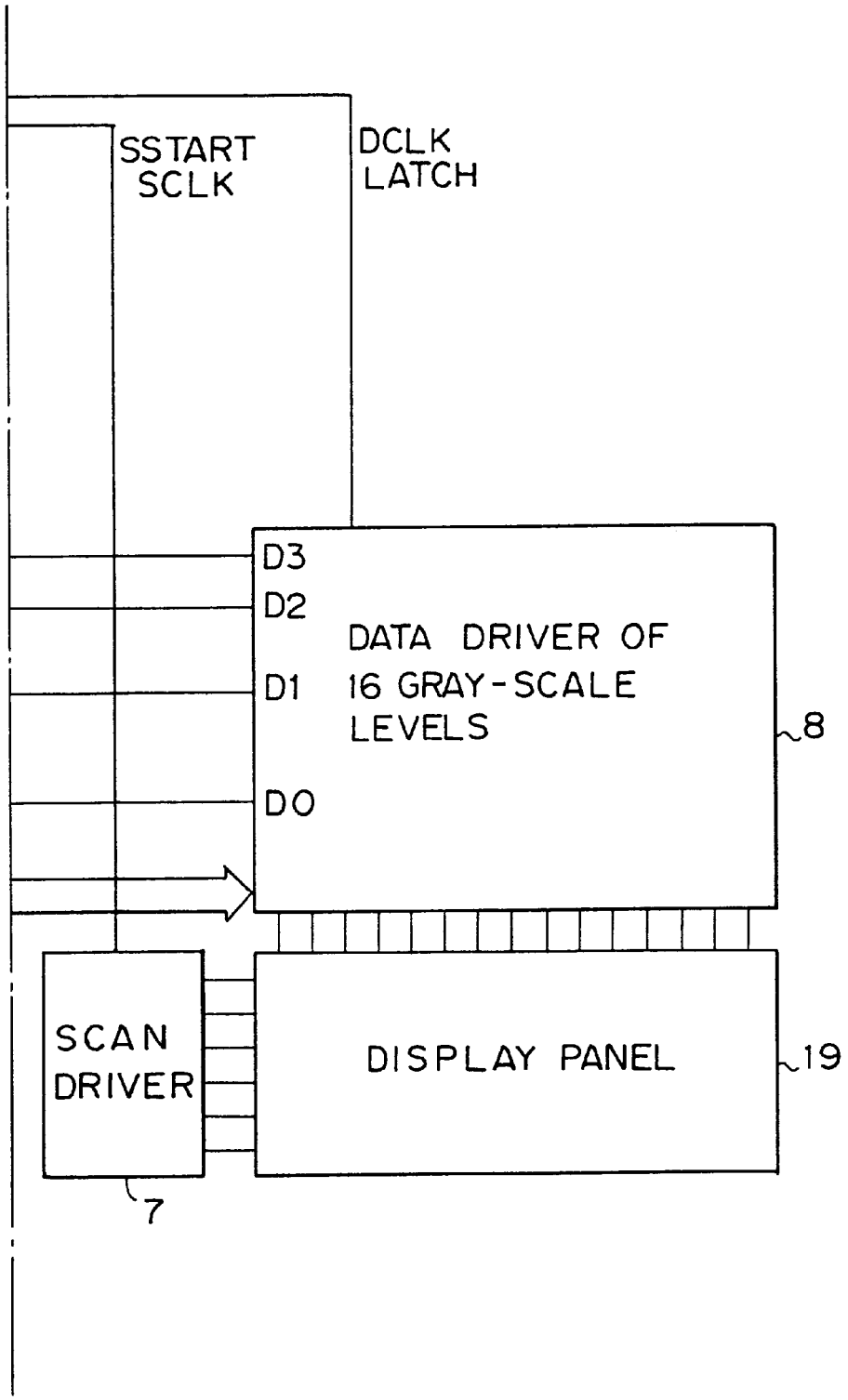

FIGS. 53A to 58 are views showing a liquid crystal display unit according to an eighth embodiment of the present invention, in which FIGS. 53A and 53B is a block diagram showing a general arrangement of the embodiment serving as a circuit for assigning 16 gray-scale levels with the use of an 8-gray-scale-level driver.

To assign 64 gray-scale levels with a digital driver IC of 16 gray-scale levels in the previous embodiments, arrangement of voltages for changing transmissivities is divided into four sections as shown in FIG. 31, and 16 voltage levels are prepared for each of the first and second fields. The 16 voltage levels are separated into four groups corresponding to the four sections.

At this time, to equally distance mean values of combined voltages each involving two voltage levels from one another, the following equations are conventionally employed:

$$V1m'=Vmin+(Vmax-Vmin)\times 2\ m/(n-1) \quad (1)$$

$$V2m'=Vmin+(Vmax-Vmin)\times 2\ mn^{1/2}/(n-1) \quad (2)$$

where Vmin is a minimum voltage in each section, Vmax a maximum voltage in each section, n the number of gray-scale levels in each section, and m being 0, 1, . . . ,n/2−1. FIG. 54 shows voltages set according to the equations (1) and (2). Namely, for each field, the voltages are separated into the first group, second group, and so on in the descending order, and voltages in the same group for the two fields are combined with one another. Accordingly, combinations in each group form 4×4=16 voltages, and the four groups provide 64 voltages, i.e., 64 gray-scale levels in total.

Figure 55:
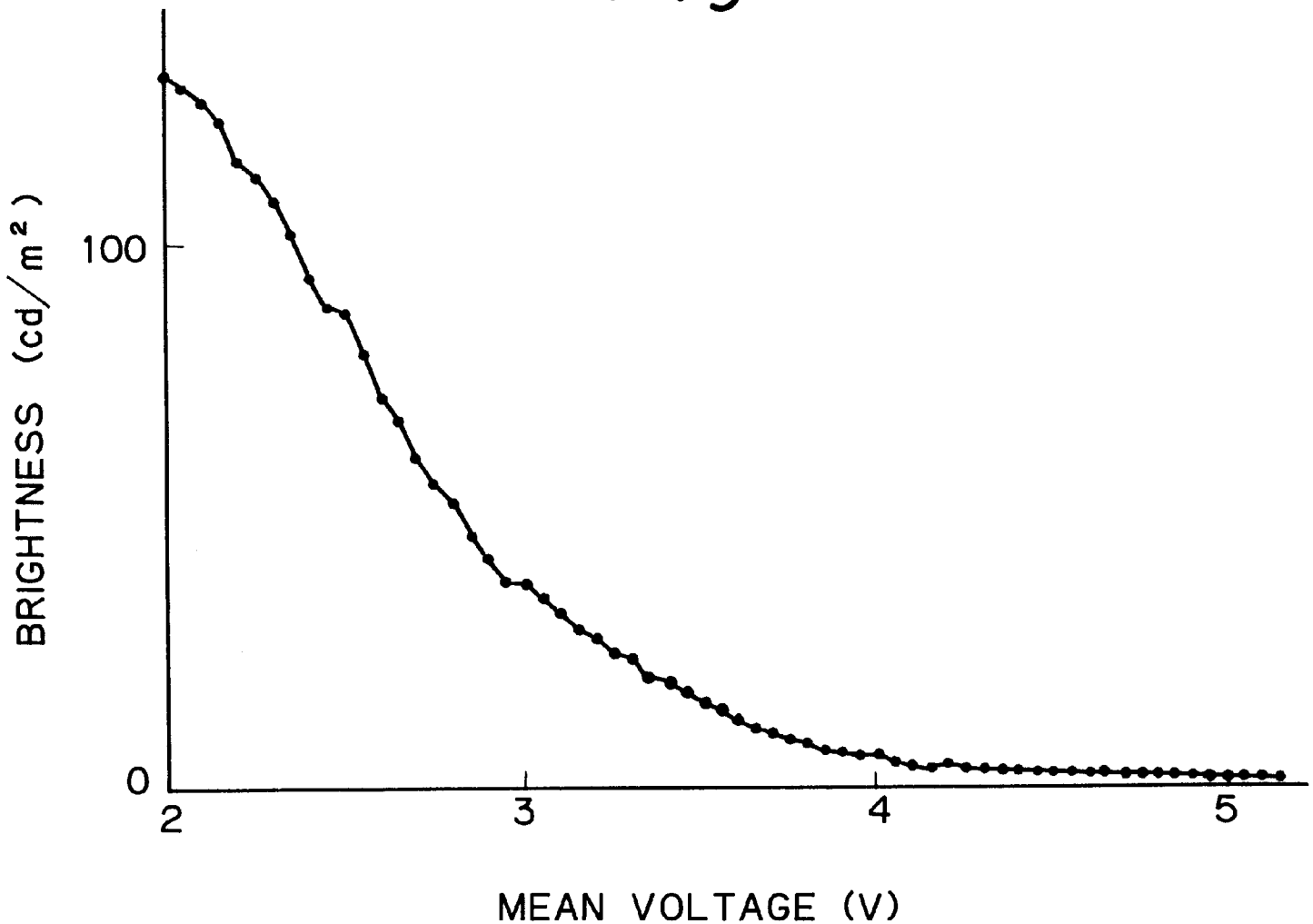
FIG. 55 is a view showing a relationship between an average voltage and brightness according to a conventional voltage setting.
Figure 56:
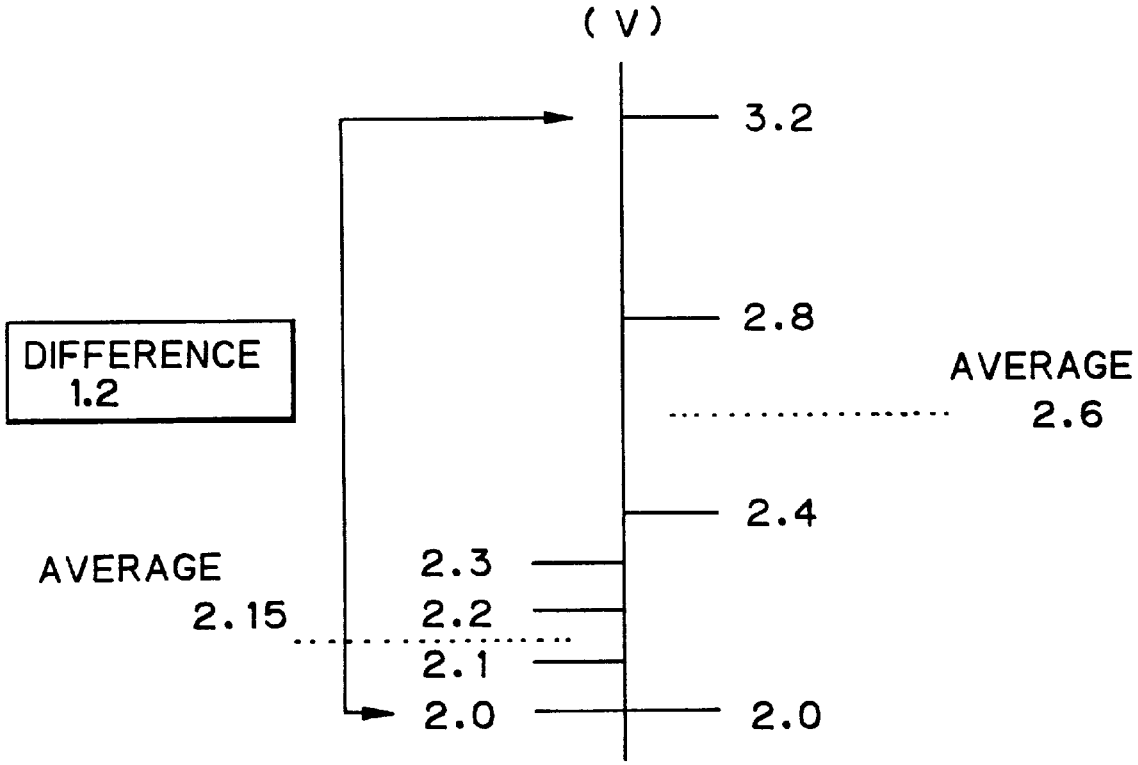
FIG. 56 is a view showing the conventional voltage setting.

FIGS. 55 and 56 show a relationship between a gray-scale level and brightness according to the above voltage sets. As is apparent in the figures, gray-scale levels are swapped with one another in a low brightness region, and in a high brightness region, a difference between gray-scale levels is narrowed although there is no swapping of gray-scale levels in the high brightness region.

Figure 57A:
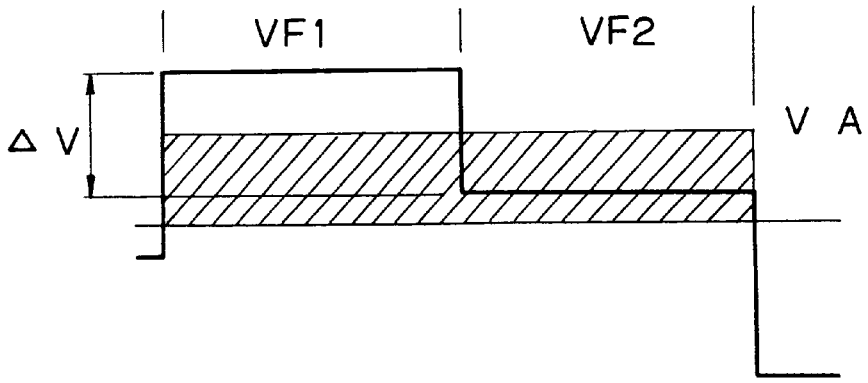
FIGS. 57A and 57B is a view explaining problems of the conventional voltage setting.
Figure 57B:
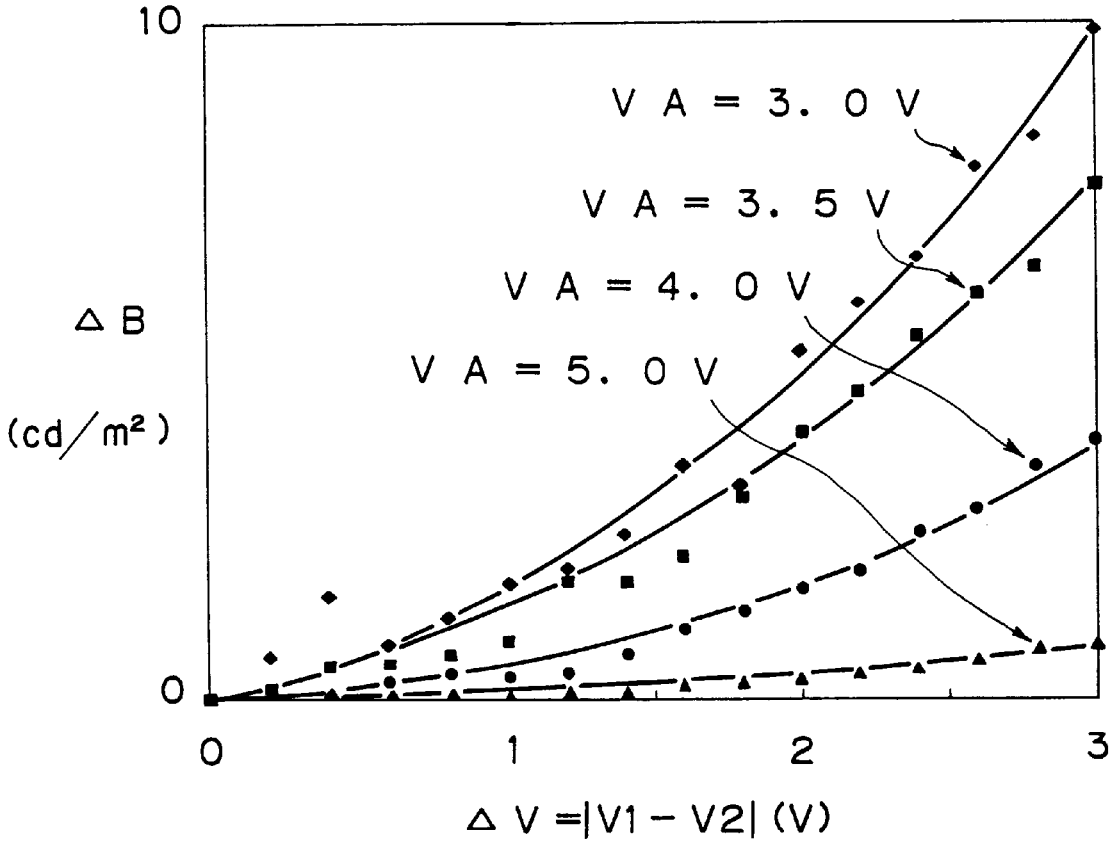

In FIGS. 57A and 57B which show a relationship between a change in brightness and a voltage difference, the above phenomenon is conspicuous as the voltage difference becomes larger. If this happens, input image data may not be correctly regenerated. The previously explained FIG. 23 shows causes of this sort of swapping of gray-scale levels and narrowed gray-scale levels. The brightness-voltage characteristics of a liquid crystal panel are not linear, and the brightness changes according to voltages in each field. If a difference between two voltages combined is too large, the brightness obtained will not be proportional to an average of the voltages but an average of brightness values obtained by the voltages respectively, so that the brightness obtained deviates from required brightness.

For example, the swapping of gray-scale levels or the narrowed gray-scale level differences may occur around a boundary where, on the one side of the boundary, a required brightness level is obtained according to a combination of the same voltages, and on the other side of the boundary, an obtained brightness level greatly deviates from a required brightness due to a combination of greatly differing voltages.

This embodiment intends to suppress this sort of deterioration of display quality. In FIGS. 53A and 53B, numeral 30 denotes a write address counter, 31 a read address counter, 32 an address switching circuit, 33 a frame memory, INV1 and INV2 inverters, AND1 through AND4 AND gates, and NAND1 and NAND2 NAND gates.

With this arrangement, a first frame liquid crystal driving source 16 and a second frame liquid crystal driving source 17 generate, according to an idea of voltage setting of this embodiment, first field voltages VF1 (16 levels) and second field voltages VF2 (16 levels),respectively. A timing signal generating portion 6 sequentially doubles a vertical synchronous signal VSYNC to provide a signal 1/2 FCLK having a frequency which is twice the frame frequency. A driving source switching portion 18 is controlled according to the signal 1/2 FCLK, and switches the two sets of voltages according to fields, and provides the selected set to a data driver of 8 of the 16 gray-scale levels.

An externally provided data signal of 6 bits for 64 gray-scale levels is written, according to a timing signal W/R for indicating write timing, in the frame memory at an address indicated by the write address counter 30, which receives a write address generating clock signal WCLK from the timing signal generating portion 6. The data are read two times in a period of one frame for one screen data according to a timing signal *W/R indicating read timing from a read address indicated by the read address counter 31, which receives a read address generating clock signal RCLK from the timing signal generating portion 6.

At this time, voltages must be selected so that a gray-scale level indicated by the data is realized with two fields. For this purpose, the upper two bits b5 and b4 of the data for each of the first and second fields are provided as they are to the upper two bits D3 and D2 of the data driver of 8 of the 16 gray-scale levels. On the other hand, among lower four bits of the data, bits b3 and b2 for the first field and bits b1 and b0 for the second fields are swapped with one another through the data switching circuit, and provided to lower two bits D1 and D0 of the data driver of 8 of the 16 gray-scale levels.

A scan driver 7 selects a scan line corresponding to the input data provided to the data driver 8 according to a clock signal SCLK having a frequency of about twice the frequency of a horizontal synchronous signal HSYN externally provided, thereby assigning, and cooperating with the data driver 8, a required gray-scale level.

In more detail, as shown in FIG. 58, the same number of voltage levels are set for each of the two fields of one frame. Combinations of the voltage levels will form a maximum voltage Vmax and a minimum voltage Vmin with the number of combinations to be formed being n. Voltages applied to the two fields are V1*m* and V2*m* (m being 0, 1, . . . , (n1/2−1)), respectively, and set as follows:

$$V1m=(Vmax+Vmin)/2-(Vmax-Vmin)/(n^{1/2}+1)+(Vmax-Vmin)\times 2m/(n-1)$$

$$V2m=(Vmax+Vmin)/2-(Vmax-Vmin)\times n^{1/2}/(n^{1/2}+1)+(Vmax-Vmin)\times 2\ m\times 2^{1/2}/(n-1)$$

Figure 59:
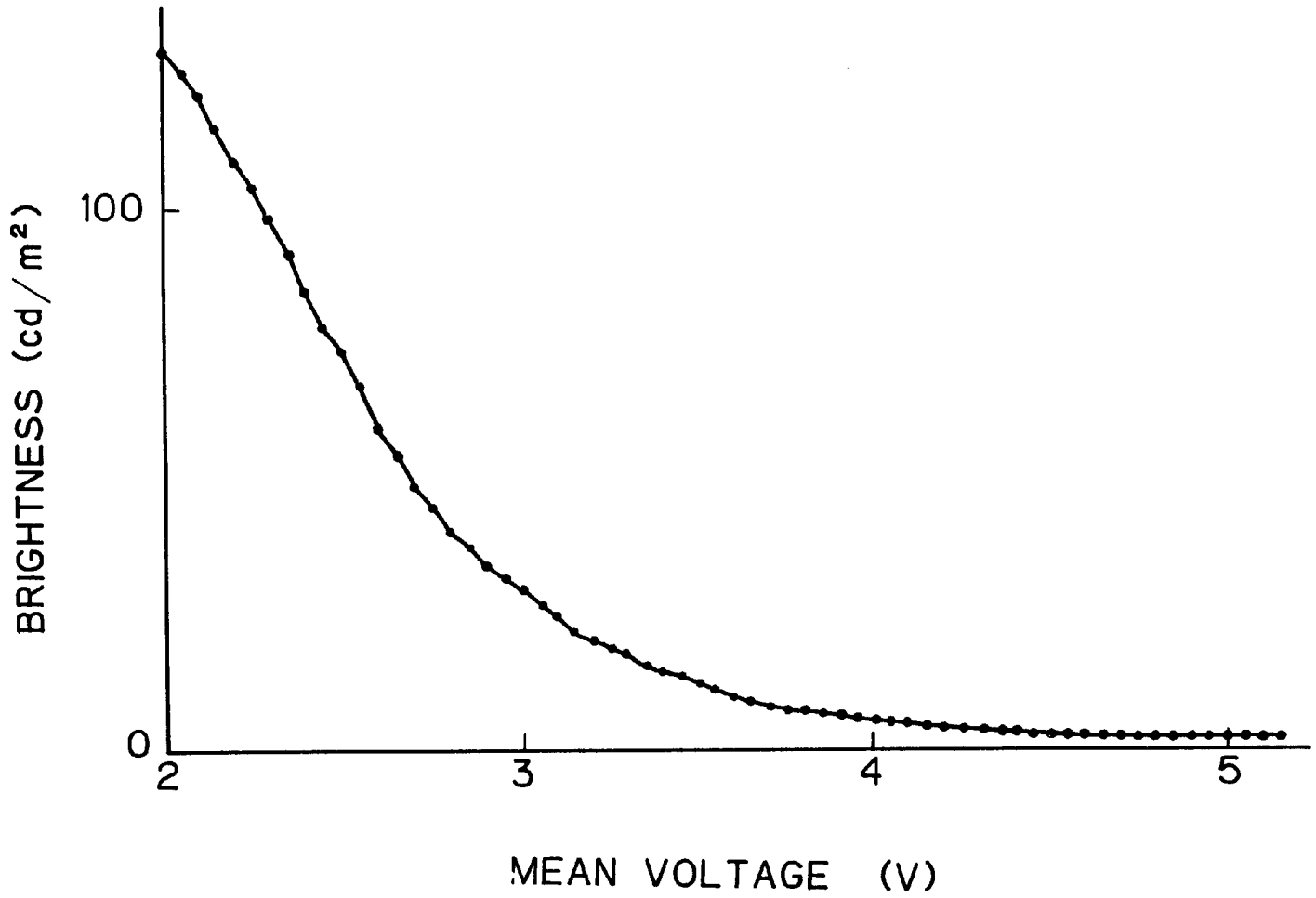
FIG. 59 is a view showing a relationship between an average voltage and brightness according to a voltage setting of the embodiment.
Figure 60:
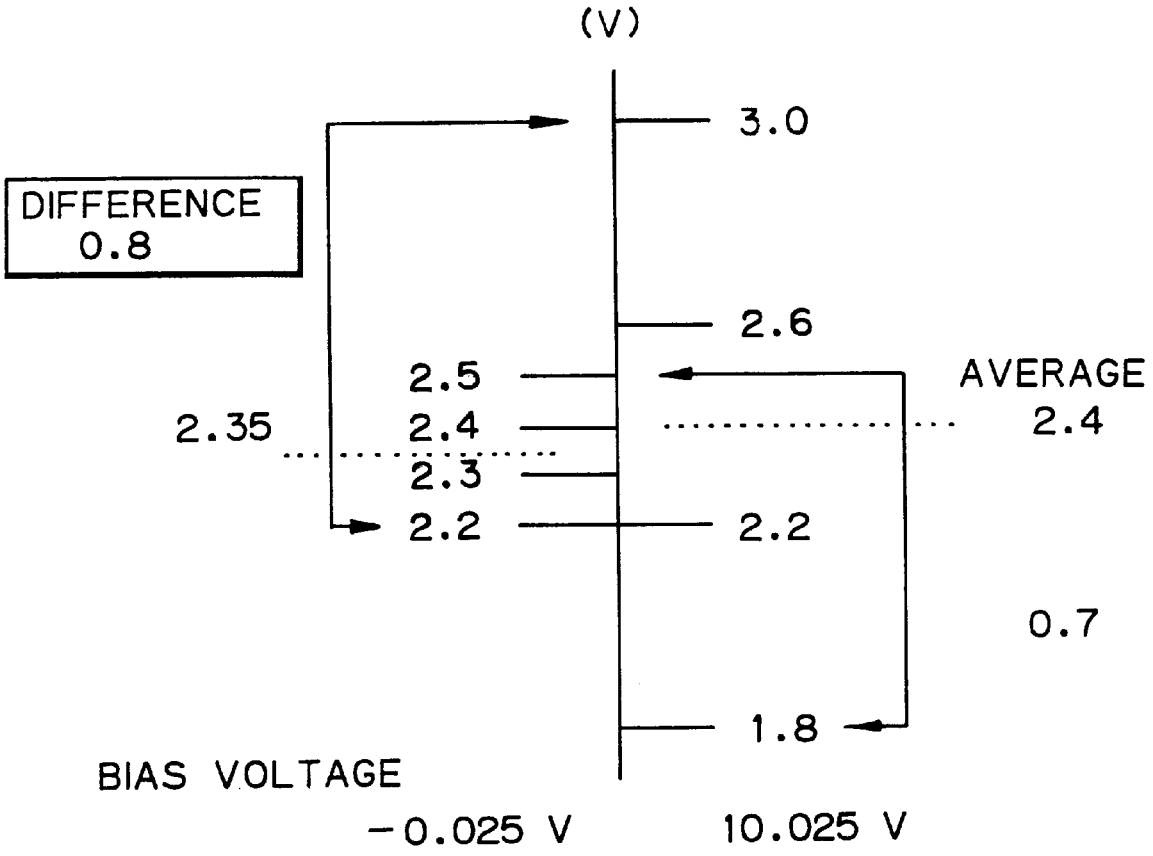
FIG. 60 is a view showing the voltage setting of the embodiment.

With this setting, an average voltage of each of the two voltage groups to be combined together becomes substantially identical. As a result, a voltage difference between the maximum and minimum voltages is minimized in each group, so that, as shown in FIGS. 59 and 60, gray-scale levels will cause no swapping or narrowing, thereby improving the quality of an image displayed with multiple gray-scale levels. Bias voltages of −0.025 (V) and +0.025 (V) have been added to the values.

In this way, when employing the field voltage modulation method to assign gray-scale levels whose number exceeds the number of gray-scale levels controlled by a data driver, this embodiment sets voltages so as to minimize a difference in voltages to be switched from one to another. The embodiment, therefore, is able to display an image with no swapping or narrowing of the gray-scale levels, and correctly assign multiple gray-scale levels with the use of an inexpensive data driver.

As mentioned above, according to the embodiments of the invention which carry out the double speed scanning, gray-scale levels are assigned according to a mean effective voltage of voltage levels applied to fields of one frame, respectively, so that inexpensive drivers may be employed to assign multiple gray-scale levels.

As a result, a high quality multiple gray-scale level assignment is realized at a low cost.

Although the above embodiments carry out the double speed scanning by increasing a scan frequency, this technique never limits the invention. Alternatively, combinations of voltages may be changed for every frame to drive liquid crystal cells.

Figure 61:
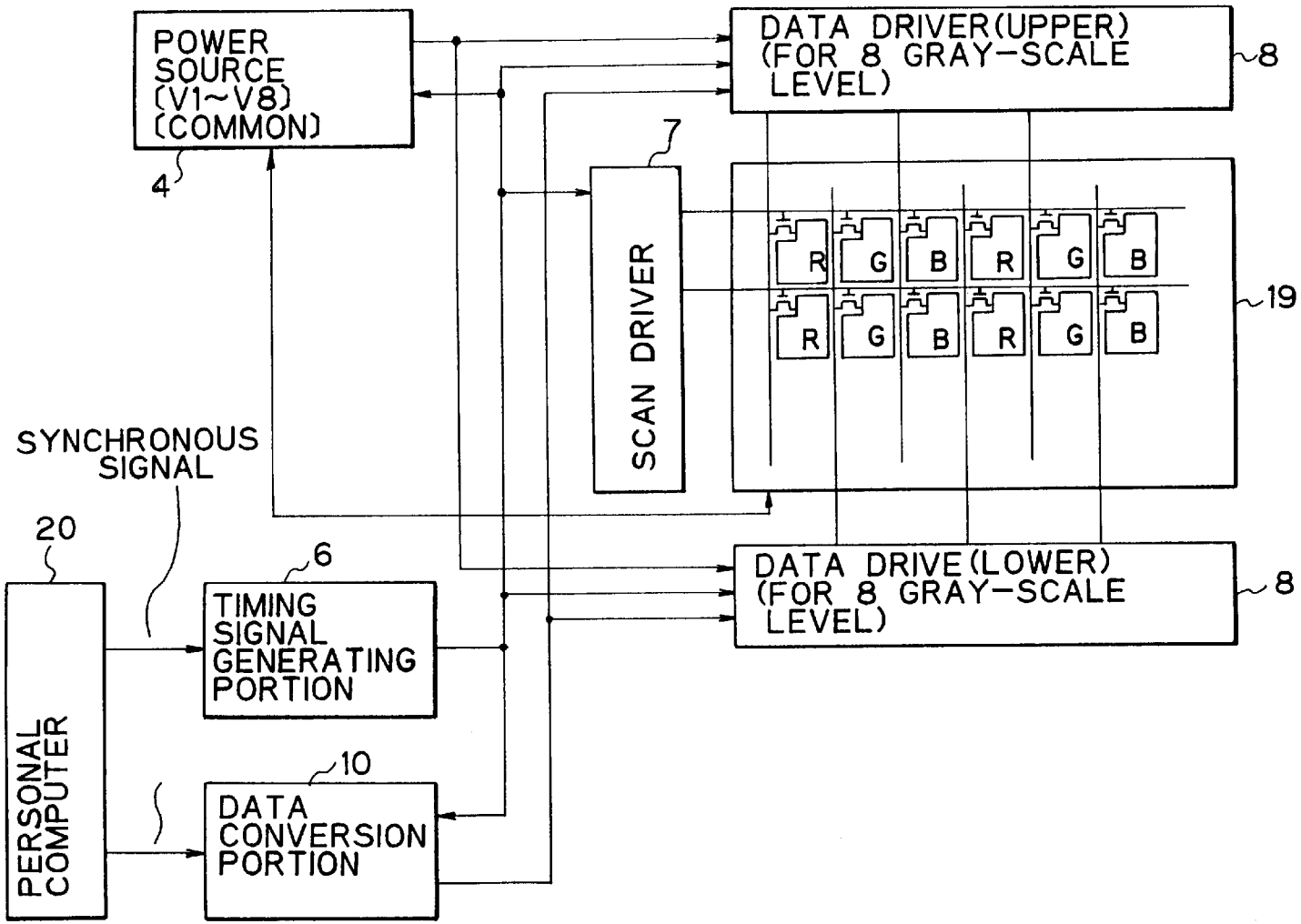
FIG. 61 is a block diagram showing a general arrangement of a ninth embodiment.
Figure 62:
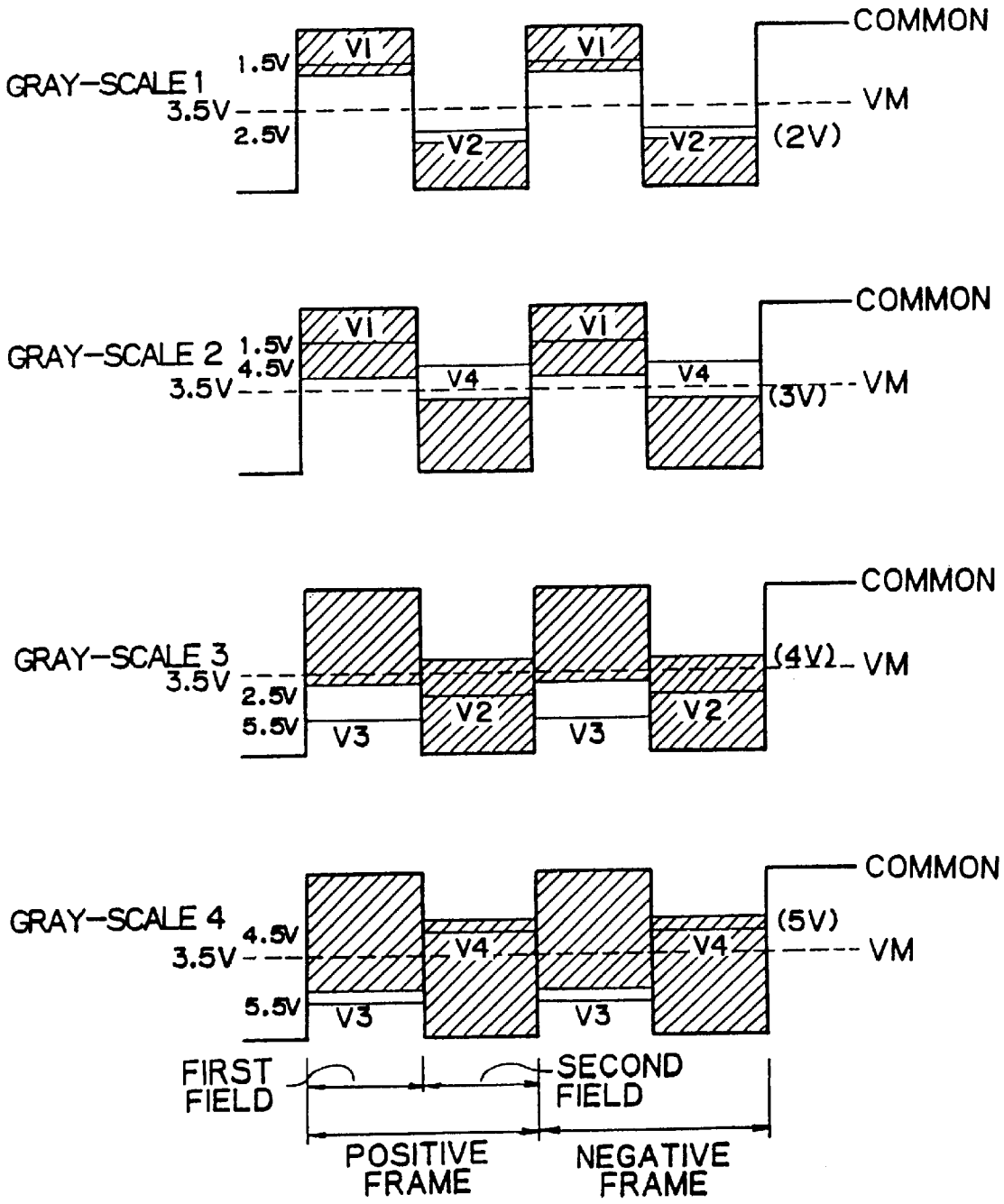
FIGS. 62A to 62D are views showing driving waveforms of liquid crystal according to the ninth embodiment.

FIGS. 61 to 63B are views showing a liquid crystal display unit according to an ninth embodiment of the present invention, in which FIG. 61 is a block diagram showing a general arrangement of the embodiment serving as a circuit for assigning 64 gray-scale levels with the use of an 8-gray-scale-level driver 8. In FIG. 61, the same numerals as those shown before represent the same parts, and only a power source 4, a timing signal generating portion 6, a scan driver 7, data drivers 8, a data conversion portion 10, a liquid crystal display panel 19, and personal computer 20 are shown.

FIGS. 62A to 62D show driving waveforms for respective fields according to the ninth embodiment. The difference between the first embodiment to eighth embodiment and this embodiment is the driving waveforms to get gray-scale levels. In the former embodiments, a polarity of the applied field voltages are the same in one frame, but the polarity of the applied field voltage in this embodiment is altered in every field as shown in FIGS. 62A to 62D.

Figure 63A:
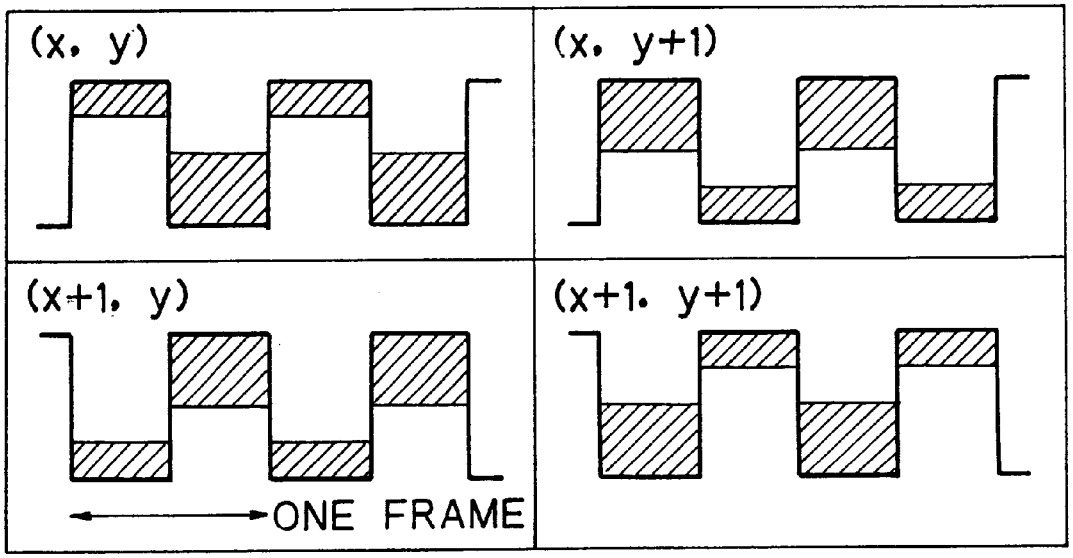
FIGS. 63A and 63B are views showing examples of voltage waveforms between adjacent cells.

Further, as shown in FIG. 63A, according to this embodiment, combinations of first field voltage and second field voltage are applied to adjacent liquid crystal cells, respectively, and also, voltage polarities are different from each other between the cells. By applying the field voltage like this, different optical response waveforms may scatter over the surface uniformly, thereby more effectively suppressing the flickering between the cells. However, when applying field voltages as shown in FIG. 63A, asymmetrical field voltages are applied to the liquid crystal as shown in FIG. 63A, thereby generating the residual image on the liquid crystal panel as time goes by.

Figure 63B:
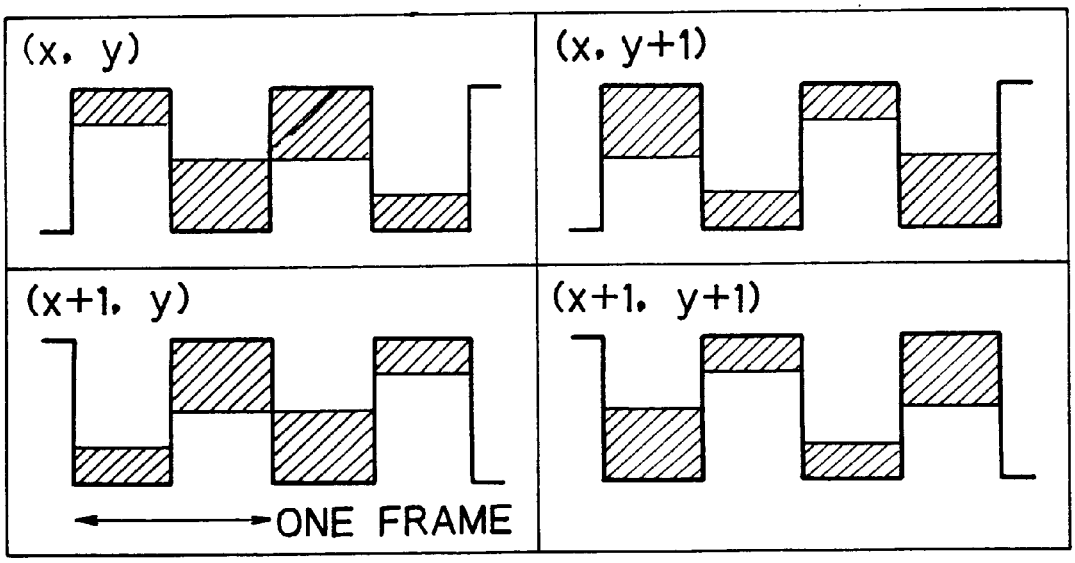

For preventing this residual image on the the liquid crystal panel, usually field voltages are applied as shown in FIG. 63B wherein the applied field voltage becomes totally symmetrical. In this way, in this embodiment the polarities of voltages applied to adjacent cells are inverted, to reduce flickering.

What is claimed is:

1. An apparatus controlling data voltage of a liquid crystal display unit having an active matrix liquid crystal display panel, a scan driver, and a data bus driver to display an image of one frame, comprising:

a timing signal generating portion generating at least timing signals for the scan driver and the data bus driver; and a data signal generating part coupled to the timing signal generating portion and dividing said image of one frame into a plurality of fields and outputting same to the data bus driver, said data bus driver applying different data voltage levels to each of the plurality of fields in the active matrix liquid crystal display panel and assigning a gray-scale level to the one frame according to a mean effective voltage of the voltage levels applied to each of the plurality of fields of the one frame, to obtain one of a plurality of gray-scale levels.

2. An apparatus as set forth in claim 1, wherein:

the one frame is formed of a first field and a second field;

said apparatus further comprises a voltage applying part generating voltage levels for the first field and the second field separately;

said timing signal generating portion generating a timing signal for switching each field;

the voltage applied to the data bus driver from the voltage applying part is switched from the first field voltage to the second field voltage and vice versa at every field by the timing signal for switching the field; and a plurality of voltage levels that are relative to a one-value common level are making voltage levels in an odd frame equal to those in an even frame.

3. An apparatus as set forth in claim 2, wherein the data signal generating part includes at least one frame memory, and a reading speed of the data signal from the frame memory is faster than a writing speed of the data signal to the frame memory.

4. An apparatus as set forth in claim 2, wherein one frame is formed of a first field and a second field;

the voltage applying part generates a binary common voltage level, and a plurality of voltage levels that are relative to the binary common voltage level is switched from one to another for every field such that an absolute voltage value in a positive frame is equal to that in a negative frame, the common voltage level and display data is inverted for every frame or line.

5. An apparatus as set forth in claim 1, wherein the data signal generating part includes a data conversion table, thereby the voltage levels applied by the voltage applying part are converted into preset gray-scale levels with use of a conversion table in order not to generate deviations in the displayed gray-scale levels.

6. An apparatus as set forth in claim 5, wherein the conversion table comprises a ROM.

7. An apparatus as set forth in claim 5, wherein the data signal generating part includes at least one frame memory and the reading speed of the data signal from the frame memory is faster than the writing speed of the data signal to the frame memory.

8. An apparatus as set forth in claim 7, wherein the conversion table comprises a ROM.

9. An apparatus as set forth in claim 2, wherein the voltage applying part generates a plurality of data voltage levels for each of the voltage ranges which are set by dividing the transmissivity-voltage characteristics of the liquid crystal pixels without overlapping; and the data signal generating part generates the data voltage selecting signal so as to select data voltage levels from each voltage range.

10. An apparatus as set forth in claim 9, wherein the data signal generating part generates the data voltage selecting signal from which the combination of the voltage levels is changed between adjacent pixels.

11. An apparatus as set forth in claim 9, wherein the data signal generating part generates the data voltage selecting signal from which the phase of the voltage levels is changed between adjacent pixels.

12. An apparatus as set forth in claim 9, wherein the data signal generating part generates the data voltage selecting signal from which the combination and phase of the voltage levels are changed between adjacent pixels.

13. An apparatus as set forth in claim 9, wherein the data signal generating part generates the data voltage selecting signal from which the polarity of the voltage levels is changed between adjacent pixels.

14. An apparatus as set forth in claim 9, wherein the data signal generating part includes at least one frame memory and the reading speed of the data signal from the frame memory is faster than the writing speed of the data signal to the frame memory.

15. An apparatus as set forth in claim 14, wherein the selecting signal generating part generates the data voltage selecting signal from which the combination of the voltage levels is changed between adjacent pixels.

16. An apparatus as set forth in claim 14, wherein the data signal generating part generates the data voltage selecting signal from which the phase of the voltage levels is changed between adjacent pixels.

17. An apparatus as set forth in claim 14, wherein the data signal generating part generates the data voltage selecting signal from which the combination and phase of the voltage levels are changed between adjacent pixels.

18. An apparatus as set forth in claim 14, wherein the data signal generating part generates the data voltage selecting signal from which the polarity of the voltage levels is changed between adjacent pixels.

19. An apparatus as set forth in claim 1, wherein the data signal generating part generates the data voltage selecting signal from which a combination of the applied voltages is determined such that a difference between the voltages applied to the fields respectively is below a predetermined value at least on the white level side.

20. An apparatus as set forth in claim 1, wherein the data signal generating part generates the data voltage selecting signal in order that averages of groups of the voltage levels prepared for a plurality of the fields may substantially be equal to one another between the fields, thereby the voltages applied to the liquid crystal pixels are set according to transmissivity-voltage characteristics of the liquid crystal pixels such that transmissivity changes at substantially equal intervals.

21. An apparatus as set forth in claim 20, wherein the voltage applying part generates the plurality of data voltage levels for each of the voltage ranges which are set by dividing the transmissivity-voltage characteristics of the liquid crystal pixels without overlapping; and the data signal generating part generates the data voltage selecting signal so as to select data voltage levels from each voltage range.

22. An apparatus as set forth in claim 21, wherein one frame is formed of two fields, and the same number of voltage levels V1*m* and V2*m* (m being 0, 1, . . . ,(n1/2−1)) are set for the fields, respectively, as follows:

$$V\,1m=(Vmax+Vmin)/2-(Vmax-Vmin)/(n^{1/2}+1)+(V\,max-V\,min)\times 2\,m/(n-1)$$

$$V\,2m=(Vmax+Vmin)/2-(Vmax-Vmin)\times n^{1/2}/(n^{1/2}+1)+(V\,max-V\,min)\times 2\,m\times n^{1/2}/(n-1)$$

where Vmax is a maximum voltage for a combination of the voltage levels, Vmin a minimum voltage for the combination of the voltage levels, and n the number of combinations of the voltage levels.

23. An apparatus as set forth in claim 22, wherein the voltage applying part generates the plurality of data voltage levels for each of the voltage ranges which are set by dividing the transmissivity-voltage characteristics of the liquid crystal pixels without overlapping; and the data signal generating part generates the data voltage selecting signal so as to select data voltage levels from each voltage range.

24. An apparatus as set forth in claim 1, wherein one frame is formed of a first field and a second field;

the voltage applying part generates a binary common voltage level, and a plurality of voltage levels that are relative to the binary common voltage level being switched from one to another for every field such that an absolute voltage value in a positive frame is equal to that in a negative frame, the common voltage level and display data being inverted for every field or line.

* * * * *